US009441357B1

(12) United States Patent
Vafaee

(10) Patent No.: US 9,441,357 B1
(45) **Date of Patent: *Sep. 13, 2016**

(54) CENTRAL CORE FOR A BUILDING

(76) Inventor: Farhad Vafaee, Los Angeles, CA (US)

( * ) Notice: Subject to any disclaimer, the term of this patent is extended or adjusted under 35 U.S.C. 154(b) by 1609 days.

This patent is subject to a terminal disclaimer.

(21) Appl. No.: 12/748,751

(22) Filed: Mar. 29, 2010

(51) Int. Cl.
*E04B 1/343* (2006.01)
*E04B 1/348* (2006.01)
*E04C 2/52* (2006.01)

(52) U.S. Cl.
CPC ..... *E04B 1/34336* (2013.01); *E04B 1/34869* (2013.01); *E04C 2/521* (2013.01)

(58) Field of Classification Search
CPC ..... E03C 1/01; E04C 2/52; E04C 2/521; E04F 17/08; E04B 1/34336; E04B 1/34869
USPC ..... 52/79.1, 79.2, 79.9, 79.8, 79.12, 79.13, 52/234, 236.3, 220.1, 220.2, 220.8
See application file for complete search history.

(56) References Cited

U.S. PATENT DOCUMENTS

| | | | | |
|---|---|---|---|---|
| 2,419,309 | A * | 4/1947 | Belchetz | 23/294 R |
| 3,694,973 | A | 10/1972 | Unger | |
| 4,198,791 | A | 4/1980 | Kalkaslief | |
| 4,327,529 | A | 5/1982 | Bigelow, Jr. et al. | |
| 4,353,411 | A | 10/1982 | Harter et al. | |
| 4,447,996 | A | 5/1984 | Maurer, Jr. et al. | |
| 4,513,545 | A | 4/1985 | Hopkins, Jr. | |
| 4,574,533 | A * | 3/1986 | Bigelow et al. | 52/34 |
| 4,655,011 | A | 4/1987 | Borges | |
| 4,745,712 | A | 5/1988 | O'Leary | |
| 5,127,201 | A | 7/1992 | Skvaril | |
| 5,528,866 | A | 6/1996 | Yulkowski | |
| 5,724,773 | A | 3/1998 | Hall | |
| 5,890,341 | A | 4/1999 | Bridges et al. | |
| 6,301,838 | B1 | 10/2001 | Hall | |
| 6,308,465 | B1 | 10/2001 | Galloway et al. | |
| 6,393,775 | B1 | 5/2002 | Staschik | |
| 6,651,393 | B2 | 11/2003 | Don et al. | |
| 6,688,048 | B2 | 2/2004 | Staschik | |
| 6,820,375 | B2 | 11/2004 | Meeker | |
| 7,540,120 | B2 | 6/2009 | Miller | |
| 2002/0100235 | A1 | 8/2002 | Weiss | |
| 2002/0189173 | A1 | 12/2002 | Staschik | |
| 2005/0086895 | A1* | 4/2005 | Elliot et al. | 52/633 |
| 2006/0277838 | A1* | 12/2006 | Travez et al. | 52/79.1 |
| 2008/0148476 | A1 | 6/2008 | Lin | |
| 2009/0031642 | A1 | 2/2009 | Donovan | |
| 2009/0145079 | A1 | 6/2009 | Garcia | |
| 2011/0099918 | A1* | 5/2011 | Buchmann | 52/79.1 |

FOREIGN PATENT DOCUMENTS

| | | |
|---|---|---|
| JP | 06-058002 U | 8/1994 |

* cited by examiner

*Primary Examiner* — Jessica Laux
(74) *Attorney, Agent, or Firm* — Norton R. Townsley; Belasco Jacobs and Townsley, LLP

(57) ABSTRACT

A prefabricated core for a building with all services already built in. The core serves as: 1. the housing for all the home's mechanical, plumbing and electrical sources, and 2. a major structural support, providing three shear walls to the structure. This invention allows access to all of the services thus allowing for ease of maintenance and avoidance of collateral damage during renovations and remodeling.

27 Claims, 50 Drawing Sheets

CENTRAL CORE FOR A BUILDING

BACKGROUND OF THE INVENTION (1) Field of the Invention

The present invention relates to the field of building construction and more particularly to the field of prefabricated building construction.

(2) Description of the Related Art

Currently, houses are built in a standard sequence. The following is a typical sequence.

Grading and site preparation

Construction of foundation. Typically premixed concrete is poured or pumped into molds constructed on the site.

Erection of framing on the foundation. Wood and steel are usually used for framing members. Openings are left in the framing for placement of doors and windows.

Installation of windows and doors.

Construction of roofing on top of the framing.

Installation of exterior walls and/or siding.

Installation of rough electrical wiring.

Installation of rough plumbing.

Installation of rough heating, ventilation and air conditioning (HVAC).

Installation of alarm system wiring.

Installation of phone system wiring.

Installation of local area network LAN wiring.

Installation of insulation in exterior walls and attic.

Attachment of drywall to interior of framing.

Installation of underlayment for floors.

Installation of trim

Painting.

Installation of finish electrical, such as switches and lights.

Installation of finish alarm system.

Installation of LAN and phone system jacks and cover plates.

Installation of bathroom and kitchen counters and cabinets

Installation of finish plumbing, such as sinks, toilets and faucets.

Installation of carpet and other flooring.

Installation of HVAC units.

Hookup to water main or well.

Hookup to sewer or septic system

Correction of problems.

Homes are built to the current standards and government codes and with the latest available amenities. But such construction does not allow for adaptability and installation of new technology. For example, demolition and reconstruction are required if the homeowner wishes to upgrade the existing home's layout and fixtures, or they wish to upgrade the infrastructure (plumbing, electrical, communications, etc.). Since the home's infrastructure is so integrated into the superstructure, it is nearly impossible to simply rearrange spaces without also reconfiguring the main systems of the house as well.

Another problem with typical home construction is that it takes a long time. Usually the foundation is poured quickly and the framing is built very fast but after that it takes a long time to for all the subcontractors to install the electrical, plumbing, etc.

A number of inventors have attempted to solve one or other of these problems.

(1) U.S. Pat. No. 4,447,996

This Patent is directed to prefabricated building structures for use in buildings with multiple units. The building will have modules to accept cubicles that are factory built containing an entire bathroom complete with lavatory, bathtub, water closet, and their associated plumbing, electrical wiring, outlets, exhaust fan and the like. The module likewise could be a complete kitchen with appliance, wiring and the like. The prefabricated module that receives the cubicle can be placed to form the building by means of a crane and if the crane is of sufficient capacity the prefabricated cubicle could be positioned in the module and both installed at the same time. The cubicle will have one wall that is an exterior wall so that at a time to upgrade or repair a fire damaged unit a refurbished or new unit can be brought on site and the old one removed with the aid of rollers so that it can be rolled out to the crane. It would also be possible to change the type of cubicle from for instance kitchen to bathroom or bathroom to kitchen.

(2) U.S. Pat. No. 6,301,838

This Patent is directed to building modules that can be prefabricated and installed in a building structure complete. The first building module is shown in FIG. 1 is for one bathroom and the larger module shown in FIG. 6 is for two rooms, electrical junction boxes and supply lines to light fan outlets and other fixtures conveniently extended within the module making it convenient and easy to connect the module to the electrical supply lines. Likewise with the dryer vent, hot and cold water lines, gas conduit and the waste lines. The toilets are off the floor water closet. The rooms preferably toilets with lavatory or wash basins, bath and shower may otherwise be laundry rooms, kitchens, custodian rooms, rest rooms, or other kinds of rooms requiring one or more waste conduits to carry away waste water and likely require cold water and electricity and possibly hot water. Such rooms may further require gas dryer vents and other lines or conduits.

(3) U.S. Pat. No. 5,528,866

This Patent is directed to a method and apparatus' for constructing multi-rise stacked modules for human occupancy. The construction is in a pinwheel array with the method of construction providing for individual models that may be readily positioned and removed without affecting the structural integrity of the multi-rise structure. The modules are prefabricated, electrical and water services may be provided through hookups to a vertically extending electrical and water surface panels supported about a central open core. The dwelling modules could encompass habitat for residence, office, manufacture, or other human uses.

(4) U.S. Pat. No. 7,540,120

This patent is directed to a multi-level apartment building that includes a vertically extending stairway system with support walls that contain rectilinearly vertically extending utility service conduits used to receive standard utility services such as HVAC, plumbing, exhaust, etc. that extend in vertical straight line paths in the building thus the single stair support assembly vertically extending in each of the plurality of vertically aligned apartments function to consolidate plumbing, HVAC and other utilities into a single assembly having a straight vertical and unobstructed path. The apartment modules preferably includes a plurality of pairs of apartments vertically stacked in alternating mirrored patterns and a plurality of such vertically stacked pairs of apartments horizontally aligned with one another.

(5) U.S. Pre-Grant Publication 2009/0031642

This reference is directed to interactive building modules that move between a collapsed configuration which is sized and shaped similarly to a standard shipping container that can be erected where it forms a building of greater space. The modules are connected together to form a single storied or multi-storied building. A series of standardized ceiling panels located within the common area create accessible services duct for placement of hydraulic, electrical, and that illumes. Hot water is distributed to each module via a continuous hot water loom. A network managing system interactively manages resources. Scenarios for use of modules are virtual space, serviced office, hotel or serviced apartment or residential uses. The scenarios are not mutually exclusive. The design principle enables the same space to be used for different uses over time. The transference of a module from one use to another beside changing the furniture possibly the reprogramming or alternation of certain services to suit the requirements of the occupant and the new use of the module. The internal fit-out may consist of a range of standard plug-in modular components providing a variety of function and form.

(6) U.S. Pat. No. 4,327,529

This reference is directed to a prefabricated building comprising: a plurality of exterior and interior wall sections joined together in a selected configuration; a plurality of ceiling panels extending between the walls; a plurality of roof trusses overlying the ceiling panels; a roof supported by the trusses; a prefabricated utility core comprising: a plurality of vertical connected core walls extending vertically, one of the core walls providing an exterior wall of the building, an access door in this exterior wall, a main sewer line supported in the core and extending through the exterior core wall and having a plurality of lateral sewer lines extending through the core walls, a main water line extending through the exterior core wall and supported in the core and having a plurality of lateral water lines extending through the core walls, a water heater in the core connected to the main water line, a main hot water line connected to the heater and having a plurality of lateral hot water lines extending through the core walls, a breaker box in the core, a plurality of electrical conduits extending from the breaker box; and fixtures utilizing water and discharging sewage connected to selected the appropriate lateral lines.

(7) U.S. Pat. No. 4,655,011

This reference is directed to a prefabricated building system comprising a portable wall unit having a supporting frame and utility apparatus mounted on the supporting frame. The utility apparatus preferably is adjustably mounted on the supporting frame and may comprise plumbing, electrical, heating and/or cooling apparatus for the rooms adjacent to the portable wall unit in the building in which it is to be installed. Prefabricated wall partitions for the adjacent rooms can be assembled with the portable wall unit before shipment to the building site or at the building site. The portable wall unit is provided with means for aligning the wall unit with the adjacent wall partitions to facilitate the assembly thereof.

(8) U.S. Pat. No. 5,127,201

This reference is directed to a compact service core structure. The walls of the prefabricated compact service core structure are higher than the total height of the floor, wall and ceiling structure of an ordinary one-storey residential building, but lower than the total height of a two-storey building of any kind. The height of the walls is large enough to e.g. accommodate the serviced fixtures of complete main floor bathroom, kitchen, and possibly laundry and utility rooms, as well as lower parts of the same rooms of the second storey of a two-storey structure. On the other hand, the height is small enough to make the prefabricated compact service core structure possible to ship on standard low trailers anywhere in the world. The prefabricated compact service core structure allows for factory completion of all major plumbing, heating, ventilation, and electrical work for a two-storey building, and easy on site hook-up to sewer, water, gas and electrical services from the bottom of the prefabricated compact service core structure ventilation and possibly electrical services may be extended above the top of the core through one or more extension service panels. As all portions of the floor of both storeys and high plumbing wall are suspended, pre-manufacturing of the service core in the plan can easily match all custom designed floor heights or deviations from them usually originating from the supply of building lumber of irregular dimensions.

(9) U.S. Pat. No. 5,890,341

This reference is directed to a modular structure consisting of three modular units of approximately the same size, the center module being the primary module containing the mechanical components of the building, with plumbing, air conditioning and heating ducts, and electrical wiring in the slab floor structural foundation and door jambs. The primary module used to transport the entire structure is completed at the factory, requiring no further work at jobsite, with heating and cooling unit, hot water heater, cabinets and appliances, plumbing and light fixtures and accessories installed at the factory in permanent locations. The major exterior walls, slab floor foundation panels, and ceiling/roof panels for all three modules are similarly manufactured in one piece in full width and the length of the building, eliminating joints, speeding assembly and strengthening the components. The major components of the side modules, consisting of the slab floor foundation panels, ceiling/roof panels and the exterior side walls, are all hinged so that they fold to the side and on top of the primary module. Accessories and wall panels and partitions not hinged are placed on top of the primary module for transportation. Two end walls are bolted to the center module during transportation to the site. At the pre-leveled permanent site, the primary module is lowered to the ground and the hinged slab floor foundation panels, which include hinged and folded exterior walls, along with the ceiling/roof panels, are unfolded and permanently fastened in place for that site, but can be refolded if later relocation is needed. The slab floor foundation panels for all three modules are placed directly on the ground or on a pre-built foundation, single or multi-level design. If a pitched roof was ordered, trusses and pre-sized roofing panels transported on top of the primary module are attached to the flat roof of the center module. Two or more of these triple modules can be joined side-to-side or end-to-end or on top of each other, for erection of multiple-unit buildings.

However, none of these inventions allow a house to be built without waiting for installation of services and none of these inventions allow for ease of maintenance or avoidance of damage during remodeling and renovations.

What is needed is a way of allowing a house to be built without waiting for installation of services and which, when built, would be easy to maintain and remodel.

Development of a way to allow houses to be built without waiting for installation of services and which, when built, would be easy to maintain and remodel represents a great improvement in the field of construction and satisfies a long felt need of the contractor and homeowner.

SUMMARY OF THE INVENTION

The instant invention is a core for a building comprising: an exterior wall section and three interior shear wall sections joined together to form a room at least two storeys tall. The outsides of the interior wall sections are finished with an interior finish; the outside of the exterior wall section are finished with an exterior finish.

A structural hold down which is used to attach the core to the foundation, is attached to the core at each corner. At least one interior platform is provided attached to the inside of at least one of the walls. There is a means for attaching a floor, external to the core, to each of the interior walls. There is an access door and a fresh air louver in the exterior wall. Water main and gas main connections are provided on the exterior wall and sewer connections are located inside the core.

A water heater is installed in the core. Clothes washer, drier and dishwasher connections are located adjacent and outside of one of the interior wall sections. Preferably a toilet mechanism is located within at least one of the interior wall sections. This is a special mechanism with a bowl that will be installed later. The mechanism is installed so that the bowl will install from outside of the core.

Faucets and mixing valves are attached to the outside of at least one of the interior wall sections. Plumbing and shut off valves interconnect the water main connection, gas main connection, sewer connection, water heater, clothes washer connection, drier connection, dishwasher connection, toilet mechanism, faucet and mixing valve as necessary and appropriate. The shut off valves are located adjacent the insides of the interior walls as close as possible to the appliances and the interior connections.

An irrigation connection, connected to the water main, is located outside the exterior wall section. An electric mains connection is located on the exterior of the exterior wall section. A breaker box is located within the core and electrically connected to the electric mains connection.

At least one forced air unit and an air conditioning condenser unit are installed within the core and connected to each other by appropriate piping. The condenser unit is located near the fresh air louver so that hot air produces by the condenser can readily escape through the louver. A return air duct stub and a supply air duct stub are connected to the forced air unit through one of the interior wall sections.

Phone line and television signal connections are located outside the exterior wall section. The phone line connection is punched down to a punch block within the core. The television signal connection is connected to a signal splitter located inside the core.

A modem is provided inside the core and electrically connected either the telephone punch block via a DSL line or the signal splitter. A security panel is provided inside the core and electrically connected to either telephone punch block or the modem.

A fire suppression unit is located within the core and connected by a plumbing line to the water main connection. Sprinkler line stubs run from the fire suppression unit through the interior walls of the core.

An exhaust fan is provided within the core. Inlet ducts run through interior walls of the core to the exhaust fan and an outlet duct runs from the fan to the fresh air louver. A control switch is attached to the outside of at least one of the interior wall sections and electrically connected to the exhaust fan.

A drier vent runs from behind the eventual location of the clothes drier through an interior wall through the core and through the exterior wall.

A range hood is attached to the inside of one of the interior walls over the eventual location of the range. A range exhaust fan is provided in the core. This is connected via ducting to the range hood. Exhaust ducting runs from the range exhaust fan to the fresh air louver and control wiring runs from the switch in the range hood to the range exhaust fan.

A core exhaust fan is located in the core adjacent the fresh air vent and a thermostatic control is located inside the core and electrically connected to the core exhaust fan.

This invention may include an internet protocol switching lighting control panel located within the core and electrically connected to the breaker box.

This invention may include a water filtration unit in the plumbing between the water main connection, and the appliances and the interior connections. This invention may further include a reverse osmosis unit to supply drinking water.

The modem may be a wired modem, wireless modem or a wired/wireless modem.

The invention may also include a central vacuum system. This comprises a canister in the core, vacuum outlets in the interior walls and vacuum tubing interconnecting them.

This invention may include a server within the core.

This invention may also include an interior room within the core. This is formed by attaching an interior floor to the wall sections one storey below the tops of the wall sections. This room is preferably a bathroom, which preferably includes another special toilet mechanism installed within at least one of the interior wall sections. This time the mechanism is installed so that the bowl for the toilet will install from inside of the core. The bathroom also includes faucets and mixing valves attached to the inside of at least one of the interior wall sections. Then plumbing and shut off valves are installed to interconnect the appliances in this interior bathroom with the water main connection, the sewer connection, and the water heater as necessary and appropriate; the shut off valves for these appliances being located under the interior floor as close as possible to the appliances.

The present invention is a module that will allow a house to be built without waiting for installation of services. This is because the module is prefabricated with all services already built in. Further, this module allows access to all of the services thus allowing for ease of maintenance and avoidance of collateral damage during renovations and remodeling. It will be recognized by those familiar with the art to which this invention pertains that this invention could, alternatively, be built on site.

The module of this invention separates the infrastructure from the superstructure in a way that allows the two buildings to be altered independent of each other. This is done by prefabricating an "Infrastructure Core," which contains all the plumbing, mechanical and electrical/communications equipent into one central location that serves the entire house and is easily accessible.

A central infrastructure core makes distribution much simpler. Plumbing only needs to go a short distance, making repairs and replacements easier, and electrical and mechanical systems also benefit from the location of the core and are able to radiate out into the home in an efficient manner.

This core serves as: 1. the housing for all the home's mechanical, plumbing and electrical sources, and 2. a major structural support, providing three shear walls to the structure.

This infrastructural core houses the utilities and electronics of the home in such a way that allows the remaining floor plan to be substantially more flexible than traditional floor plans.

The house will preferably be wired with smart technology that will allow the lighting and electrical systems to be remotely observed and controlled. Individual web sites will allow home owners to monitor, control and maintain the health of their house from inside or remotely over the internet.

The core has an inherent effect on the architecture of the house in the following ways. 1. The vertical orientation of the core, designed to maximize efficiency in floor space and materials, lends itself to a multi-story home. 2. Because of the consolidation of infrastructure in the core, there are fewer ducts and wires running through the home, resulting in fewer essential walls and fixed floor planes. 3. By using lower ceiling heights, three floors can be provided in a space that would normally accommodate only two floors in a traditional home.

Balloon framing was chosen as the main method of construction for the wall panels for several reasons: 1. Components can be created off-site, saving time and money while increasing accuracy. 2. Vertically-oriented walls work seamlessly with window systems. 3. They make it easy to run electric and communication wiring up and down.

It is an objective of this invention to provide a central core for a house that includes all the functionality of a modern infrastructural system. Modern infrastructure needs to be upgradeable, interconnected and monitorable. For example a modern infrastructure should provide notification when FAU filters need to be changed, the water filtration needs filter change, a backup battery for the security system or tech rack needs to be changed, etc.

It is an objective of this invention to provide a core that contributes to the structural stability of the house. The shell of the core provides lateral stability and floor/roof support for the rest of the house. It can be either a wood structure or steel structure. It can be made up of either a rigid frame construction with infill panels or it can be stud wall system.

It is an objective of this invention to provide end use plumbing fixtures such as valves, faucets and toilets, already connected to the hot, cold and sewer distribution system. This minimizes plumbing time at the site and yields better and more consistent quality work since it is completed in a more controlled environment.

It is an objective of this invention to provide 90% of the infrastructural distribution (i.e. pipes, ducts and wires) and 100% infrastructural source hardware (i.e. FAUs, condensers, low voltage controls for lighting or security, water filtration system, electrical panels, fire sprinkler riser, ventilation fans, etc.) within a prefabricated core. This minimizes the work, the time, and the need for many of the trades.

It is an objective of this invention to provide a house in which repair, upgrade or maintenance can be easily and readily accomplished. This obviates the need to tear up concrete floors, finished ceilings or finished walls to access a defective solder joint that was leaking. It also obviates the need to cut into bathroom walls to replace worn out shower valves. In this invention all hardware is organized and installed so that it is easily accessible. Any aspect of the infrastructure can be updated, maintained or repaired without touching the finishes. One does not have to open the superstructure or structure to access any aspect of the infrastructure.

It is an objective of this invention to provide the most efficient vertical and horizontal distribution of the infrastructural elements. This invention is crawl space plus attic plus the vertical and horizontal chases and raceways. This invention facilitates the interconnectivity of the modern infrastructural system. For example: the HVAC system needs electricity, hot & cold water, sewer drain and low voltage control; the security system needs electricity, phone and network connection; the water heater needs electricity or gas, ventilation, connection to the water mains and connection to the plumbing fixtures; security cameras need electricity, back up batteries, phone system and access to the network. All of this access and more is provided conveniently and accessibly within the core of this invention.

It is an objective of this invention to provide a complete, sophisticated and ideal infrastructural system to a house while consuming very little time in construction schedule. It is not only that minimizing the construction time saves money. But also the inherent efficiency of the system plus its factory production will make it cost much less than a site built house. Further, since the core of this invention is factory built it is less likely to be built wrongly. The core of this invention will be pretested and thus will be fully functioning at installation. It will be recognized by those familiar with the art to which this invention pertains, that this invention could, alternatively, be built on site.

It is an objective of this invention to provide a core that is sized to be carried on smaller semi trailers without wide load transport provisions. This invention is light and rigid which makes it easy to transport and install. There are no finishes such as tile or paint that would be vulnerable to damage in shipment.

It is an objective of this invention to provide data on water and electricity consumption, and to operate switches, control temperature, control irrigation system, turn the security system on or off, view the security cameras, and move the shades up and down.

It is an objective of this invention to provide consumer benefits because one company is behind the entire infrastructural system. Instead of dealing with multiple subcontractors customers will deal with the manufacturer of this invention.

It is an objective of this invention to provide remote monitoring through the internet of many aspects of the health of the infrastructure through sensors, cameras and internet.

An appreciation of the other aims and objectives of the present invention and an understanding of it may be achieved by referring to the accompanying drawings and description of a preferred embodiment.

DETAILED DESCRIPTION OF THE PREFERRED EMBODIMENT

Figure 1:
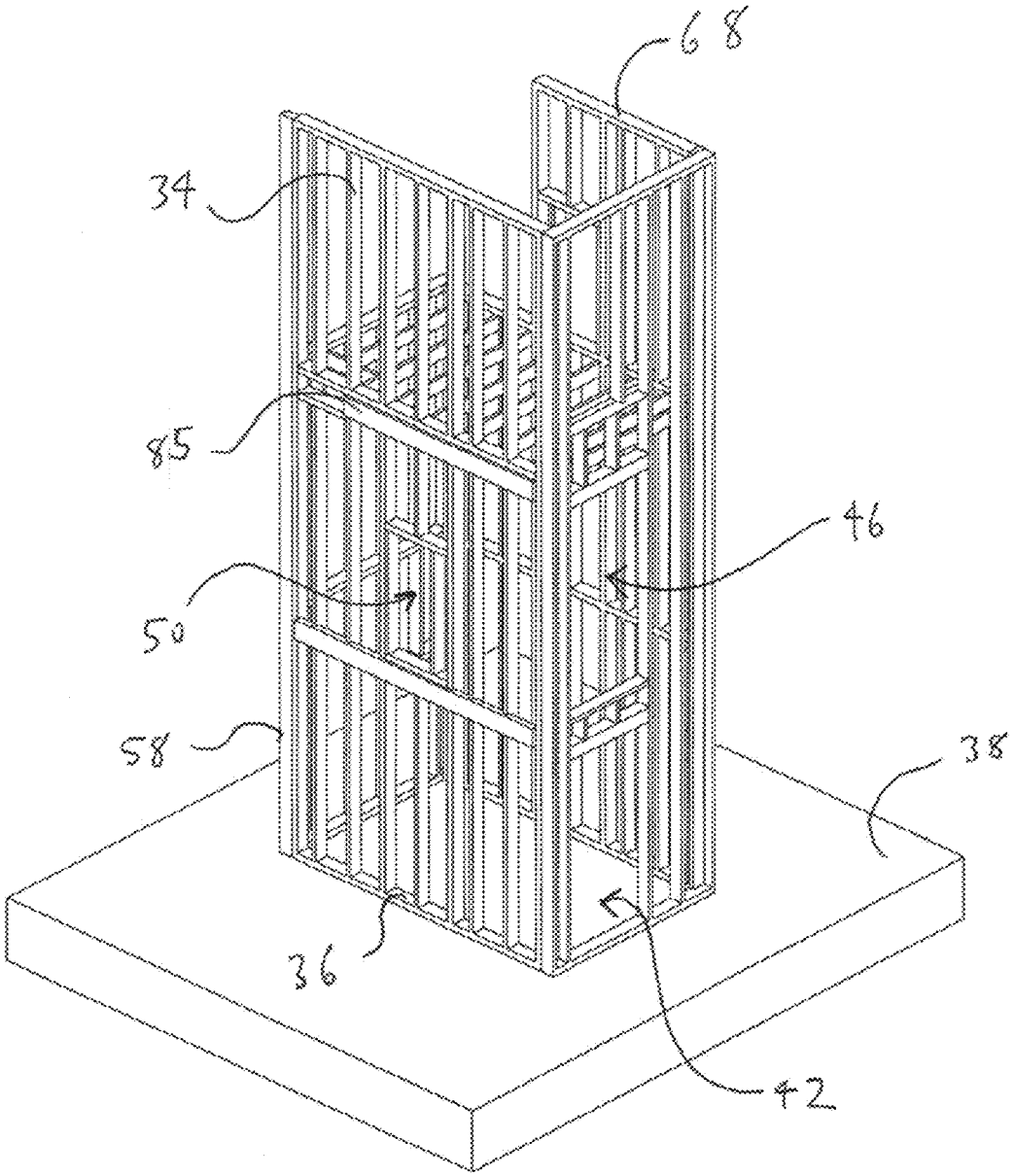
FIG. 1 is a perspective view of the balloon framing of the 3 storey core.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

FIGS. 1-5 show structural aspects of the 3 storey core. The core is essentially a room 14 which has one exterior wall segment 18 and three interior wall segments 22, 26, 30. The core is two or more storeys high and built of framing in standard fashion. Preferably the framing is balloon framing (illustrated in almost all of the Figures), in which the studs 34 run from the foundation 38 to the roof (not shown). Balloon framing is stronger and more rigid than platform framing. An alternate type of framing is shown in FIG. 1A. This type of framing has steel corner posts 31 and beams 32 which are connected with very rigid joints or reinforced with cross braces 33. In this case, intermediate studs 34*a* are not necessary but may be included to frame openings.

Openings 42, 46 are constructed in the framing for the outside wall for an access door and a fresh air louver. One or more spaces 50 are constructed in one or more of the inside walls 22, 26, 30 for a toilet mechanism. Structural hold downs 54 are attached to the core at each corner 58. These hold downs 54 are used to attach the core to the foundation 38 at the construction site.

Figure 5:
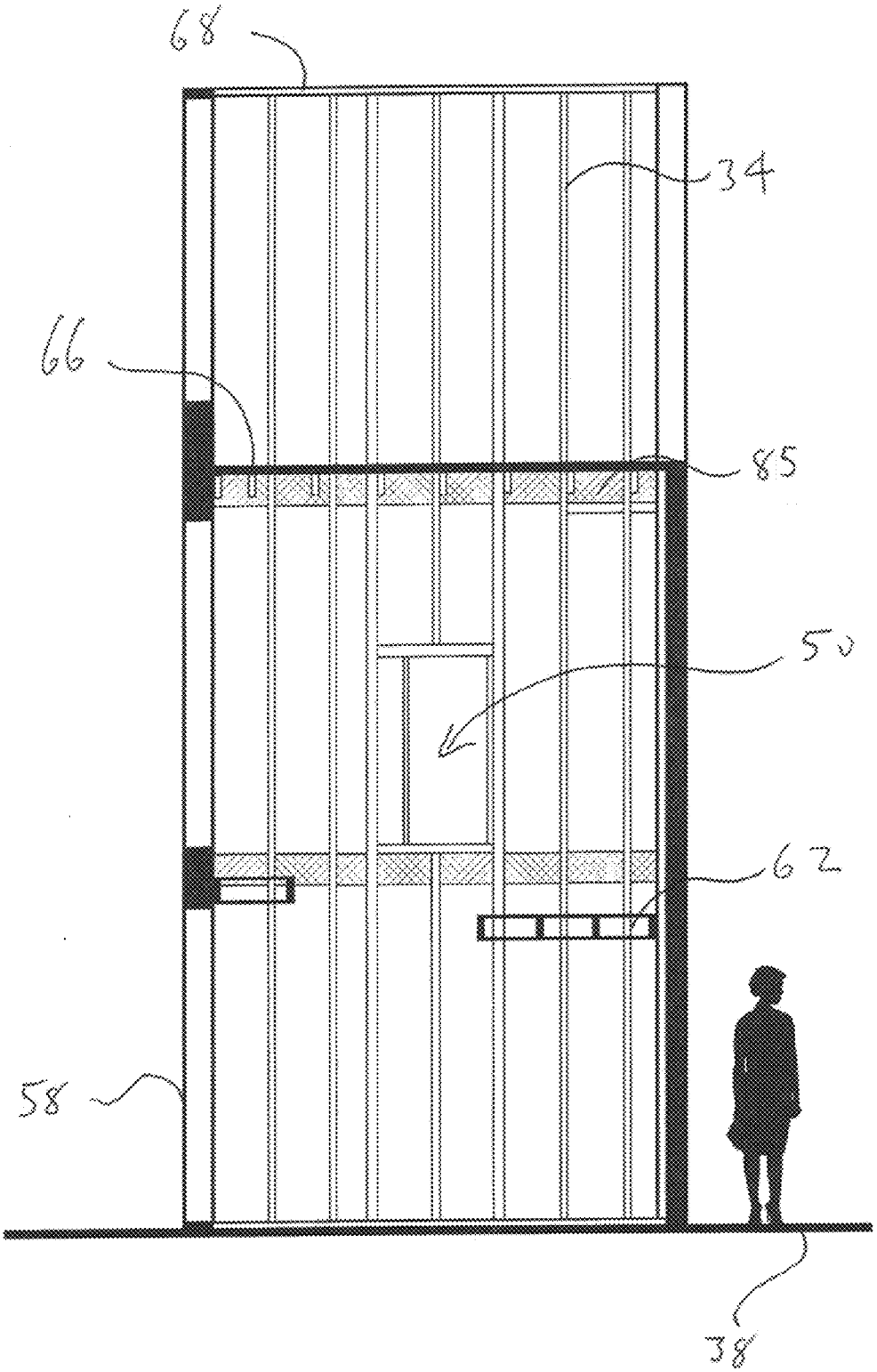
FIG. 5 is a front elevational view of the 3 storey core.
Figure 5A:
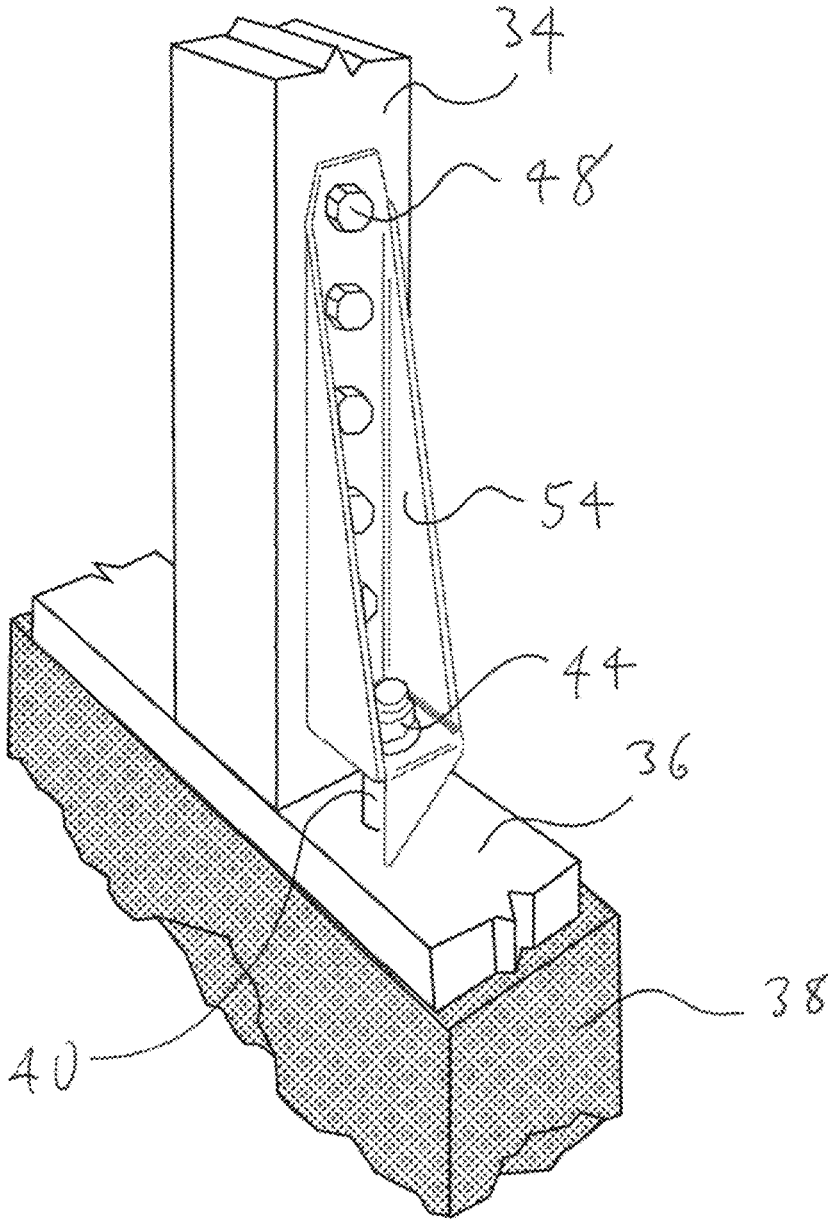
FIG. 5A is a detail of a structural hold down.
Figure 5B:
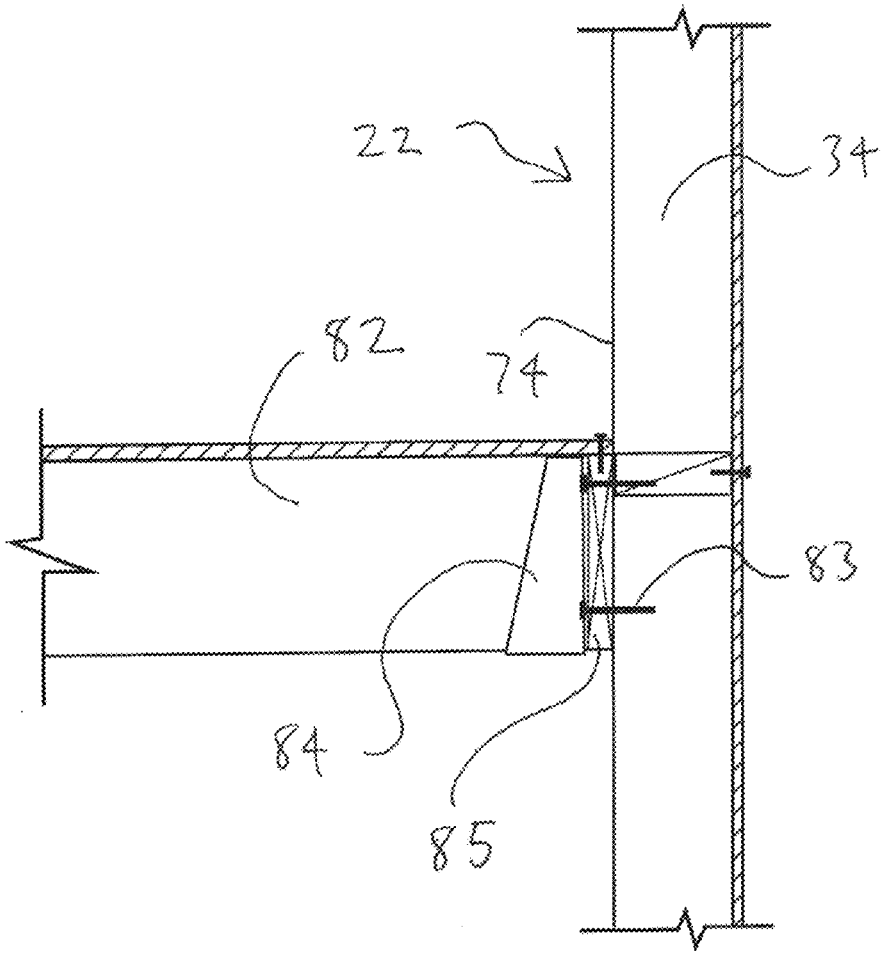
FIG. 5B is a detail showing attachment of the floors of the house to the core.
Figure 6:
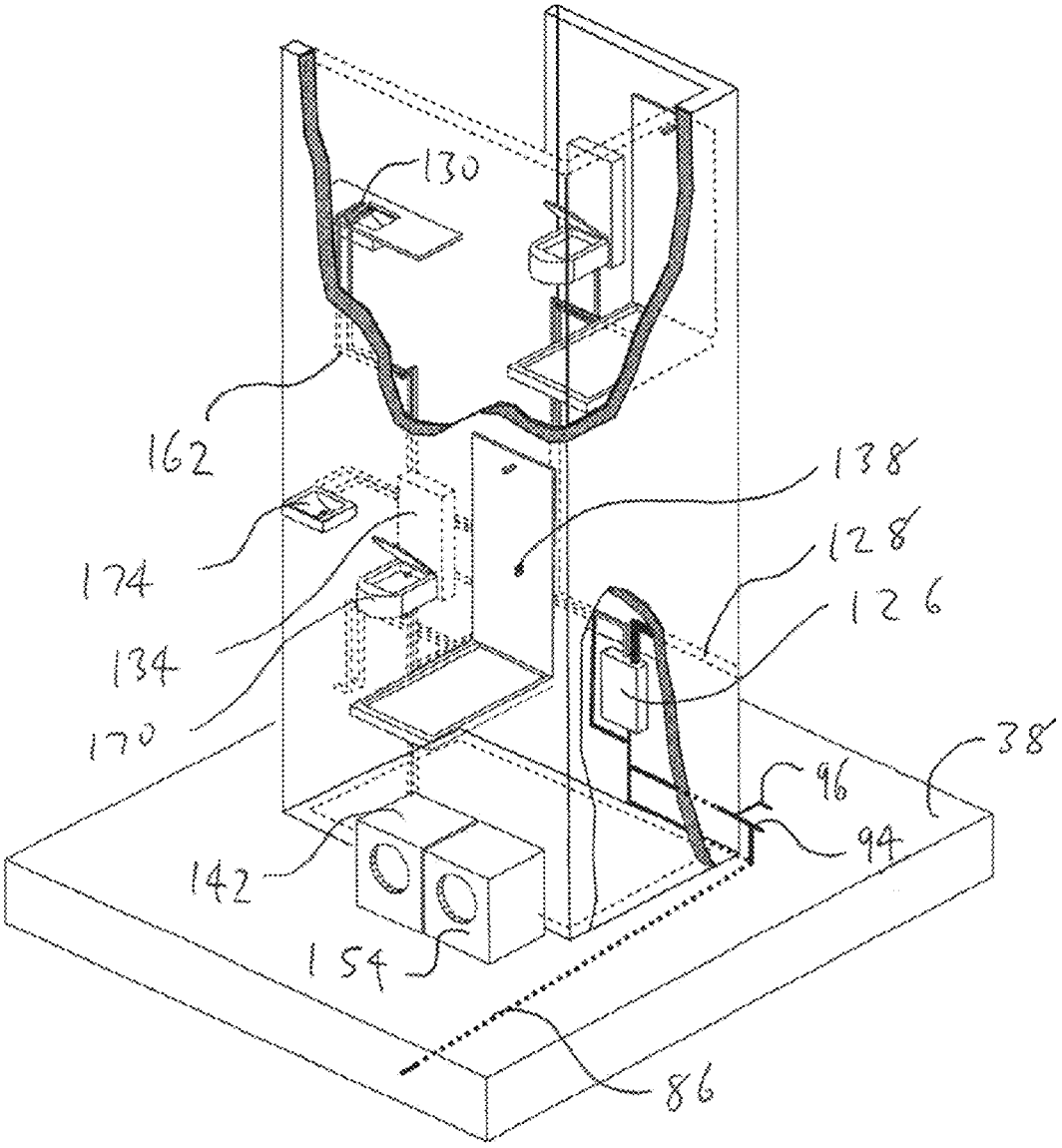
FIG. 6 is perspective view of the 3 storey core illustrating plumbing aspects of the core.
Figure 7:
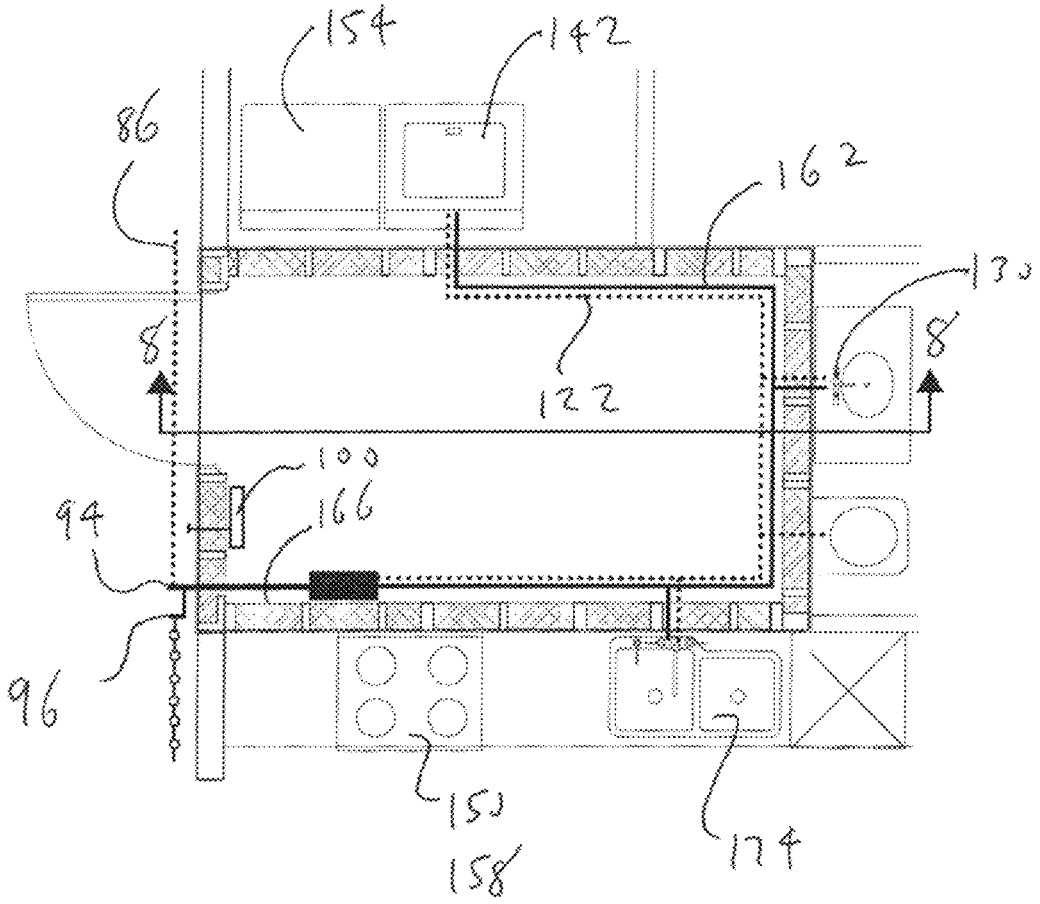
FIG. 7 is a typical ground floor plan for the core illustrating plumbing aspects.
Figure 8:
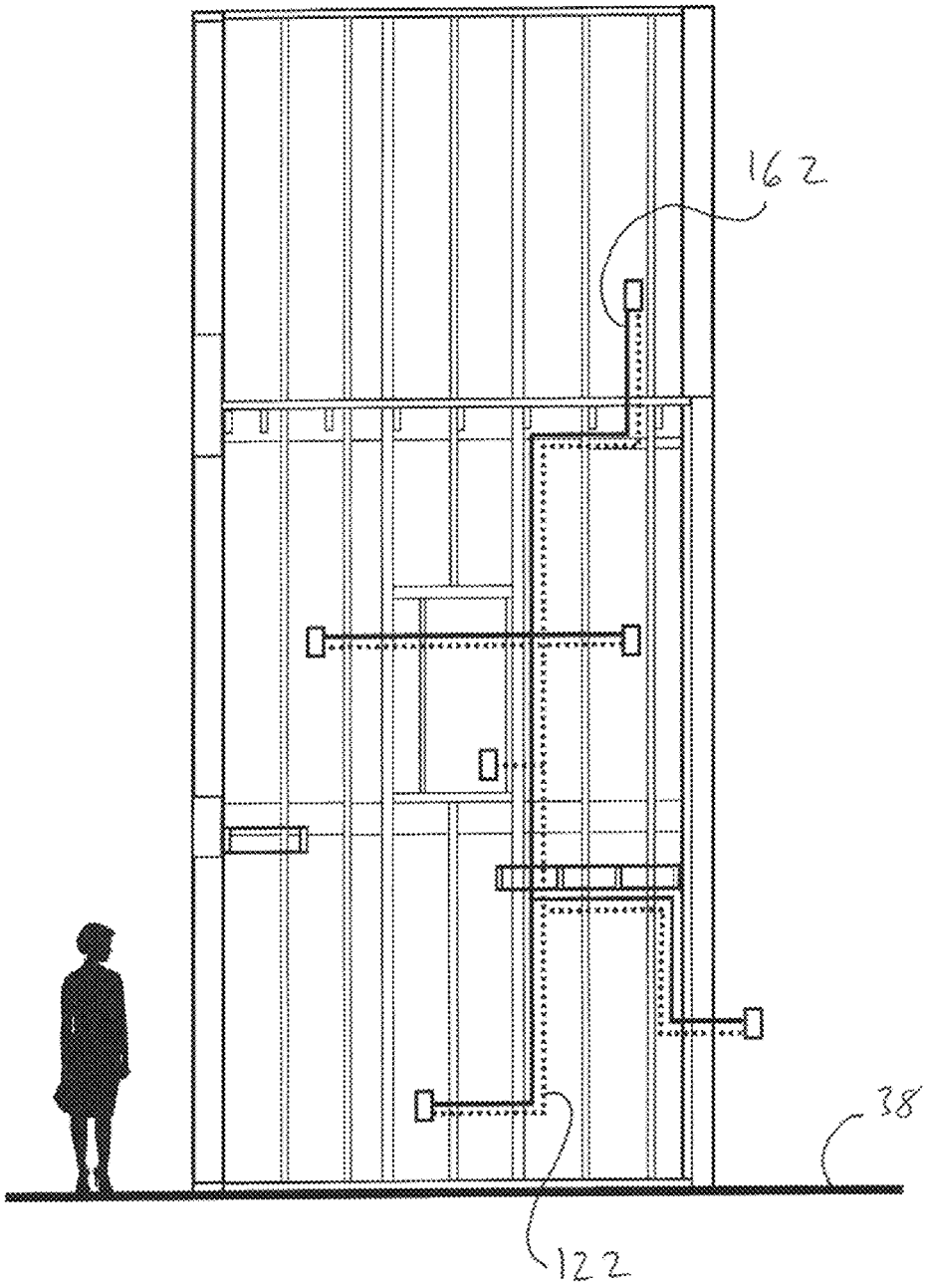
FIG. 8 is an elevational view of the 3 storey core as seen from the line 8-8 on FIG. 7.
Figure 9:
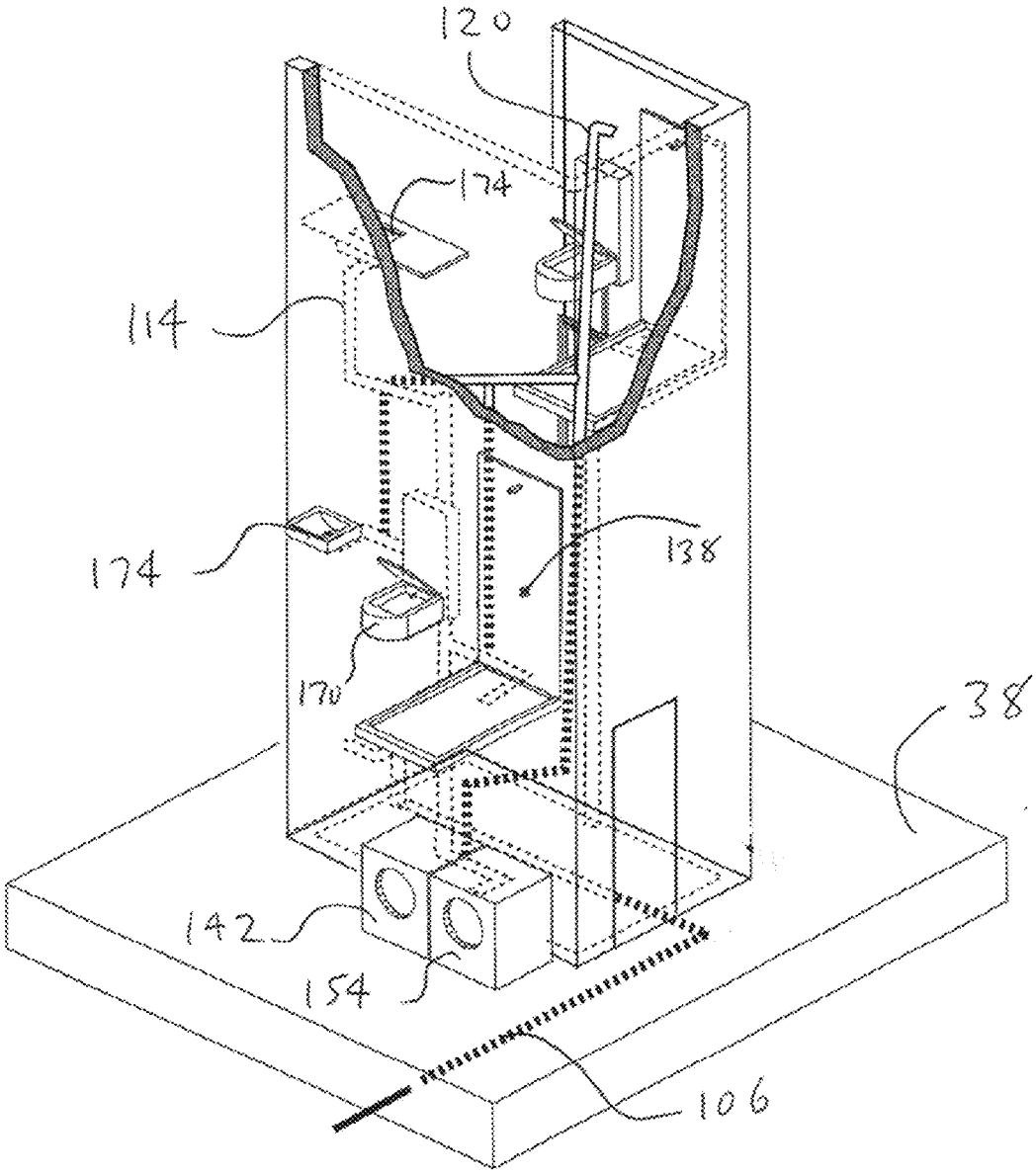
FIG. 9 is perspective view of the 3 storey core illustrating waste handling aspects of the core.
Figure 10:
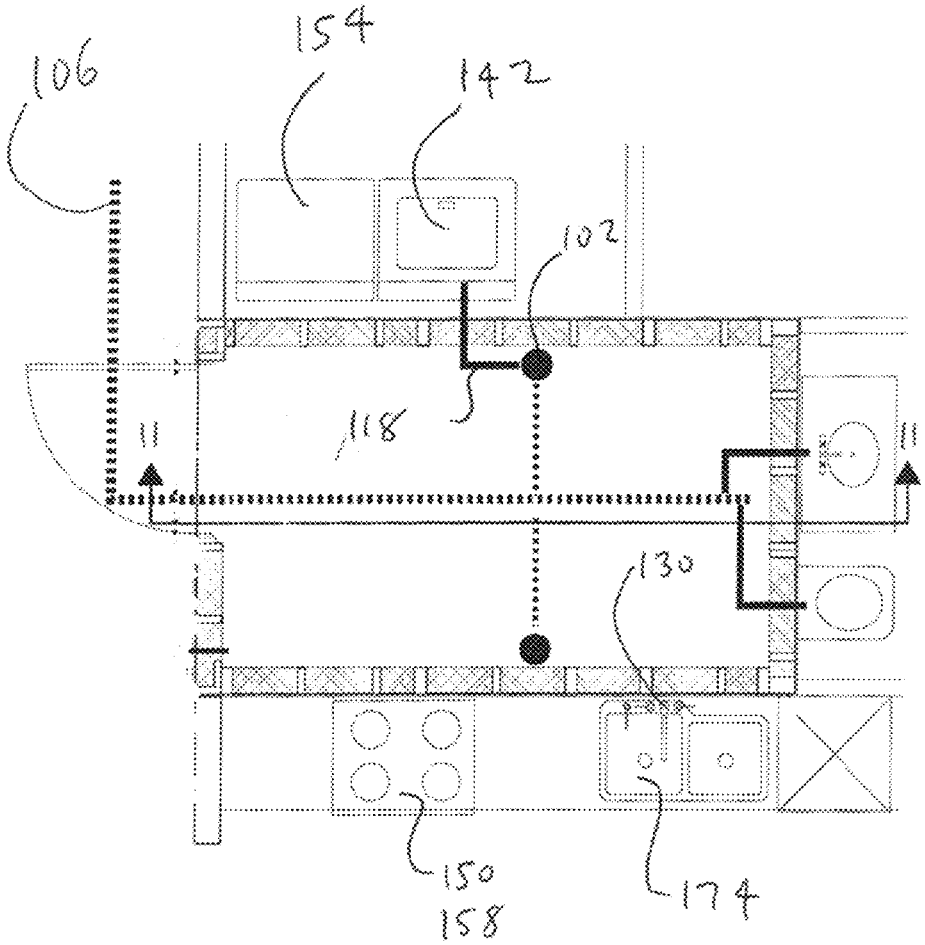
FIG. 10 is a typical ground floor plan for the core illustrating waste handling aspects.
Figure 11:
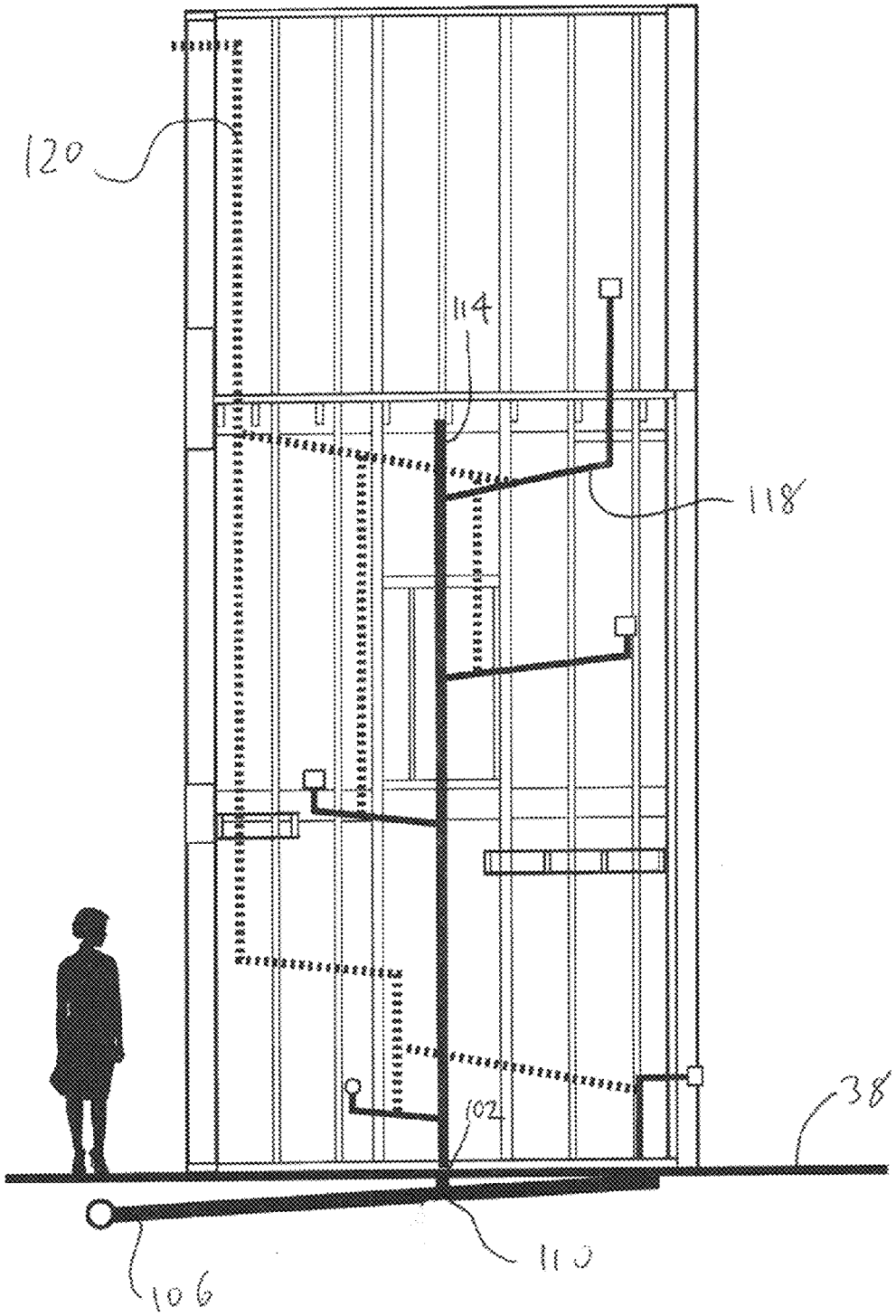
FIG. 11 is an elevational view of the 3 storey core as seen from the line 11-11 on FIG. 10.
Figure 12:
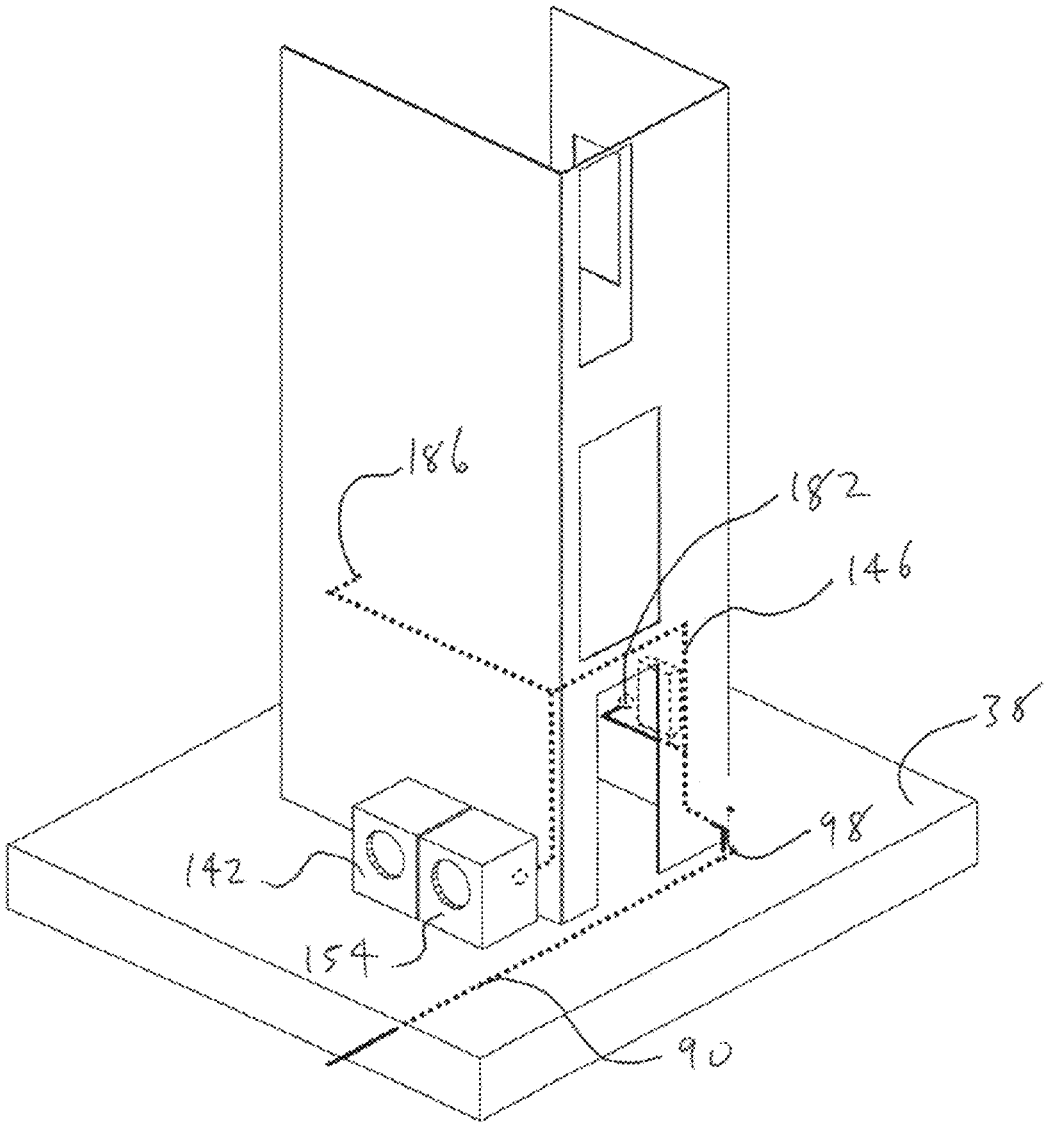
FIG. 12 is perspective view of the 3 storey core illustrating fuel aspects of the core.
Figure 13:
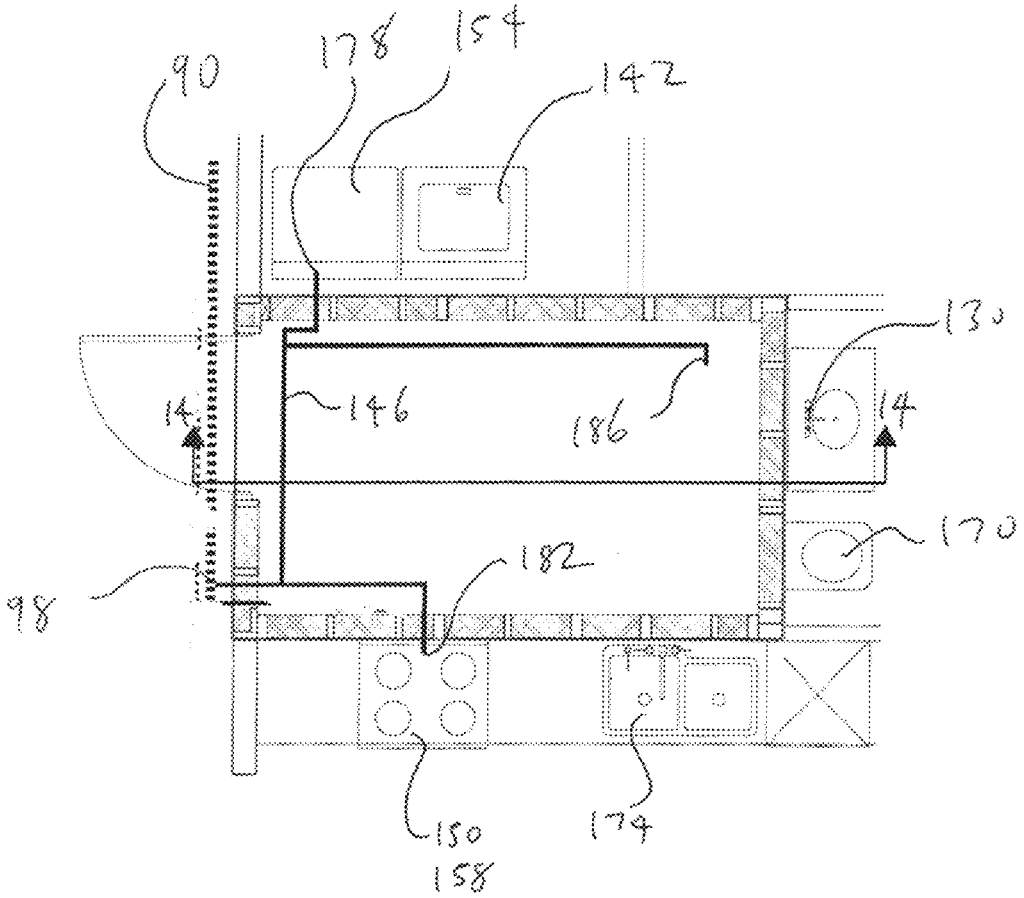
FIG. 13 is a typical ground floor plan for the core illustrating fuel aspects.

FIG. 5B is a detail of a structural hold down 54. The hold down 54 is bolted to a stud 34 and to the sill 36 and foundation 38.

Built in to the core are one or more interior platforms 62 for mechanical units such as the HVAC unit. In cores three storey or more in height, a floor supported by joists 66 is located one storey below the top 68.

The outside of the framing is sheathed with panels 70 so that the walls 18, 22, 26, 30 of the core become shear walls, i.e. able to resist lateral loads. To conform to standard building codes, the panels 70 must be structural plywood. Then the outsides 74 of the interior wall segments 22, 26, 30 are finished with an interior finish, preferably with wall board, to match the interior finish of the house and the outside 78 of the exterior wall segment 18 is finished with an exterior finish, for example, stucco or siding to match the exterior finish of the house.

FIG. 5B shows how interior floors of the house are attached to the interior wall segments of the core. Floor joists 82 are attached to a ledger board 85 provided on the outsides 74 of each of the interior segments 22, 26, 30 with joist hangers 84. This is typically done with nails 83. The floor joists 82 will be attached after delivery of the prefabricated core to the site.

FIGS. 6-14 show plumbing, waste and fuel aspect of the core. The main utilities, i.e. water 86 and gas 90, come into the core from outside the building footprint. Preferably these are provided from underground. Connection 94, 98 is made with main shut off valves (not shown) just outside the outside 78 of the exterior wall segment 18. An irrigation line 96 for hose bibs and sprinklers (not shown), branches off the water main 94 just outside the outside wall 18. A sprinkler controller 100 may be installed on one of the walls of the core and connected electrically to each sprinkler circuit.

Sewer connections 102 are provided within the core. The main sewer line 106 from the street comes under the core slab 38 and branches out to three stub outs 110. The branching and stub outs 110 will be done before the slab 38 is poured in a coordinated location that will connect to the sewer lines 114, 118 of the core. When the core is built all 3 main sewer lines 114 will terminate about 6" above ground. Once installed the sewer lines 114 will be connected to the stub outs 110. The 6" will allow for some adjustment, just in case the core's sewer lines 114 and stub outs 110 are not perfectly aligned.

In the core, the cold water line 122 is connected to a water heater 126, and to shut off valves (not shown) for all cold water appliances such as faucets 130, toilets 134, mixing valves 138, washers 142, etc. The valves will be located just behind the interior walls 22, 26, 30. Piping will run from these shut off valves through the interior walls 22, 26, 30 of the core. Faucets 130, toilets 134 and mixing valves 138 will be attached to the pipes on the outsides of an interior wall section 22, 26, 30. The other appliances will be attached to the piping later. In the core, the gas line 146 is connected to the water heater 126 and gas cocks for appliances such as ranges 150, driers 154, ovens 158, etc, if they are gas powered. Piping will run from these cocks through the interior 22, 26, 30 walls of the core. All such appliances will eventually be located next to the outside 74 of an interior wall 22, 26, 30. In the core, the hot water line 162 from the water heater 126 is connected to shut off valves (not shown) for all hot water using appliances, such as faucets 130, mixing valves 138, washers 142, etc. Again the valves will be located just behind the interior walls 22, 26, 30 and piping will run from these shut off valves through the interior walls 22, 26, 30 of the core. Faucets 130, and mixing valves 138 will be attached to the pipes on the outsides of an interior wall section 22, 26, 30. The other appliances will be attached to the piping later.

The water heater 126 is located within the core. It may be tankless and attached to the inside 166 of one of the wall segments 18, 22, 26, 30 or it may have a tank and may be attached on one of the interior platforms 62. All other appliances are wall mounted and located next to or attached to the exterior of an interior wall segment. The operating mechanism 134 of all toilets, usually the tank and flush valve, is installed in specially provided openings 50 in the interior wall segments 22, 26, 30. Then the bowl 170 is attached to the mechanism 134 on the outside 74 of the interior wall segment 22, 26 or 30. Suitable toilets for this application are available from Duravit AG of Hornberg, Germany. All cold water piping 122 and gas piping 146 are run within the core and only go through the wall 22, 26, 30 just behind the appliance. Sewer pipes (not illustrated) run from the appliances, such as sinks 174, toilets bowls 170 and washers 142 through the wall 22, 26, 30 directly behind the appliance and then are connected via vertical 114 and lateral runs 118 within the core to the main sewer line 106.

Figure 14:
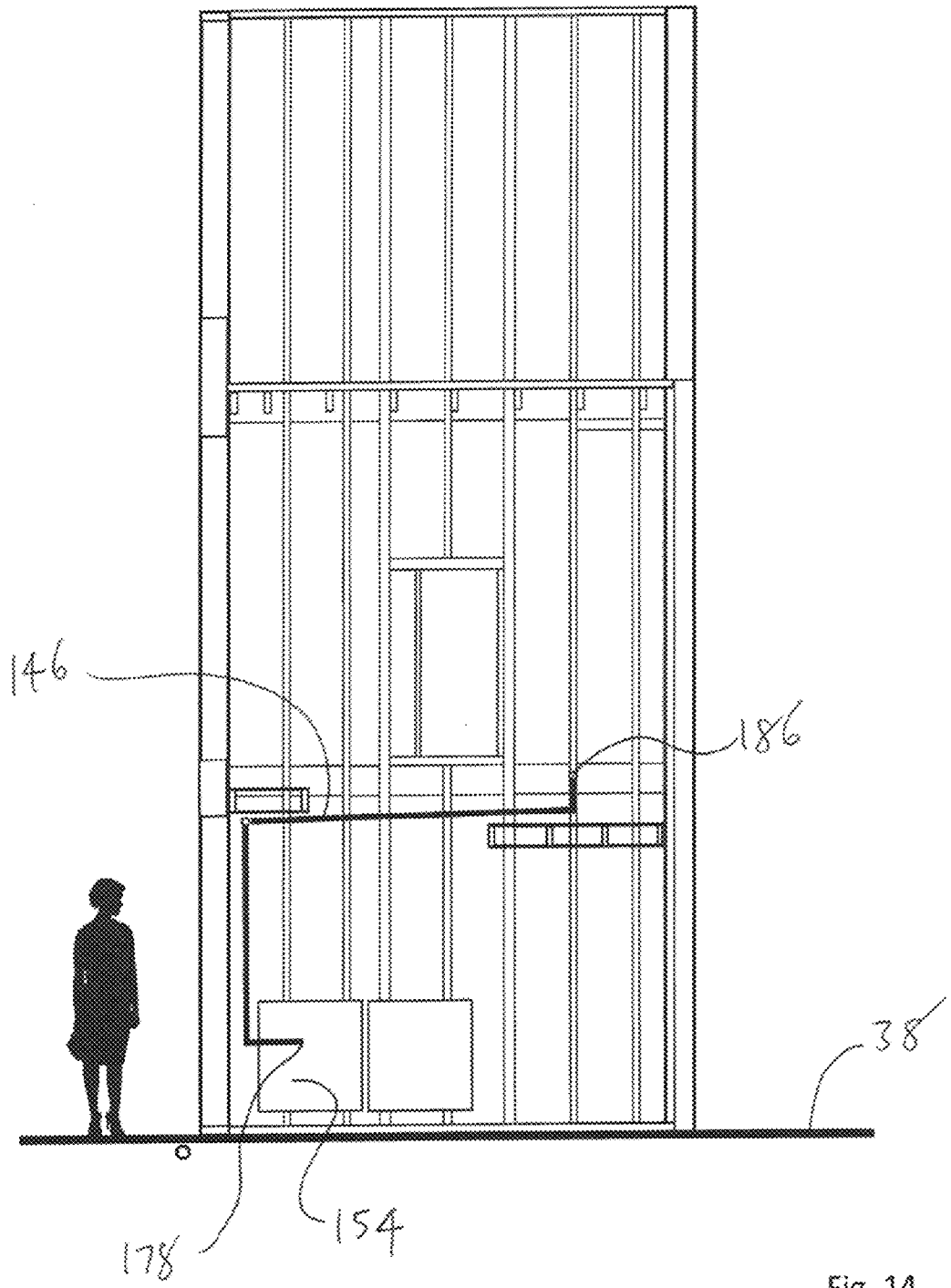
FIG. 14 is an elevational view of the 3 storey core as seen from the line 14-14 on FIG. 13.
Figure 14A:
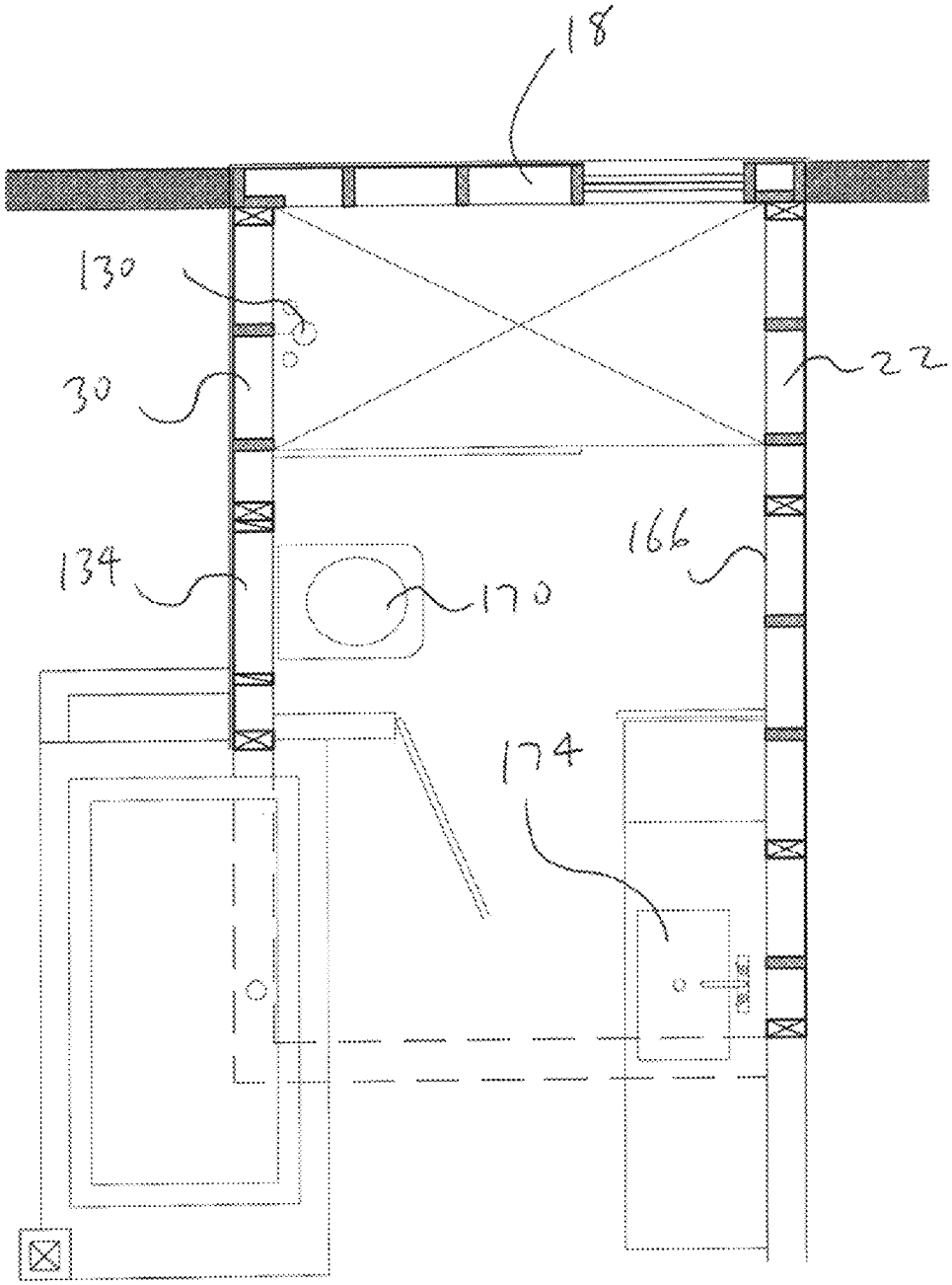
FIG. 14A is a floor plan of a typical third floor bathroom.

Alternatively, in three storey houses, i.e. ones incorporating three storey cores, the third floor may be a bathroom. In this case the walls 18, 22, 26, 30 of the core are finished and the fixtures are attached to the insides 166 of the interior walls 22, 26, 30. The toilet 134, 170 in such a third floor bathroom is also, preferably wall mounted. A floor plan of such a third storey bathroom is shown on FIG. 14A. A more conventional floor mounted toilet could be used, however this would necessitate increased plumbing labor at a later stage in construction of the house.

In either case, when the core is provided prefabricated, all fixtures are attached in their proper locations prior to delivery of the core to the job site. Then it is only necessary to do any final wall finish, such as tile, paint or wallpaper, and attach any necessary trim and the toilet bowls 170.

Figure 15:
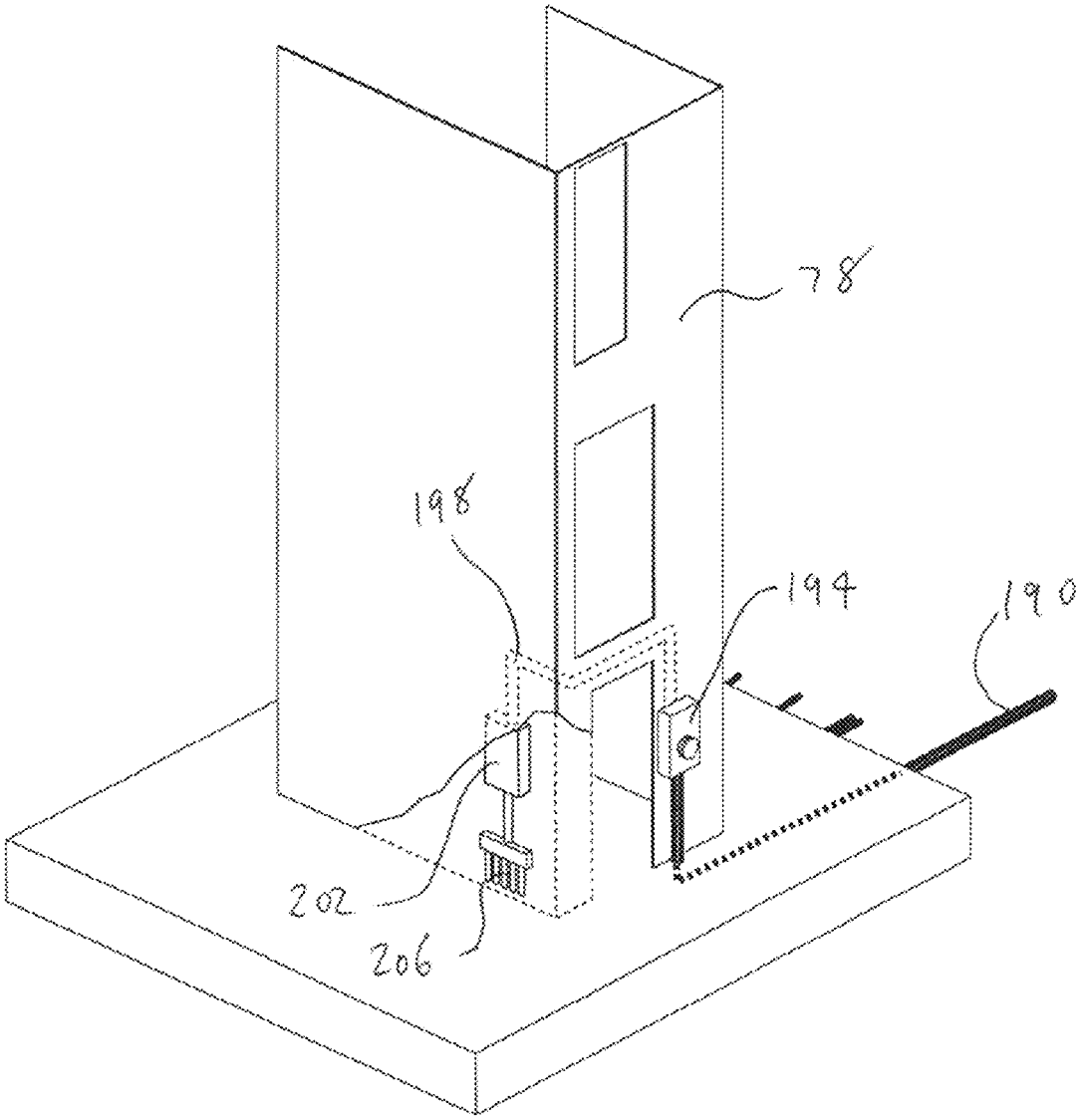
FIG. 15 is perspective view of the 3 storey core illustrating power aspects of the core.
Figure 16:
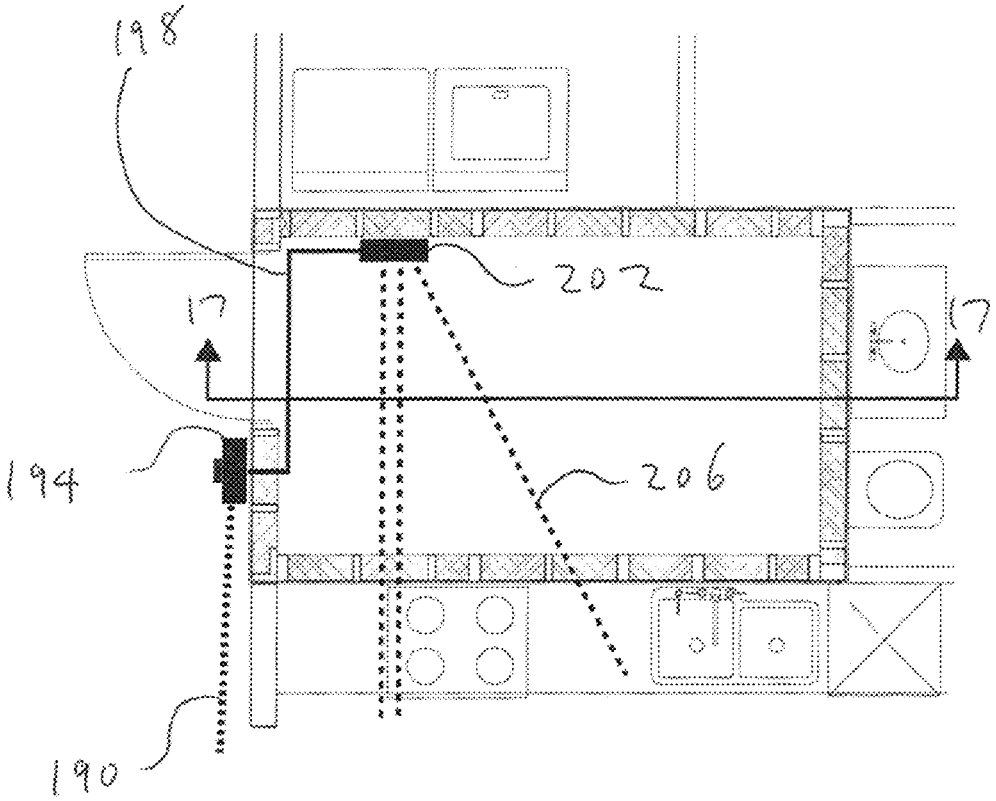
FIG. 16 is a typical ground floor plan for the core illustrating power aspects.
Figure 17:
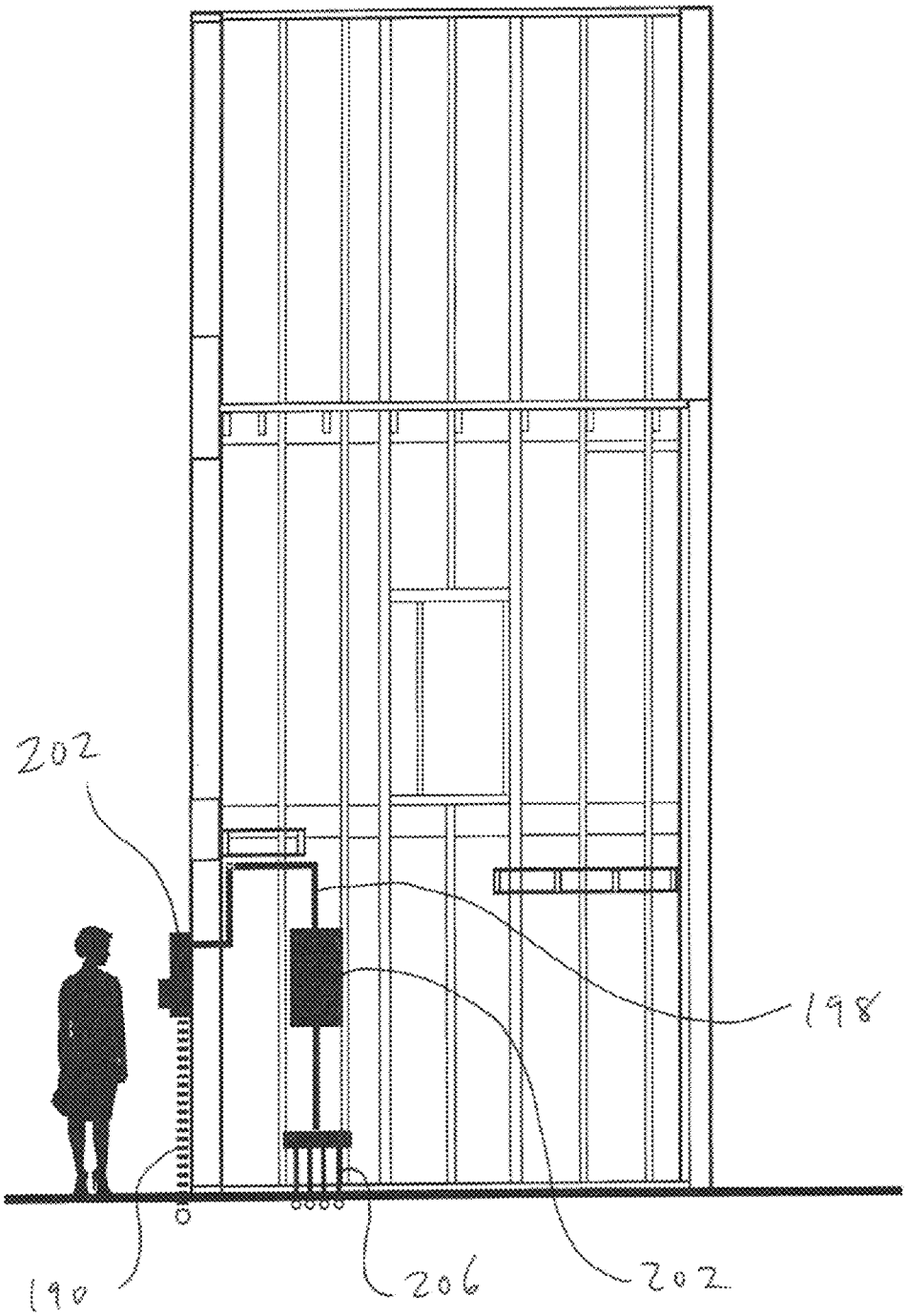
FIG. 17 is an elevational view of the 3 storey core as seen from the line 17-17 on FIG. 16.

FIGS. 15-17 show the electrical power aspect of the core. The electric main 190 is provided to the building, preferably underground. The main 190 runs to a meter 194 located on the exterior of the building, preferably on the outside 78 of an exterior wall segment 18 of the core. From here a line 198 runs inside the core to a main electric subpanel 202. Electric circuits 206 are later run from here to all wall outlets in the house.

Figure 18:
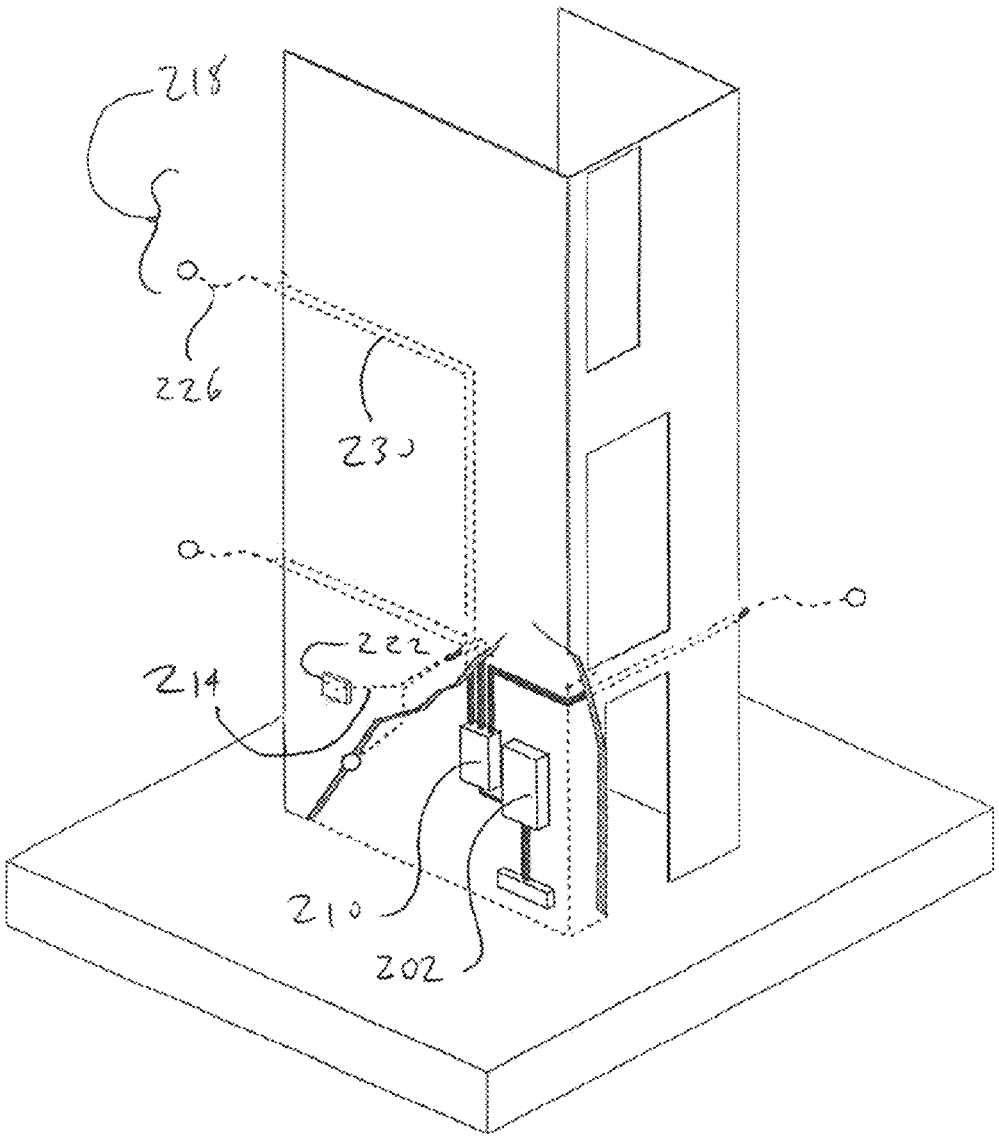
FIG. 18 is perspective view of the 3 storey core illustrating lighting aspects of the core.
Figure 19:
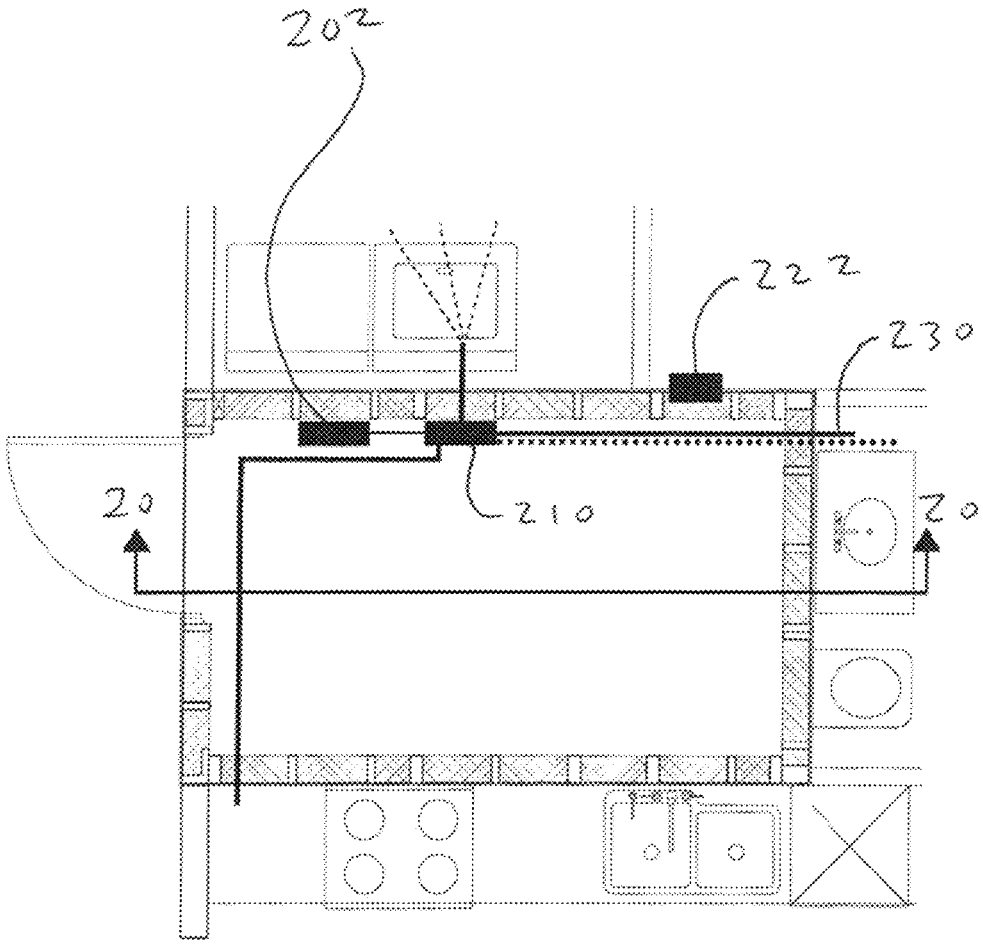
FIG. 19 is a typical ground floor plan for the core illustrating lighting aspects.
Figure 20:
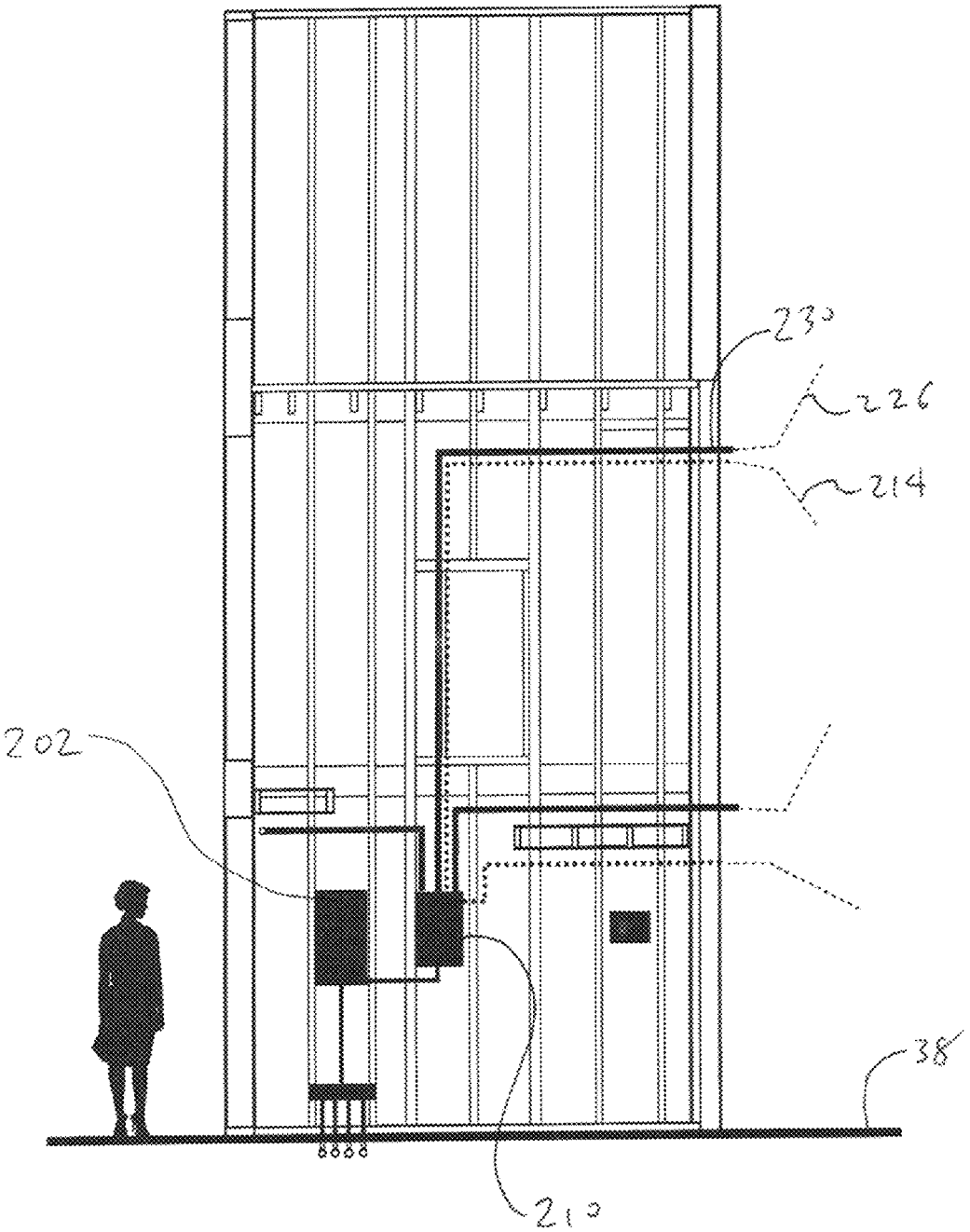
FIG. 20 is an elevational view of the 3 storey core as seen from the line 20-20 on FIG. 19.

Lighting could be done with standard high voltage circuits and switches with circuits 206 running from the main electric subpanel. Preferably, however, lighting will be done with internet protocol (IP) switches. Suitable systems are available from Lutron of Coopersburg, Pa. In this case lighting will be done as shown in FIGS. 18-20. A lighting control panel 210 is electrically connected to the main electric subpanel. From here power runs to each light fixture 218 or zone of light fixtures 218 over a switched power line 226 that runs through conduit 230. Also from panel 210 Category 5 (CAT 5) cable, which is the standard cable used for connecting computer networks, or plain twisted pair wiring 214 runs to a low voltage switch 222 for each light 218 or zone of lights 218. The standard RJ45 connectors on the ends of the cable 214 simply plug into the switches 222 and the control panel 210. Twisted pair wiring 214 is connected with connector blocks. Alternatively, the switches may be wireless. Wired or wireless controls 222 can be located wherever desired within the house. Programming of each control 222 is accomplished from the lighting control panel 210. Preferably power line 226 runs through conduit 230. IP lighting systems are complicated. It is not possible to fully describe such systems in this document. For further details one should consult the technical literature issued by Lutron or equivalent companies.

Figure 21:
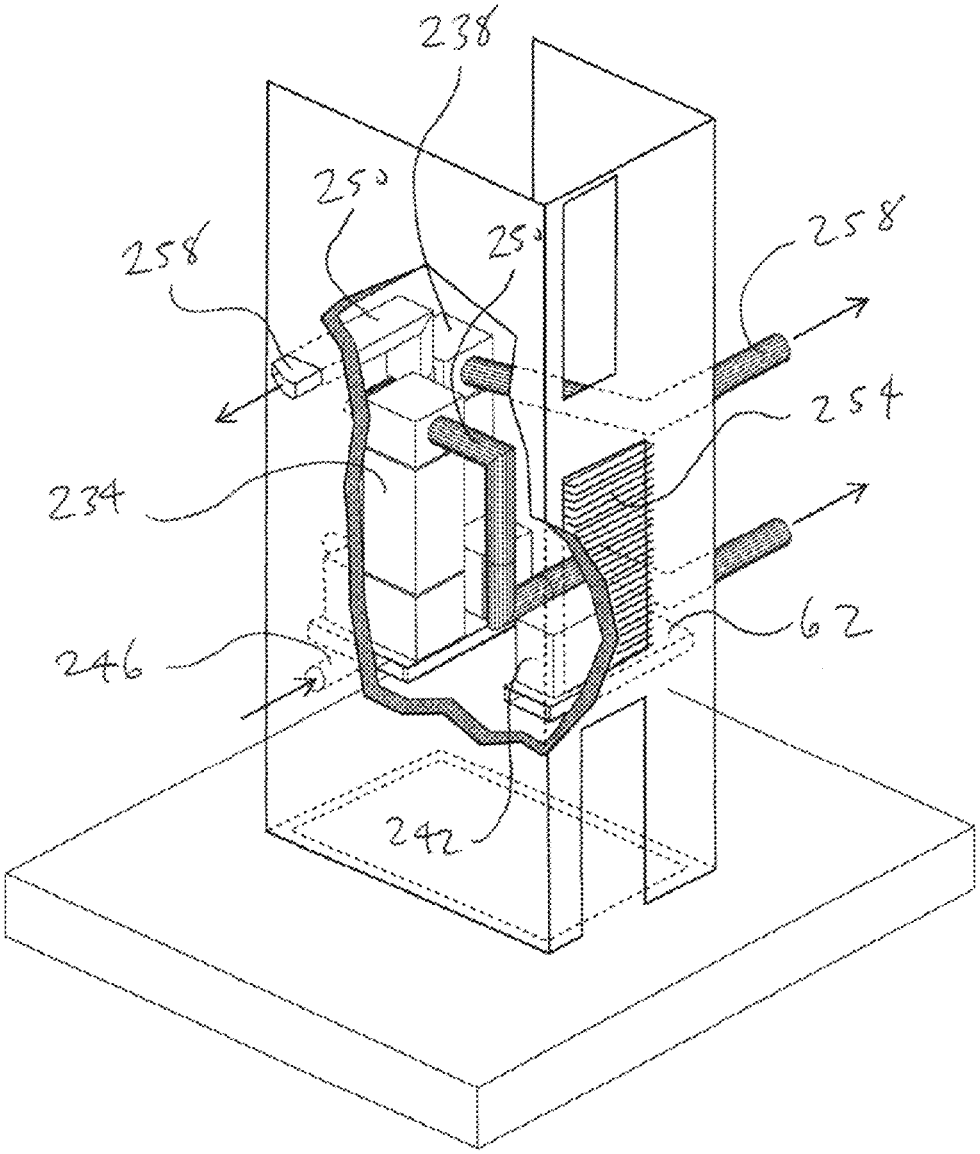
FIG. 21 is perspective view of the 3 storey core illustrating air distribution aspects of the core.
Figure 22:
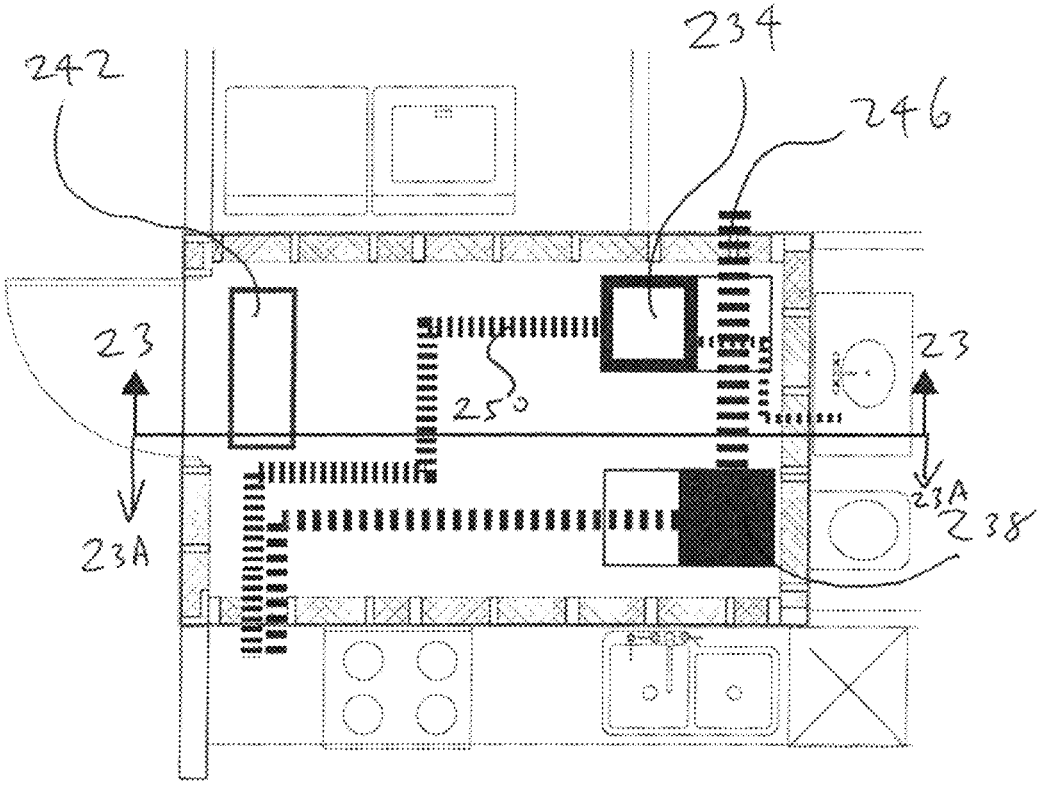
FIG. 22 is a typical ground floor plan for the core illustrating air distribution aspects.
Figure 23:
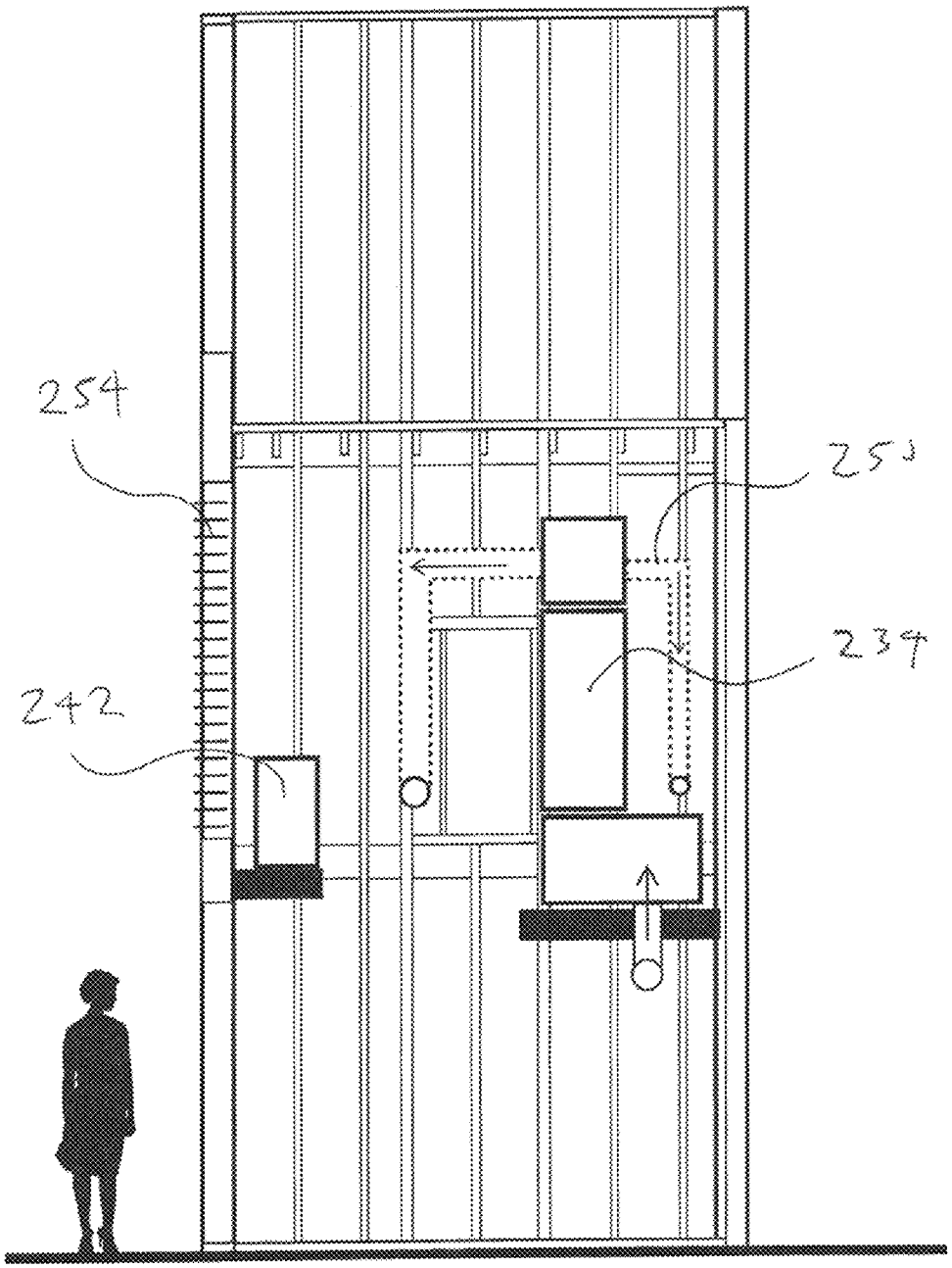
FIG. 23 is an elevational view of the 3 storey core as seen from the line 23-23 on FIG. 22.
Figure 23A:
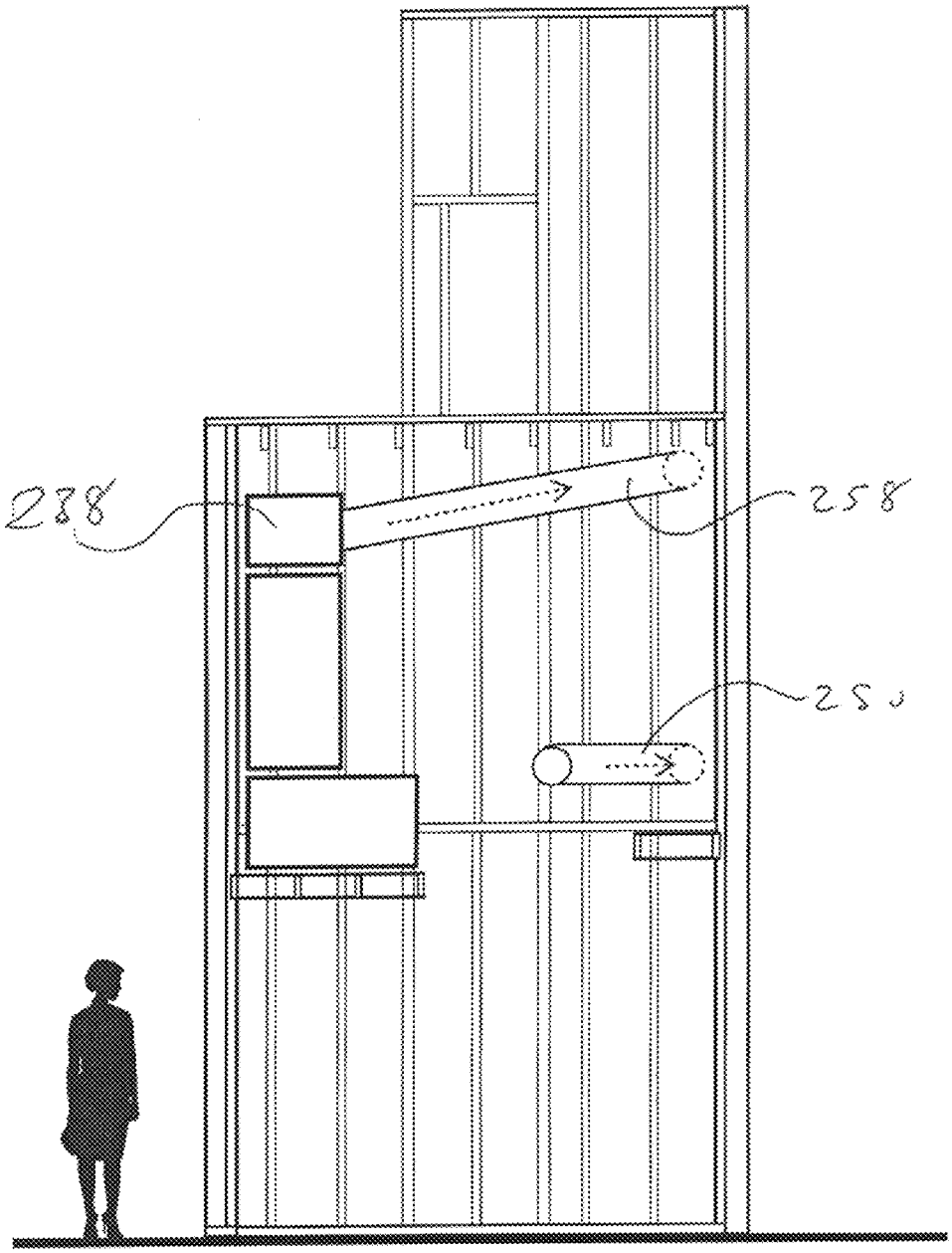
FIG. 23A is an elevational view of the 3 storey core as seen from the line 23A-23A on FIG. 22.

FIGS. 21-23 show air distribution aspects of the core. Preferably, in larger houses there are two forced air units 234, 238 and an air conditioning condenser unit 242 mounted on the platforms 62 inside the core. In smaller houses there would preferably be only one forced air unit 234 and an air conditioning condenser unit 242. All ducting 246, 250 is preinstalled in the core during prefabrication. Supply air and return air stubs 258 run through the interior walls 22, 26, 30 of the core. These are then connected to the supply air and return air ducts in the remainder of the house, after the house has been constructed around the core. Hot air blown out of the air conditioner condenser unit 242 is able to exit the core through the fresh air louver 254. Air flow is indicated by arrows on FIGS. 21 and 23.

Figure 24:
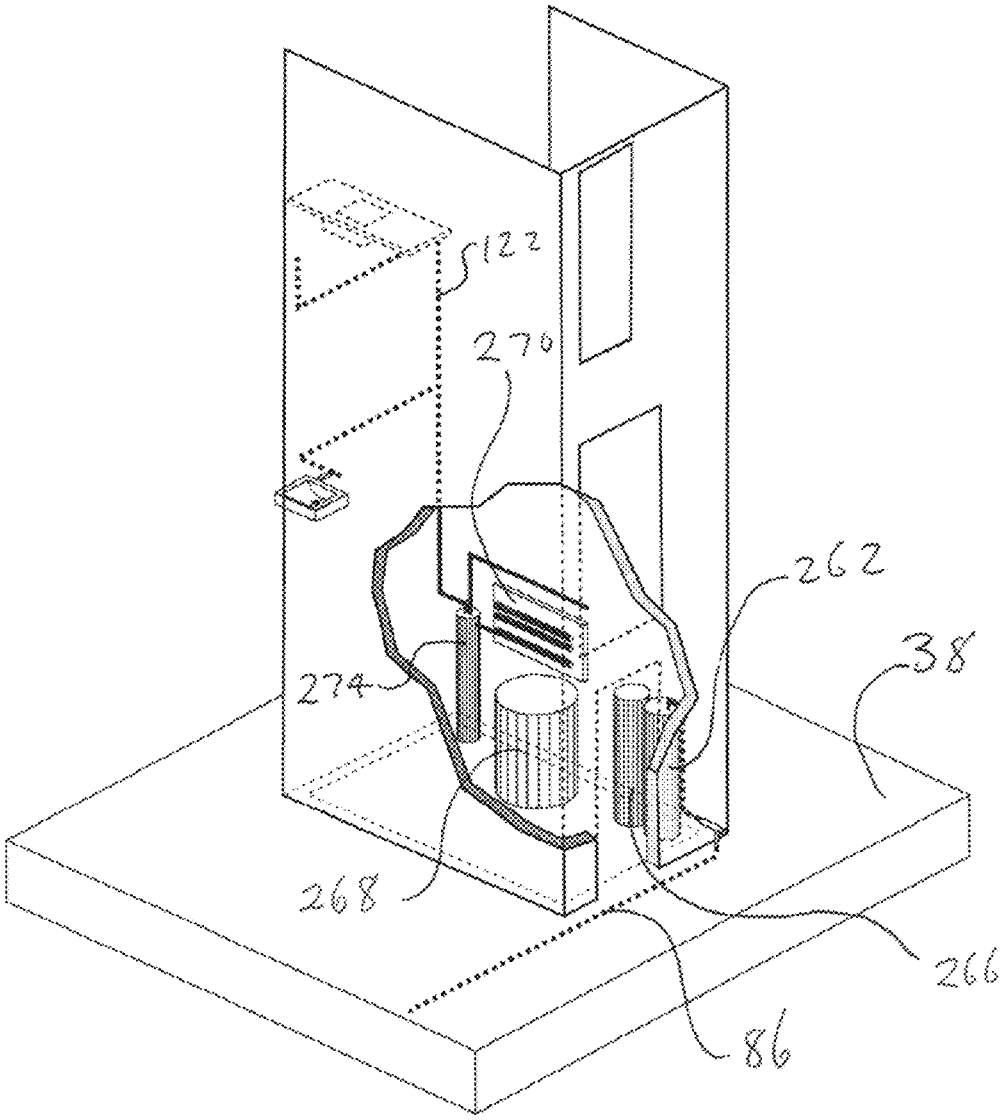
FIG. 24 is perspective view of the 3 storey core illustrating air water filtration aspects of the core.
Figure 25:
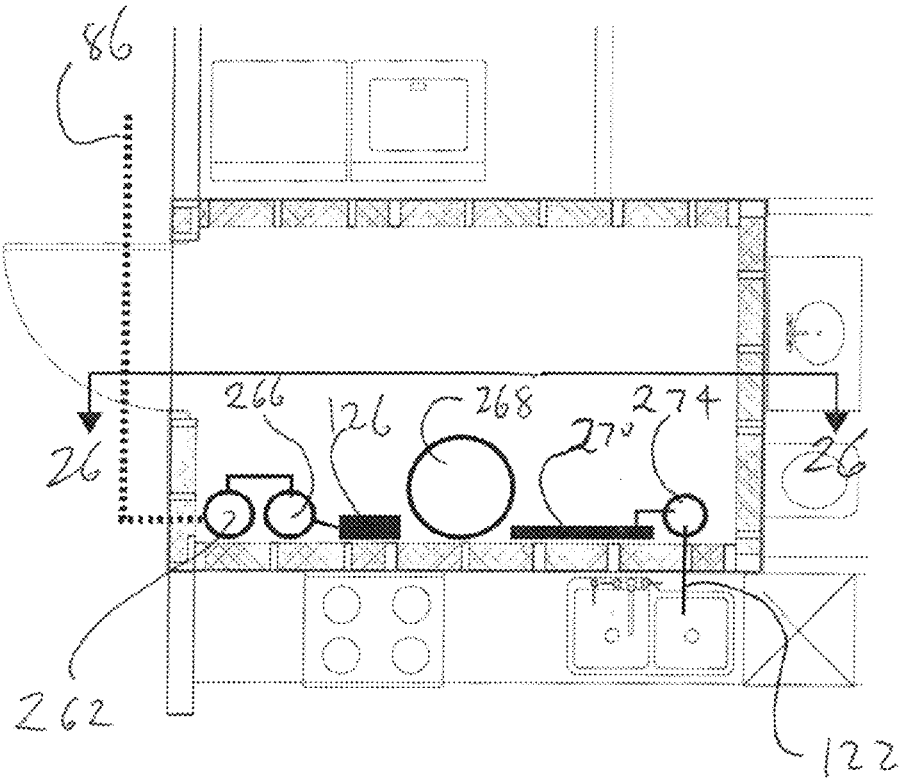
FIG. 25 is a typical ground floor plan for the core illustrating water filtration aspects.
Figure 26:
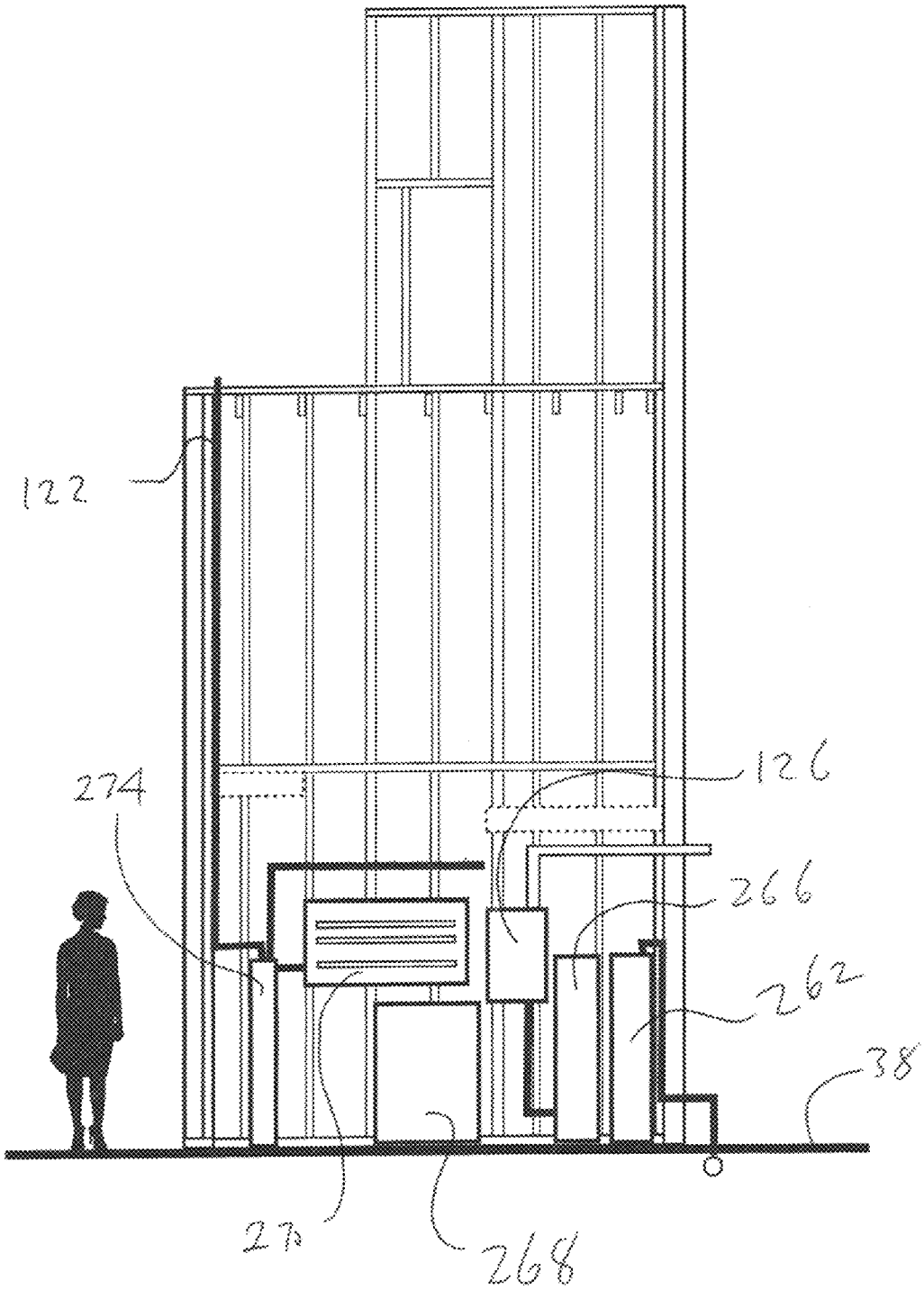
FIG. 26 is an elevational view of the 3 storey core as seen from the line 26-26 on FIG. 25.

FIGS. 24-26 show the optional whole house water filtration aspects of the core. These are designed to remove, sediments, objectionable tastes and odors, organic chemicals, chlorine and dissolved solids from the water delivered by the mains. To accomplish this there may be one or more filters 262; a water softener 266 with backwash tank 268; and reverse osmosis equipment 274 in the incoming water line.

Figure 27:
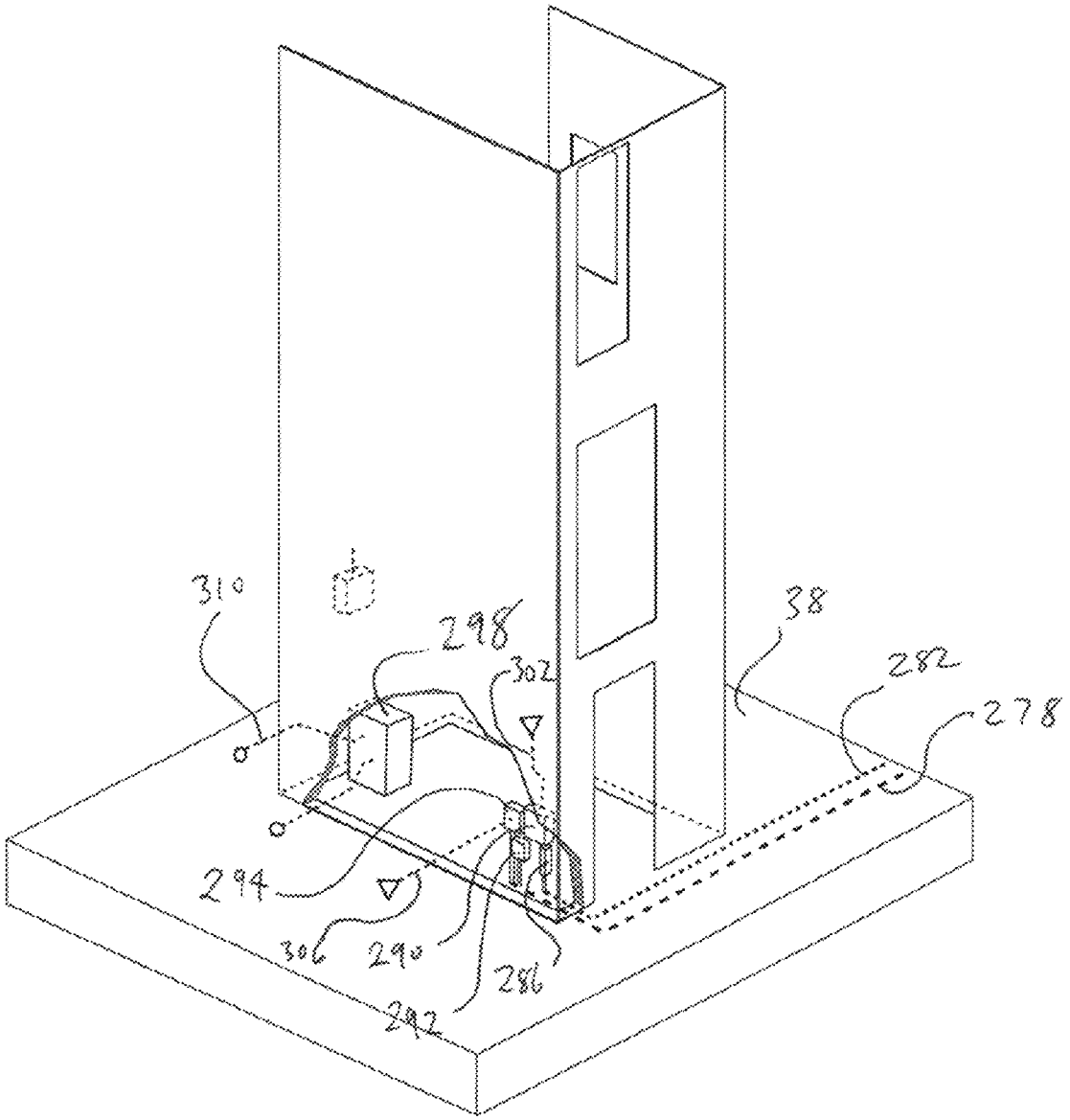
FIG. 27 is perspective view of the 3 storey core illustrating telephone, data and security aspects of the core.
Figure 28:
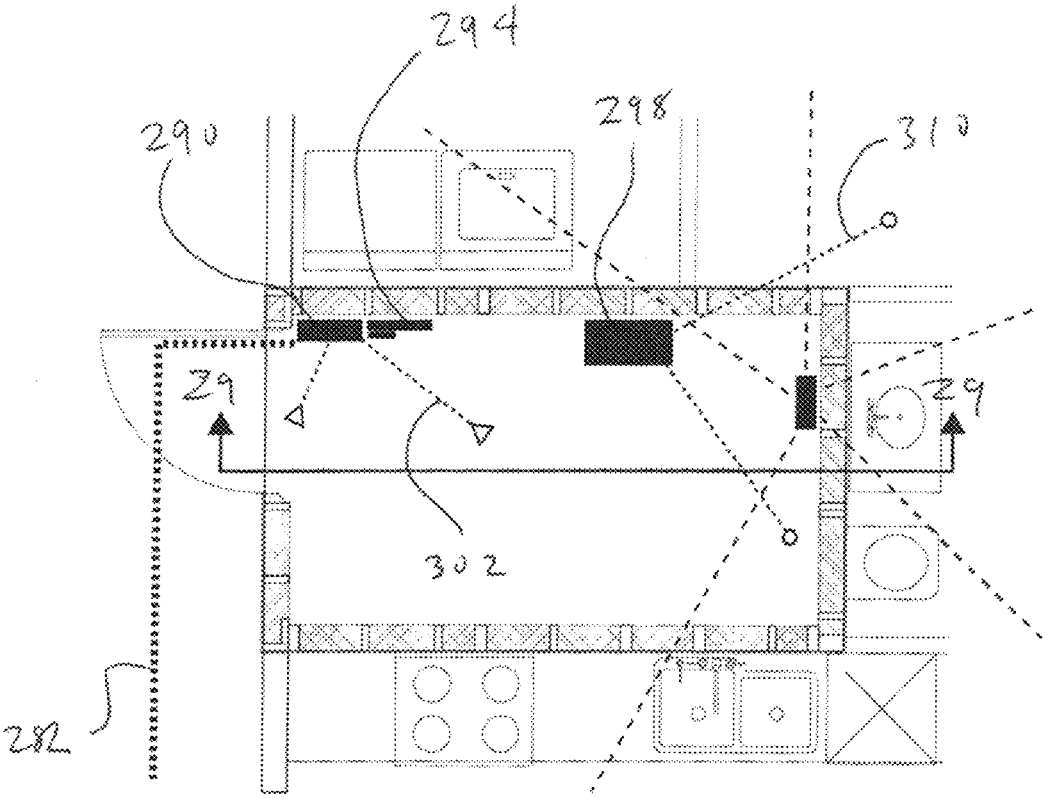
FIG. 28 is a typical ground floor plan for the core illustrating telephone, data and security aspects.
Figure 29:
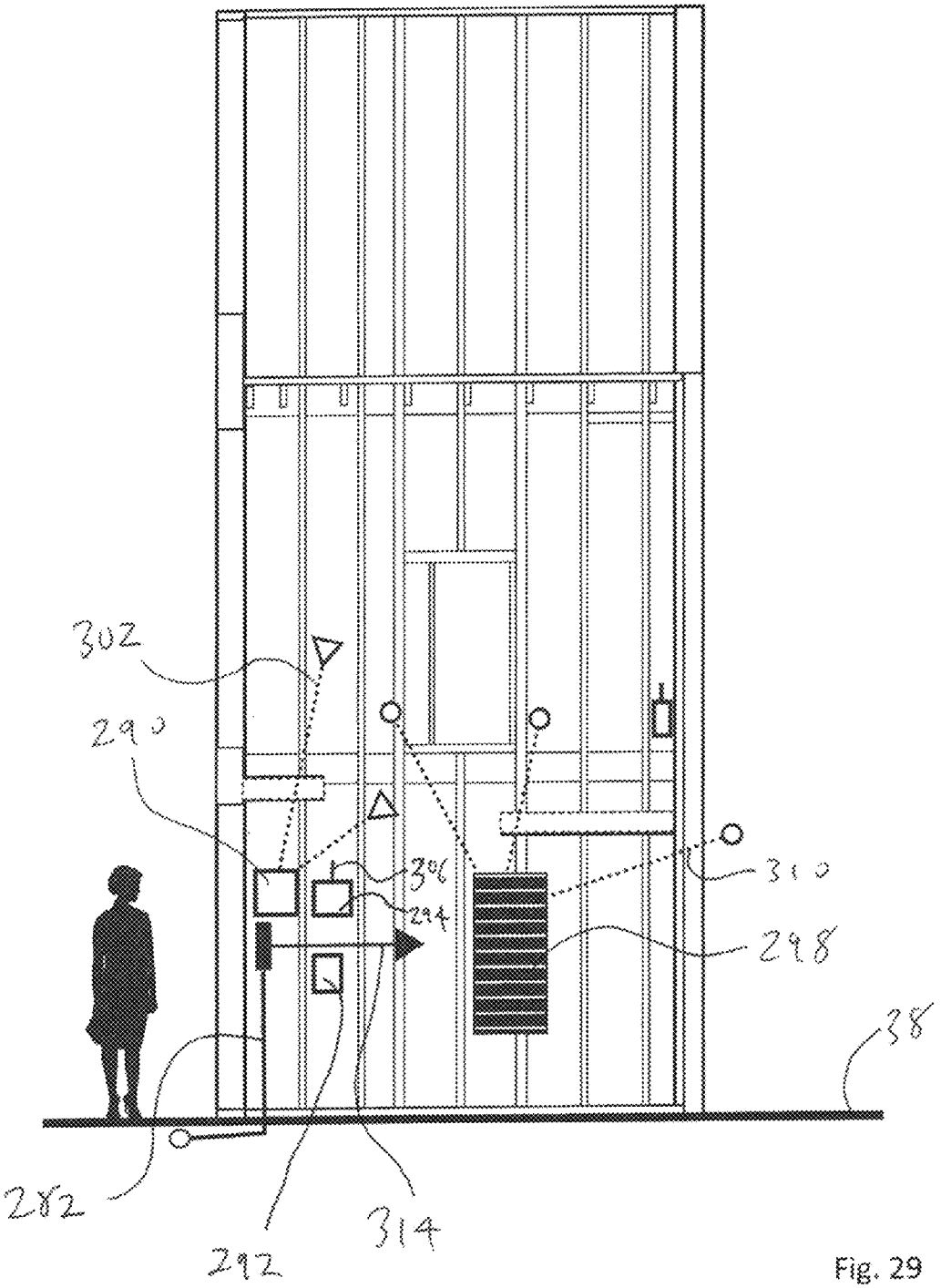
FIG. 29 is an elevational view of the 3 storey core as seen from the line 29-29 on FIG. 28.

FIGS. 27-29 show the telephone, TV, data and security aspects of the core. Telephone and cable connections may be located on the outside of the exterior wall section 18 of the core. Inside the core are a security panel 290, a phone punch block 286 and a signal splitter 306. The modem (either DSL or cable), server (if desired) and computer (if desired) are mounted in the rack 298. The incoming phone/DSL 282 or cable line 278 connects to the input of the modem. From there the data lines 310 go through a switch and patch panel to specific locations within the house, where computers or other equipment need to be connected to the network. Alternatively or additionally a wireless modem (not shown) may be connected to the switch and mounted within the core. If only a wireless modem is used, data connections 310 to specific locations within the house will be unnecessary. Incoming phone lines 282 are punched down in the punch block and telephone lines 314 run from there to specific locations within the house where telephone equipment is to be located. Low voltage wiring 302 runs from the security panel 290 to switches on doors and windows; interior detectors; and other security devices.

Figure 30:
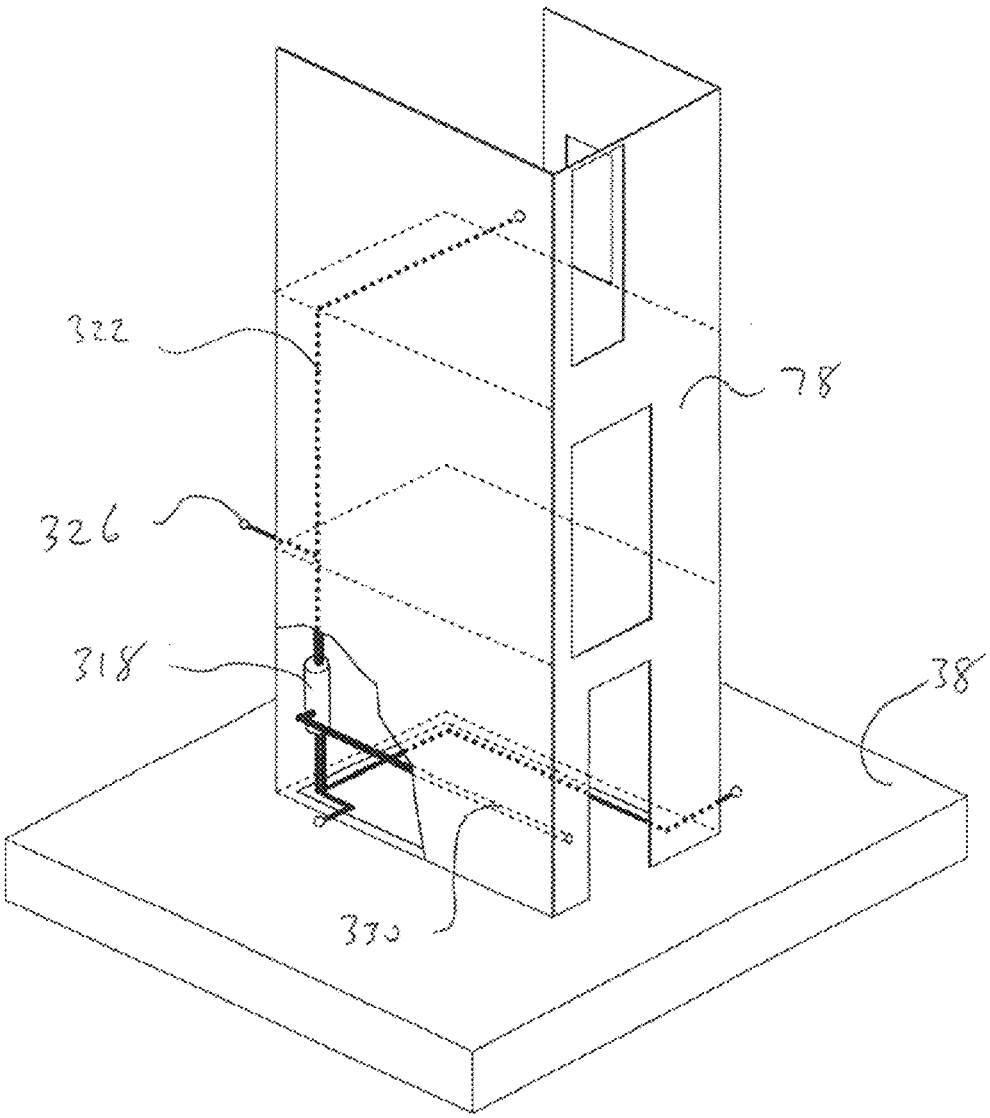
FIG. 30 is perspective view of the 3 storey core central vacuum aspects of the core.
Figure 31:
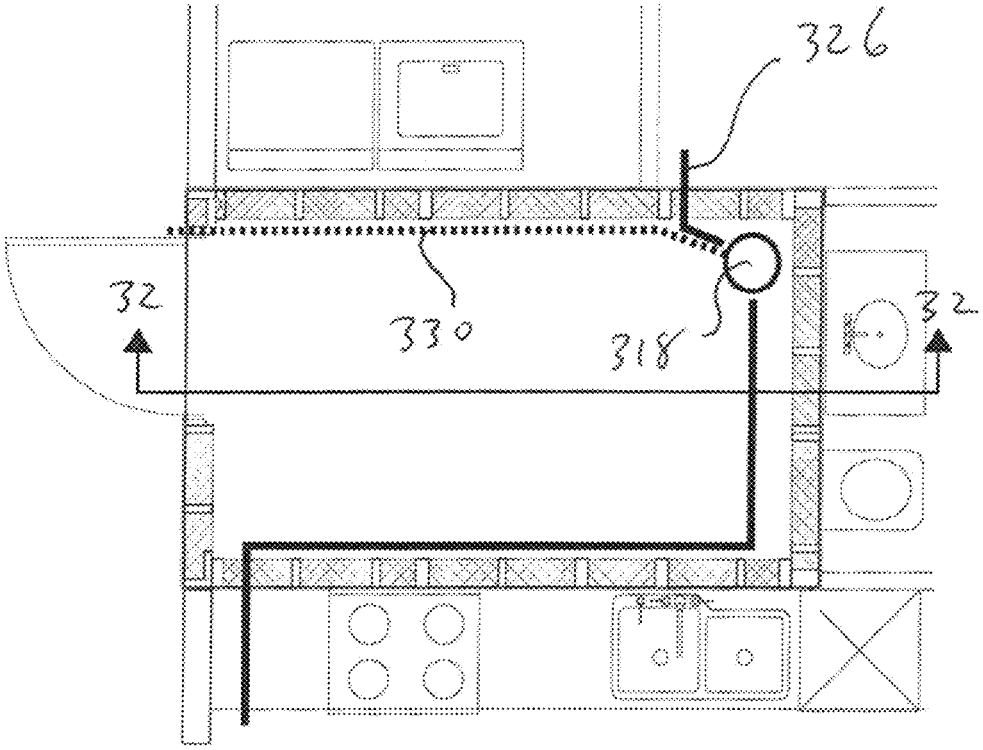
FIG. 31 is a typical ground floor plan for the core central vacuum aspects.
Figure 32:
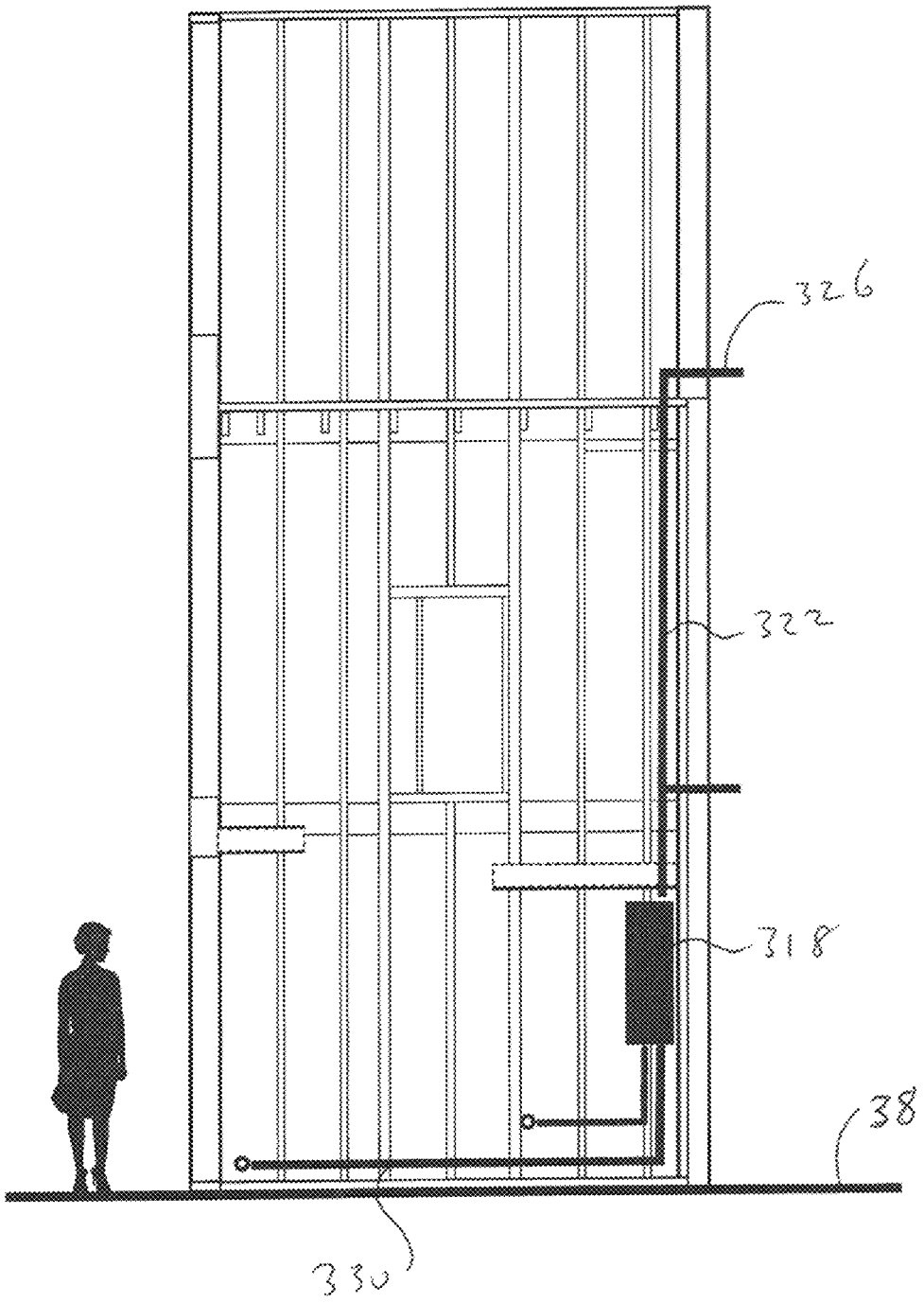
FIG. 32 is an elevational view of the 3 storey core as seen from the line 32-32 on FIG. 31.

The house may be provided with a central vacuum system. FIGS. 30-32 show the central vacuum aspect of the core. A central vacuum canister 318 is located in the core. Ducts 322 run from the canister to outlets 326 on each floor, on the exterior of the core. An exhaust duct 330 runs from the canister 318 through the exterior wall segment 18, to the exterior of the core.

Figure 33:
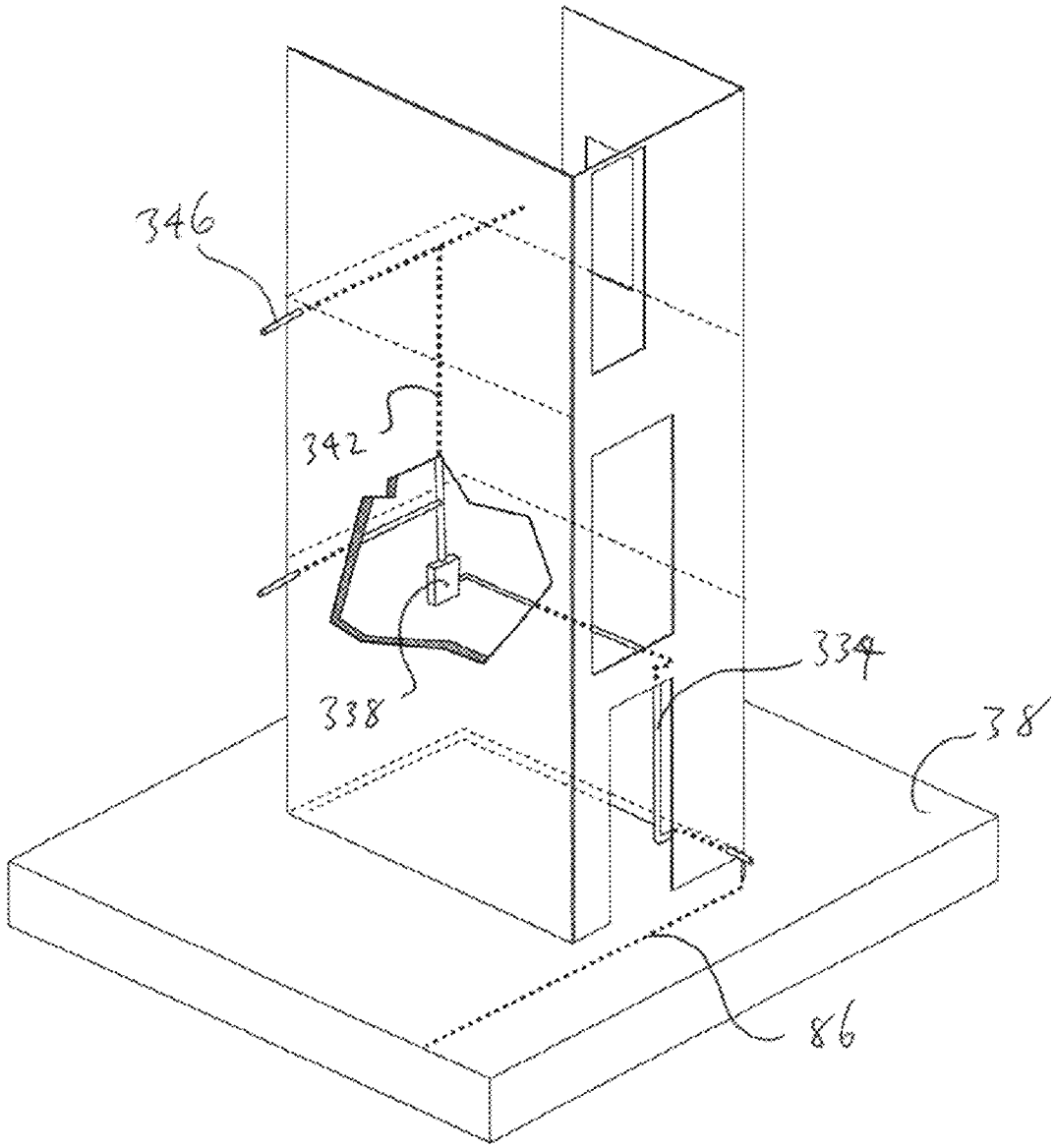
FIG. 33 is perspective view of the 3 storey core illustrating fire suppression aspects of the core.
Figure 34:
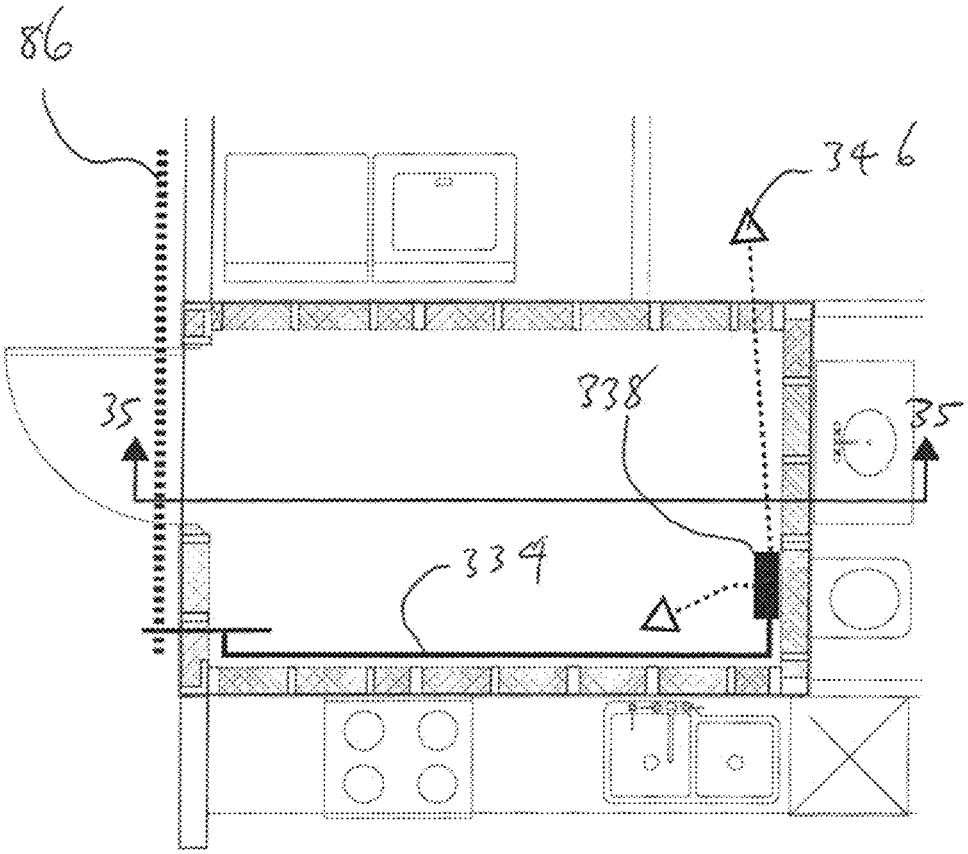
FIG. 34 is a typical ground floor plan for the core illustrating fire suppression aspects.
Figure 35:
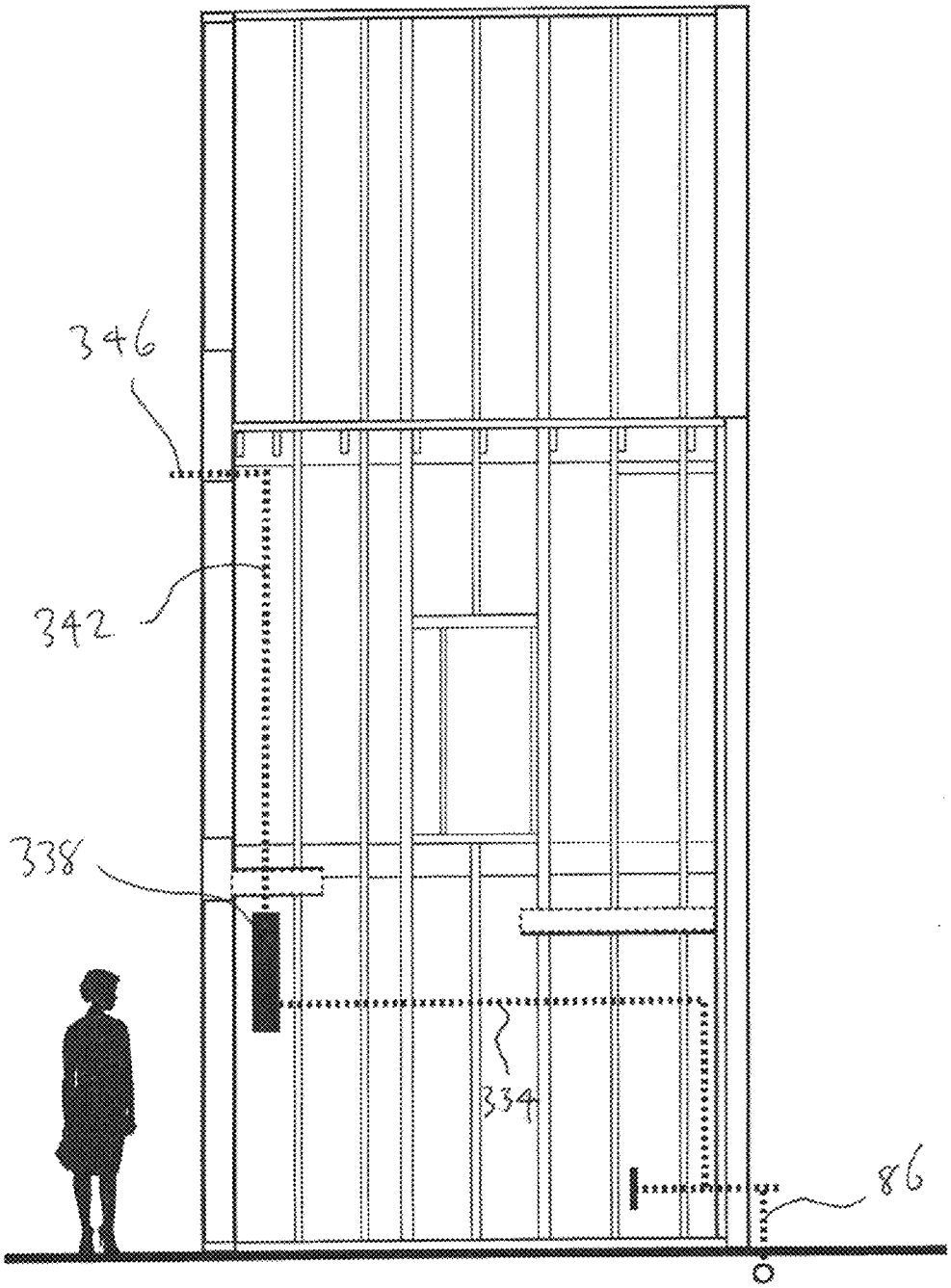
FIG. 35 is an elevational view of the 3 storey core as seen from the line 35-35 on FIG. 34.

FIGS. 33-35 show the fire suppression aspect of the Core. Conventional fire suppression systems are used. A main line 334 runs from the water mains 86 to the riser box 338, which is mounted inside the core and electrically connected to the alarm system in conventional fashion. Fire sprinkler lines 342 run from there to stubs 346 passing through the walls 22, 26, 30 of the core. These are then connected to fire sprinkler lines and heads throughout the house after it is constructed around the core.

Figure 36:
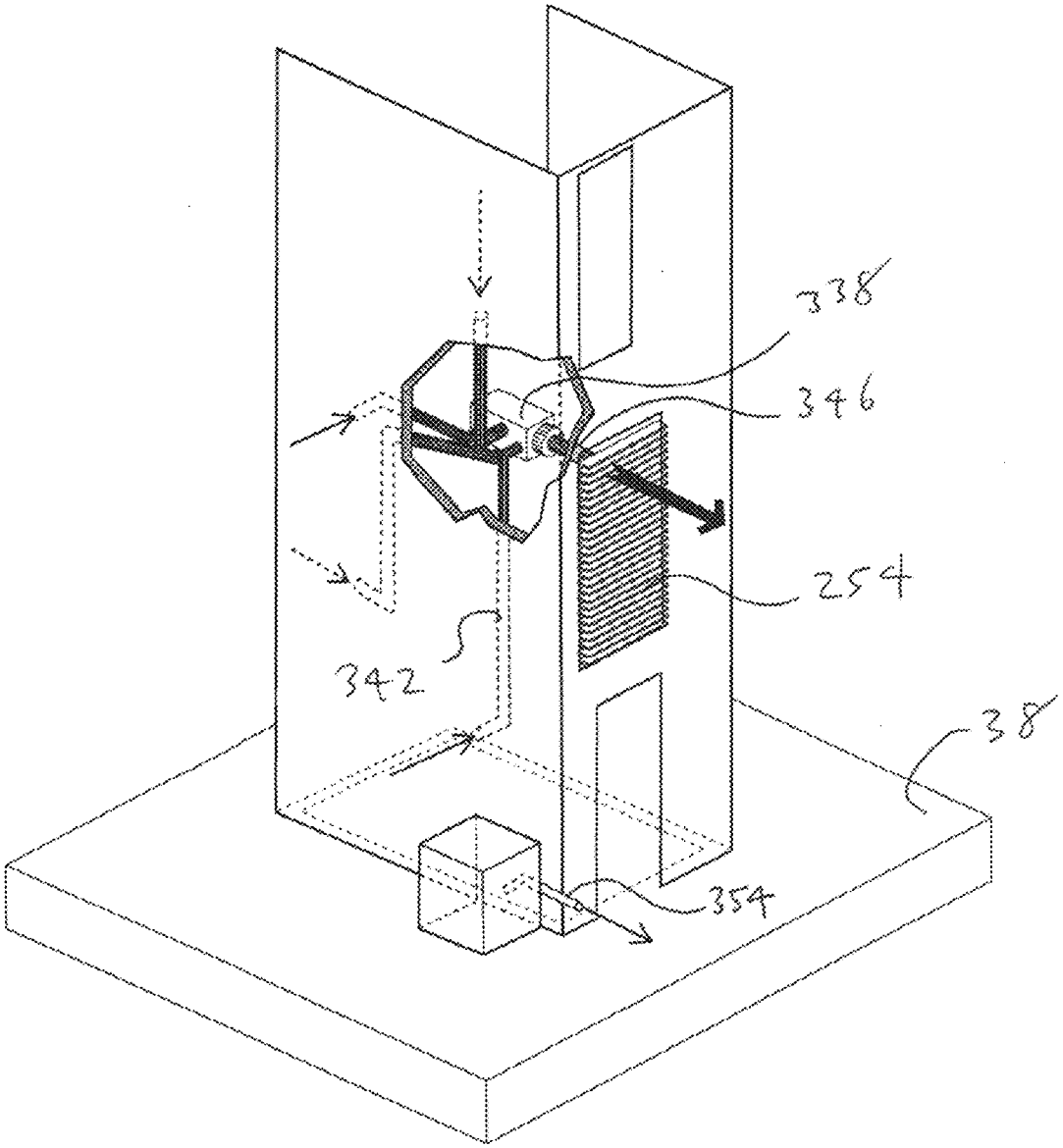
FIG. 36 is perspective view of the 3 storey core illustrating central fan aspects of the core.
Figure 37:
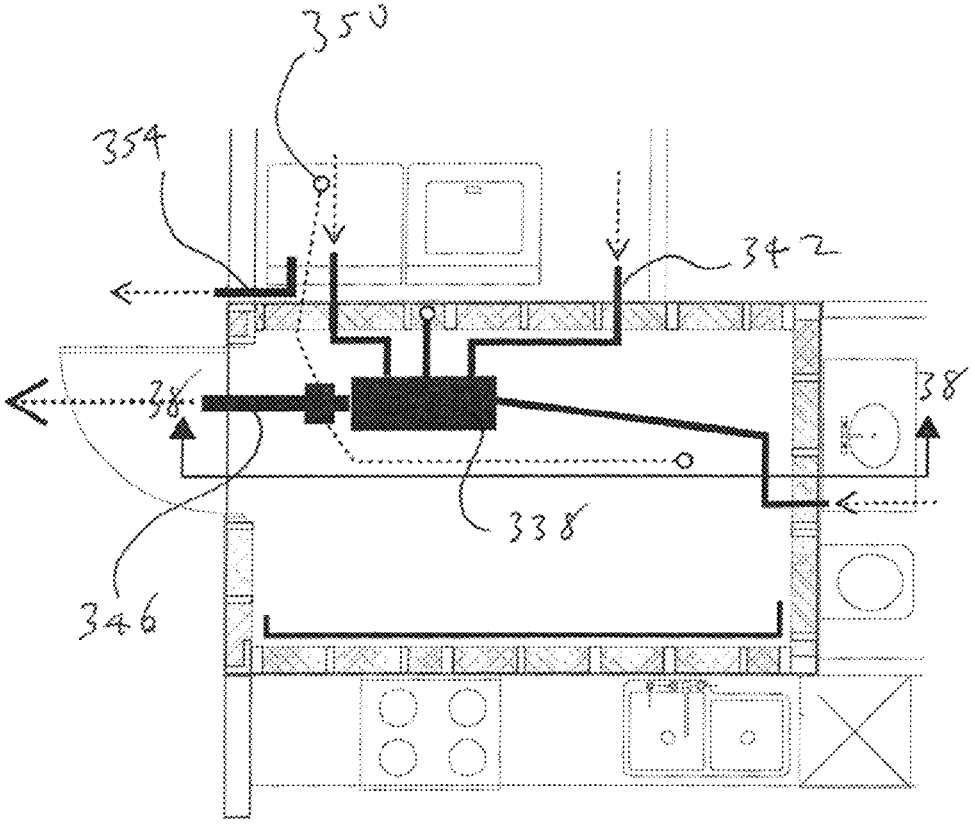
FIG. 37 is a typical ground floor plan for the core illustrating central fan aspects.
Figure 38:
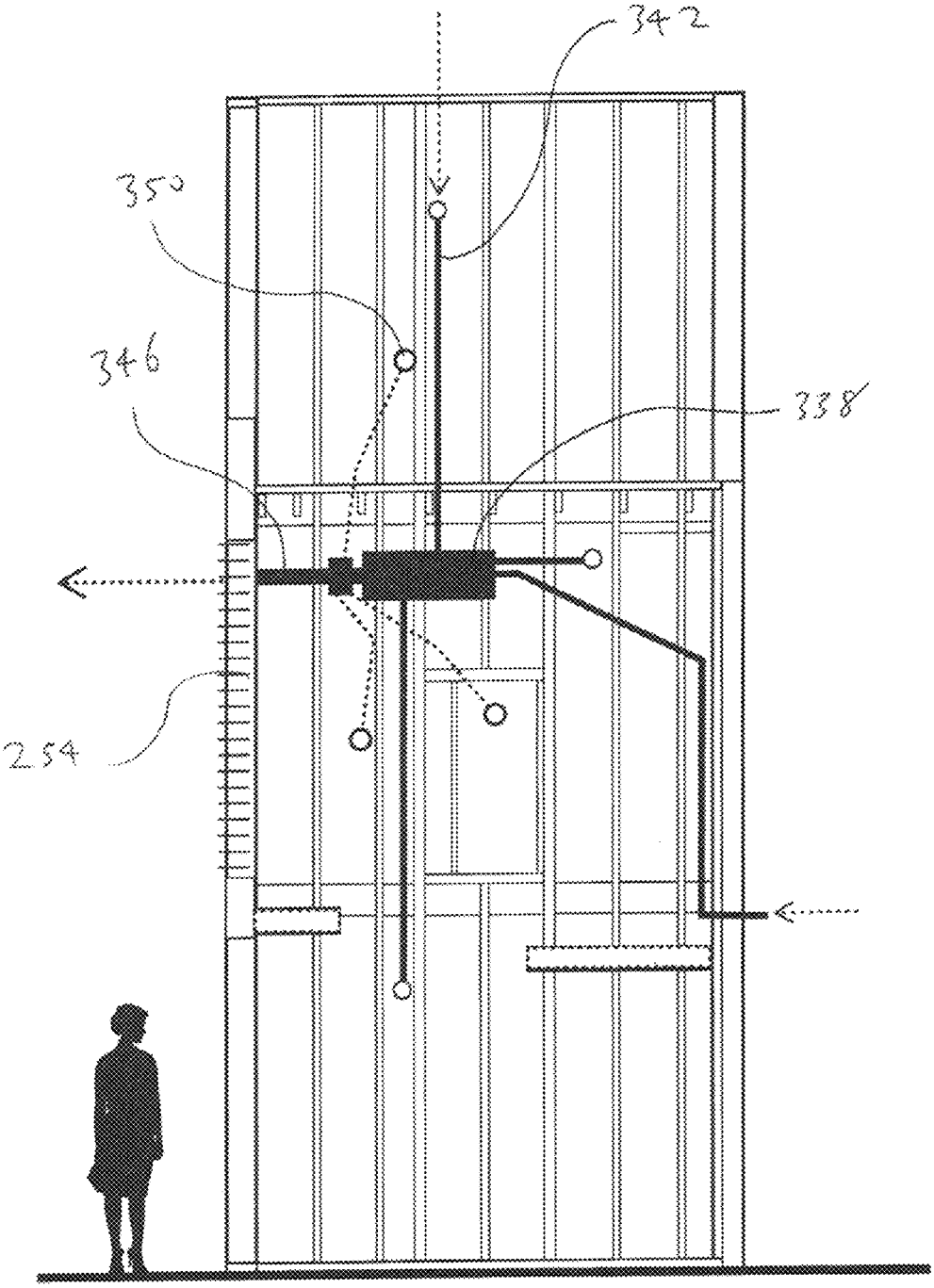
FIG. 38 is an elevational view of the 3 storey core as seen from the line 38-38 on FIG. 37.

FIGS. 36-38 show the central exhaust aspect of the core. The bathrooms and laundry room are exhausted by a remote fan 338. Inlet ducting 342 passes through the walls 22, 26, 30 of the core and connects to the fan 338. An exhaust duct 346 runs from this fan 338 to the fresh air louver 254 so the air can be vented outside the core. Control switches 350, electrically connected to the fan are located in each room. A drier vent runs from the rear of the drier through the core and then through an outside wall of the core.

Figure 39:
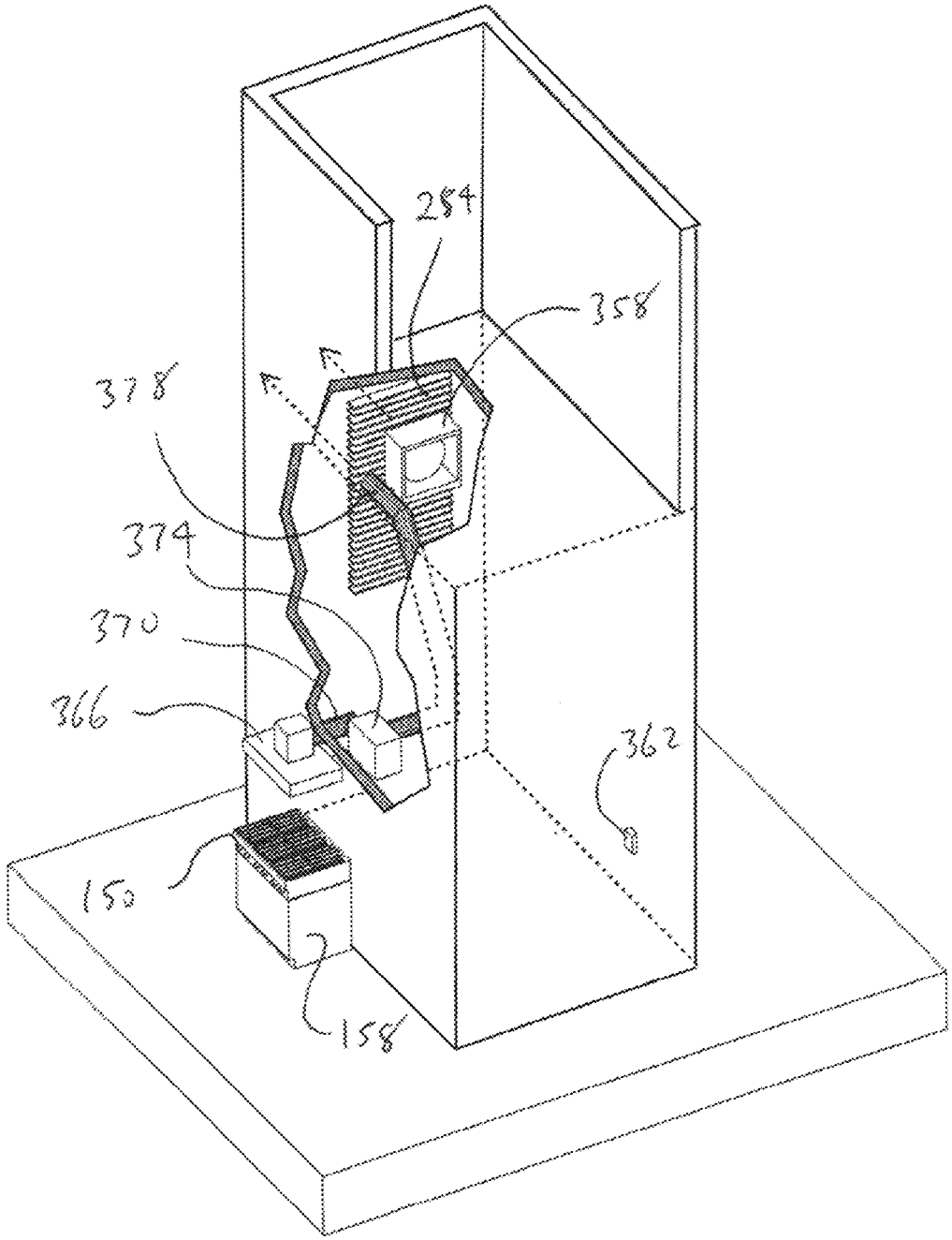
FIG. 39 is perspective view of the 3 storey core illustrating exhaust aspects of the core.
Figure 40:
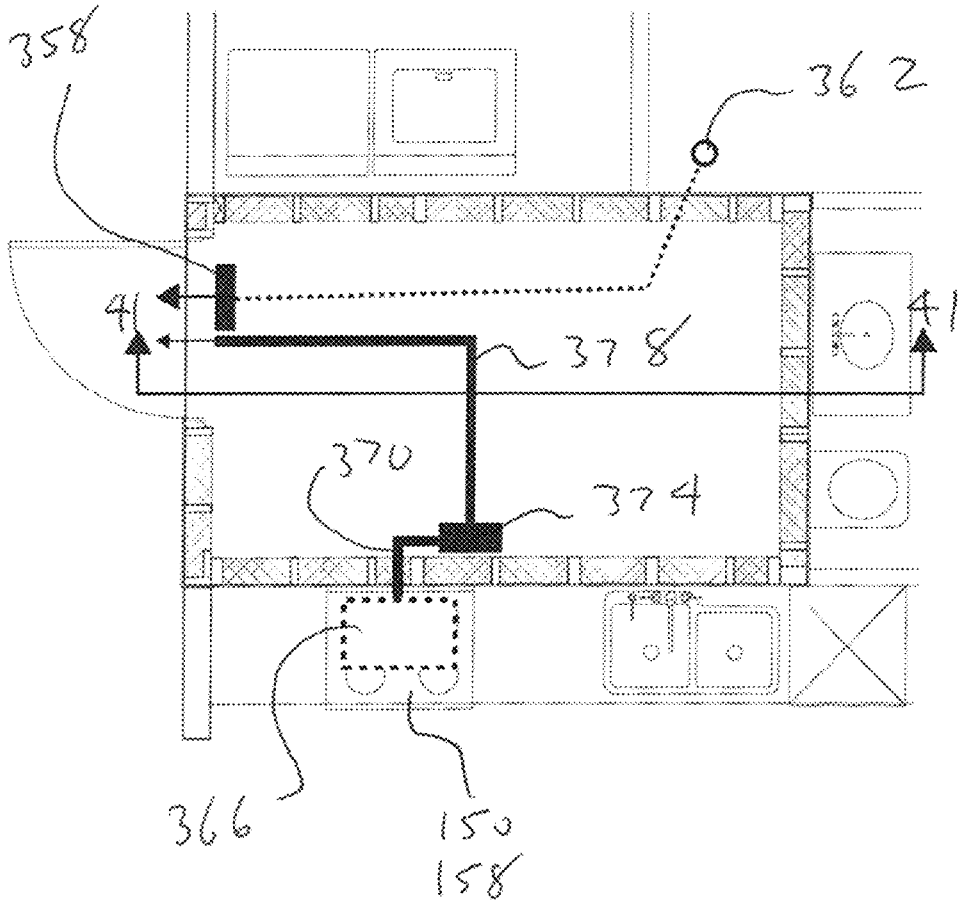
FIG. 40 is a typical ground floor plan for the core exhaust aspects.
Figure 41:
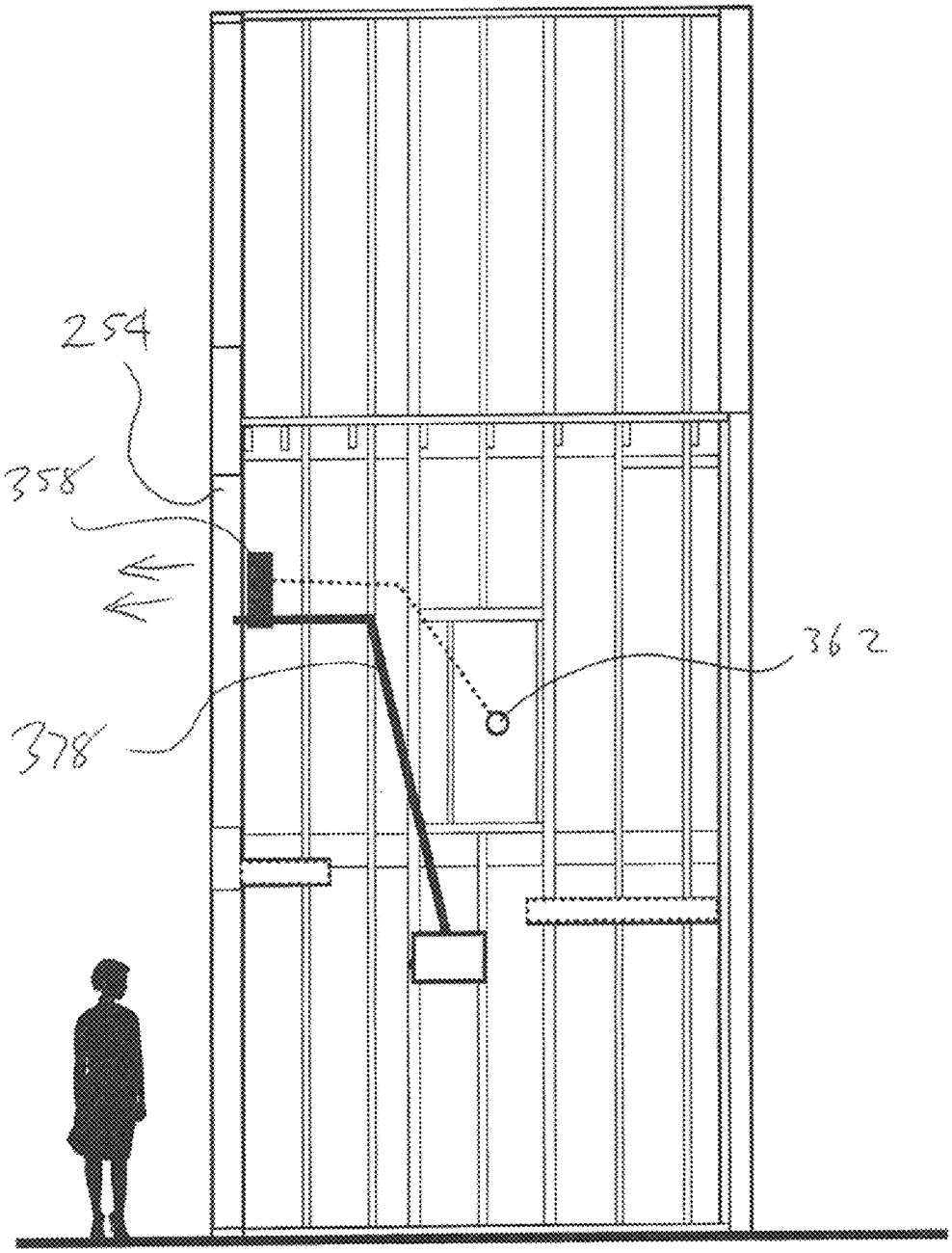
FIG. 41 is an elevational view of the 3 storey core as seen from the line 41-41 on FIG. 40.

FIGS. 39-41 show discharge of hot air. A wall fan 358 is installed near the top of the fresh air louver 254 to push the air out. A thermostat switch 362, electrically connected to this fan 358, is located on the inside of one of the interior walls 22, 26, 30 of the core. In this way the core is cooled when the temperature rises above a preset level. This helps in cooling the whole house also. In addition the kitchen air vent 366 is connected via ducting 370 to an exhaust fan 374 within the core. This fan 374 is connected to an exhaust duct 378 which vents through the fresh air louver 254.

Figure 42:
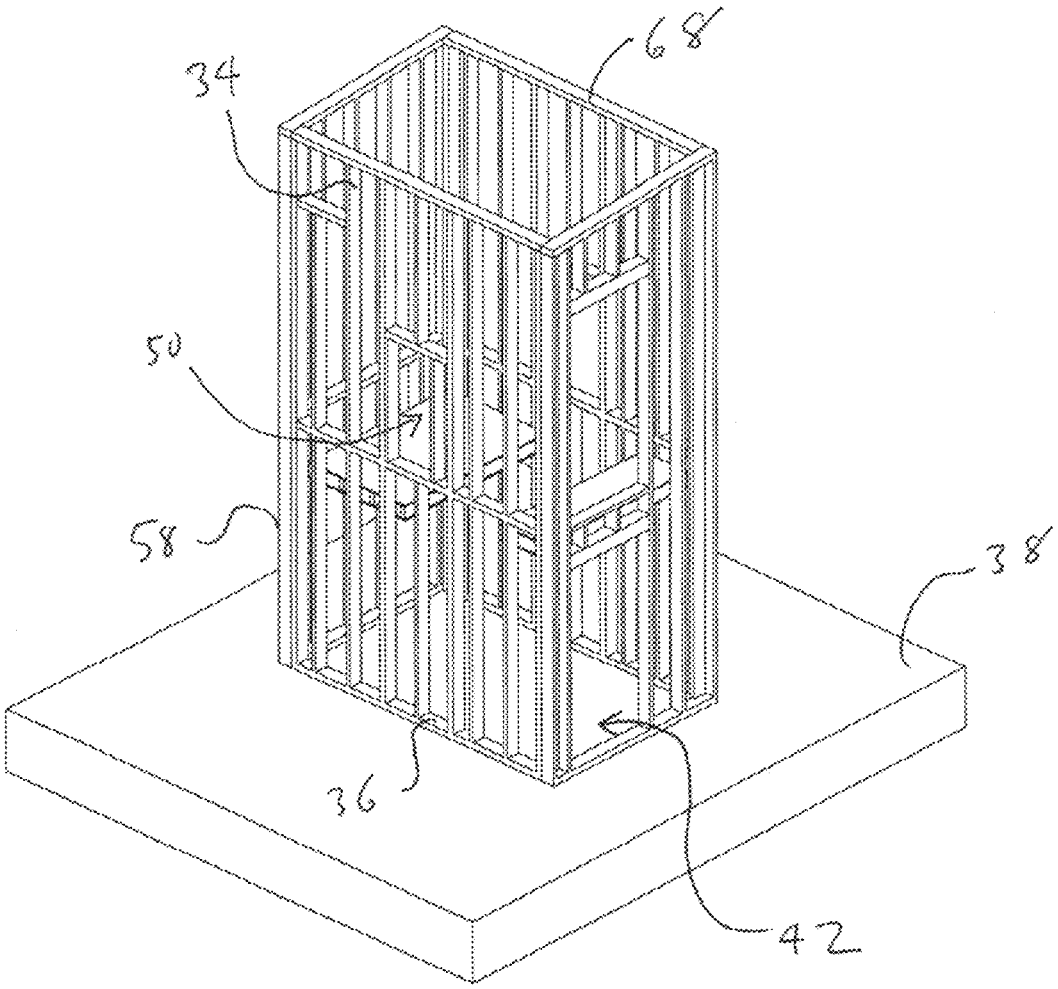
FIG. 42 is a perspective view of the balloon framing of the 2 storey core.
Figure 43:
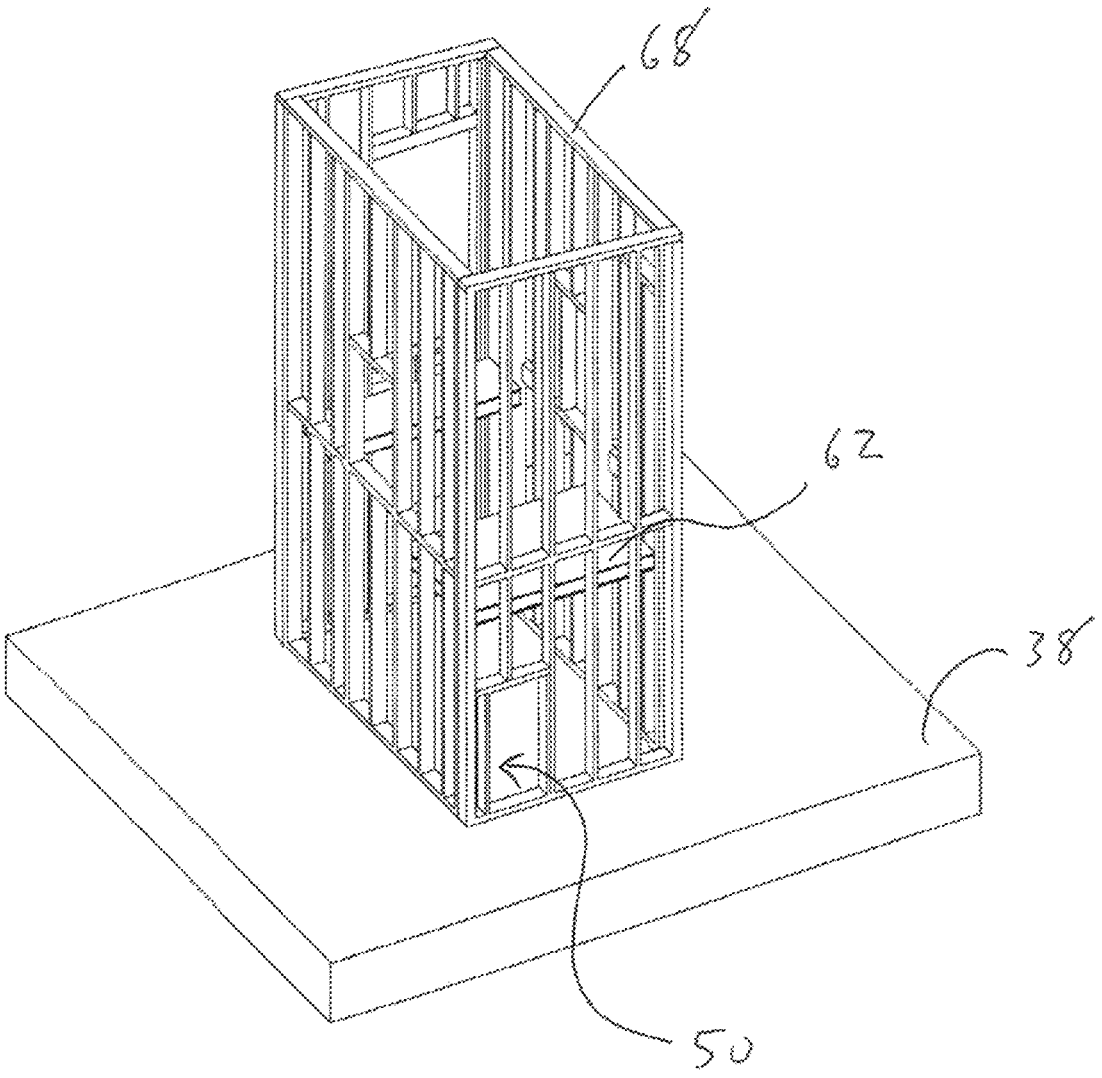
FIG. 43 is a perspective view of the balloon framing of the 2 storey core showing the floor framing.
Figure 44:
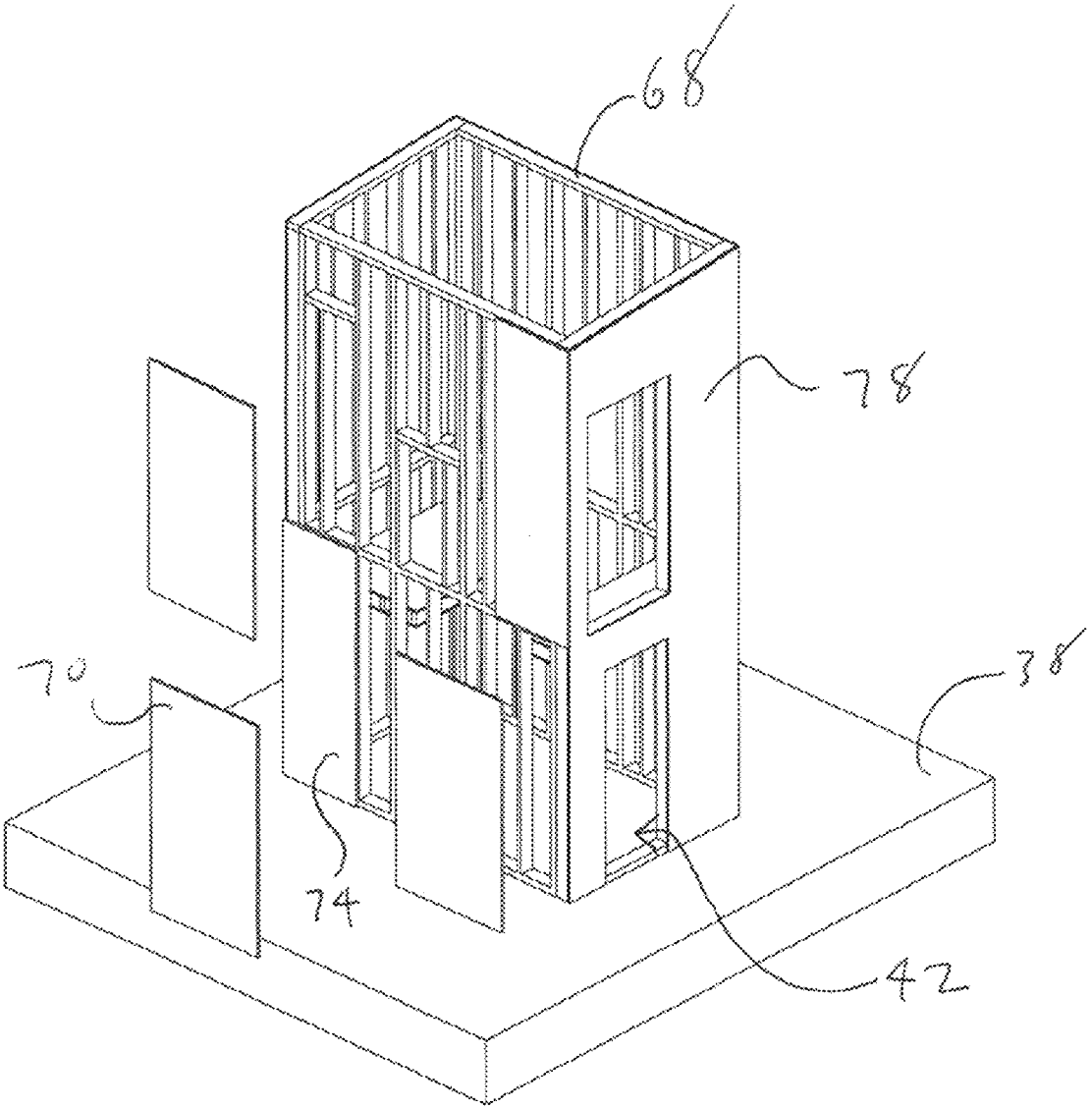
FIG. 44 is a perspective view of the 2 storey core illustrating attachment of sheeting which provides structural support to the core and the whole building.
Figure 45:
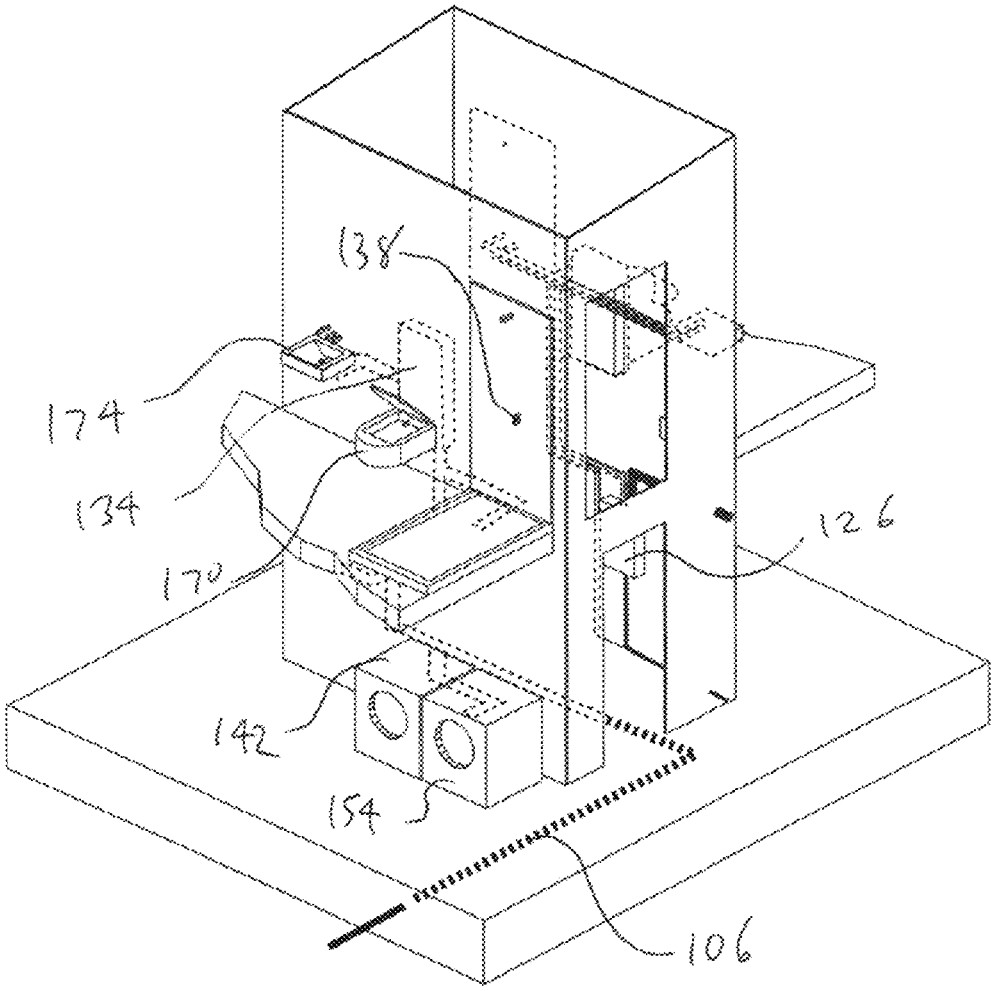
FIG. 45 is perspective view of the 2 storey core illustrating some plumbing and sewer aspects.

FIGS. 42-44 show structural aspects of the two storey core. The two storey core is built similarly to the three storey core except there is no third storey, no third storey floor and no third storey bathroom. All other facilities and appliances are installed and attached the same way in the two and three storey cores. By way of example, FIG. 45 shows some plumbing and waste aspects of the two storey core.

This invention is preferably made prefabricated. It is light and rigid which makes it easy to transport. It is sized to be transported on a standard semi-trailer without wide load provisions. It will be understood that the following items will be installed during prefabrication of the core: structural hold downs 54, interior platforms 62, an access door, a fresh air louver 254, a water main connection 94, a gas main connection 98, drain lines 114, 118 and sewer connections 102, a clothes washer connection, a drier connection (including the gas connection 178), stove and oven connections (including the gas connection 182) a dishwasher connection, toilet mechanisms 134, all faucets 130 and mixing valves 138, all plumbing 122, 146, 162 and shut off valves, a water heater 126, an electric mains connection, a breaker box 202, at least one forced air unit 234, an air conditioning condenser 242, a return air duct 246 and stub, a supply air duct 250 and stub 258, a phone line connection, a television line connection, a punch block 286, a signal splitter 294, a modem, a security panel 290, a fire suppression unit 338, sprinkler line 342 and stubs 346, an exhaust fan 338 with inlet 342 and outlet ducting and control switches 350, a drier vent 354, a range hood 336 with remote fan 374, ducting 370, 378 and electrical wiring, and a core exhaust fan 358 with thermostatic control 362.

The foundation, with sewer connections incorporated in it is poured on the job site. Then the core is delivered and placed in its proper place on the foundation and secured with the structural hold downs. Construction then proceeds as follows.

Erection of framing for the rest of the house on the foundation. Wood and steel are usually used for framing members. Openings are left in the framing for placement of doors and windows.

Construction of upper floor(s), connecting them to the interior walls of the core and the rest of the framing.

Installation of windows and doors.

Construction of roofing on top of the framing.

Installation of exterior walls and/or siding.

Running electrical wiring from subpanel.

Running alarm system wiring from alarm panel.

Running of phone system wiring from punch block.

Installation of local area network LAN wiring from modem.

Installation of insulation in exterior walls and attic.

Attachment of drywall to interior of framing.

Installation of underlayment for floors.

Installation of trim

Painting.

Installation of finish electrical, such as switches and lights.

Installation of finish alarm system.

Installation of LAN and phone system jacks and cover plates.

Installation of all sinks

Installation of bathroom and kitchen counters and cabinets

Installation of faucet décor and toilet bowls.

Installation of carpet and other flooring.

Hookup to water main or well.

Hookup to sewer or septic system

Correction of problems.

It will be understood from the above descriptions that in a house constructed with the core of this invention, the bathrooms, kitchen and laundry room are located next to the outside of an interior wall segment.

Figure 1A:
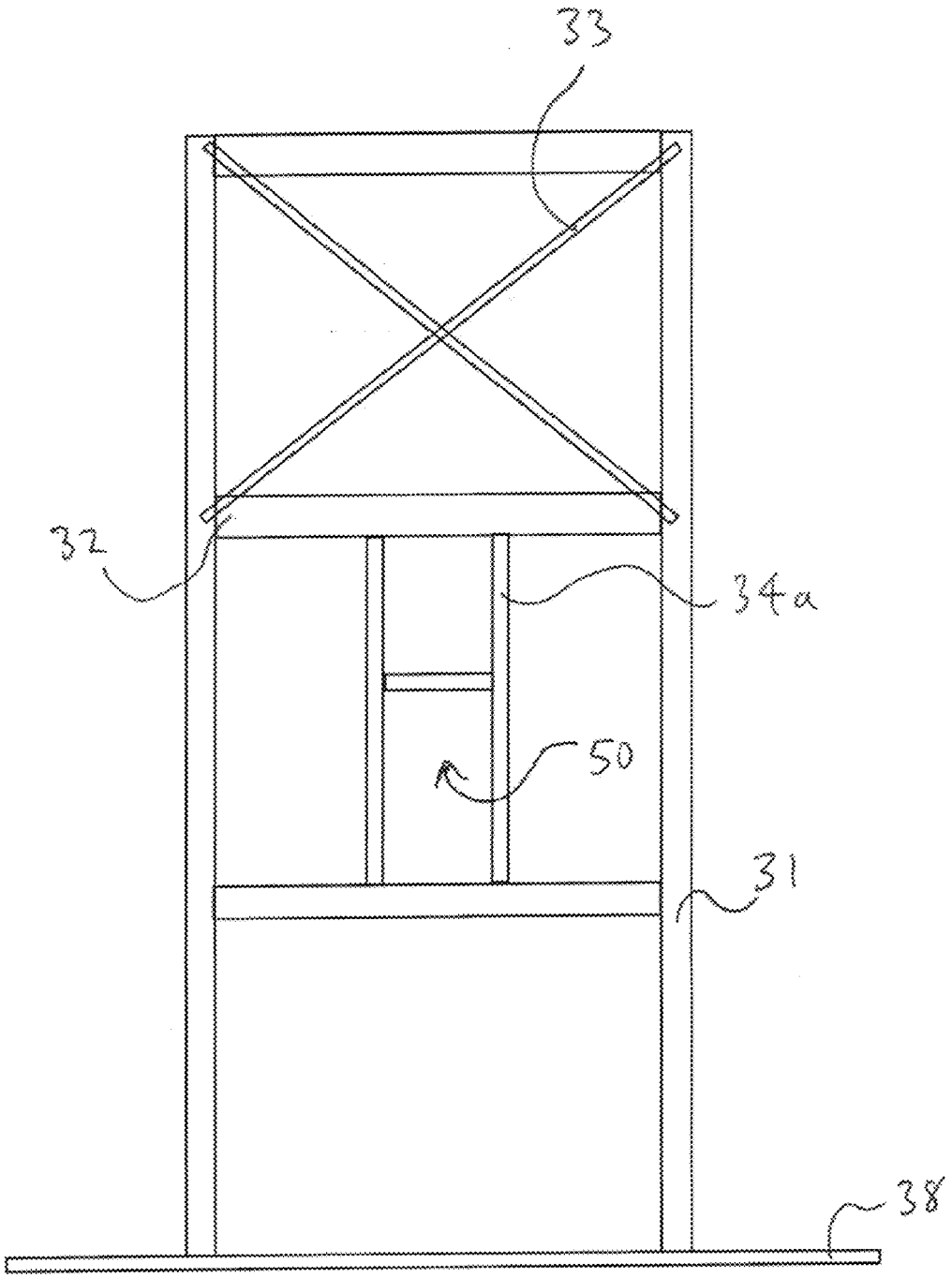
FIG. 1A is an elevational view of an alternate type of framing.
Figure 2:
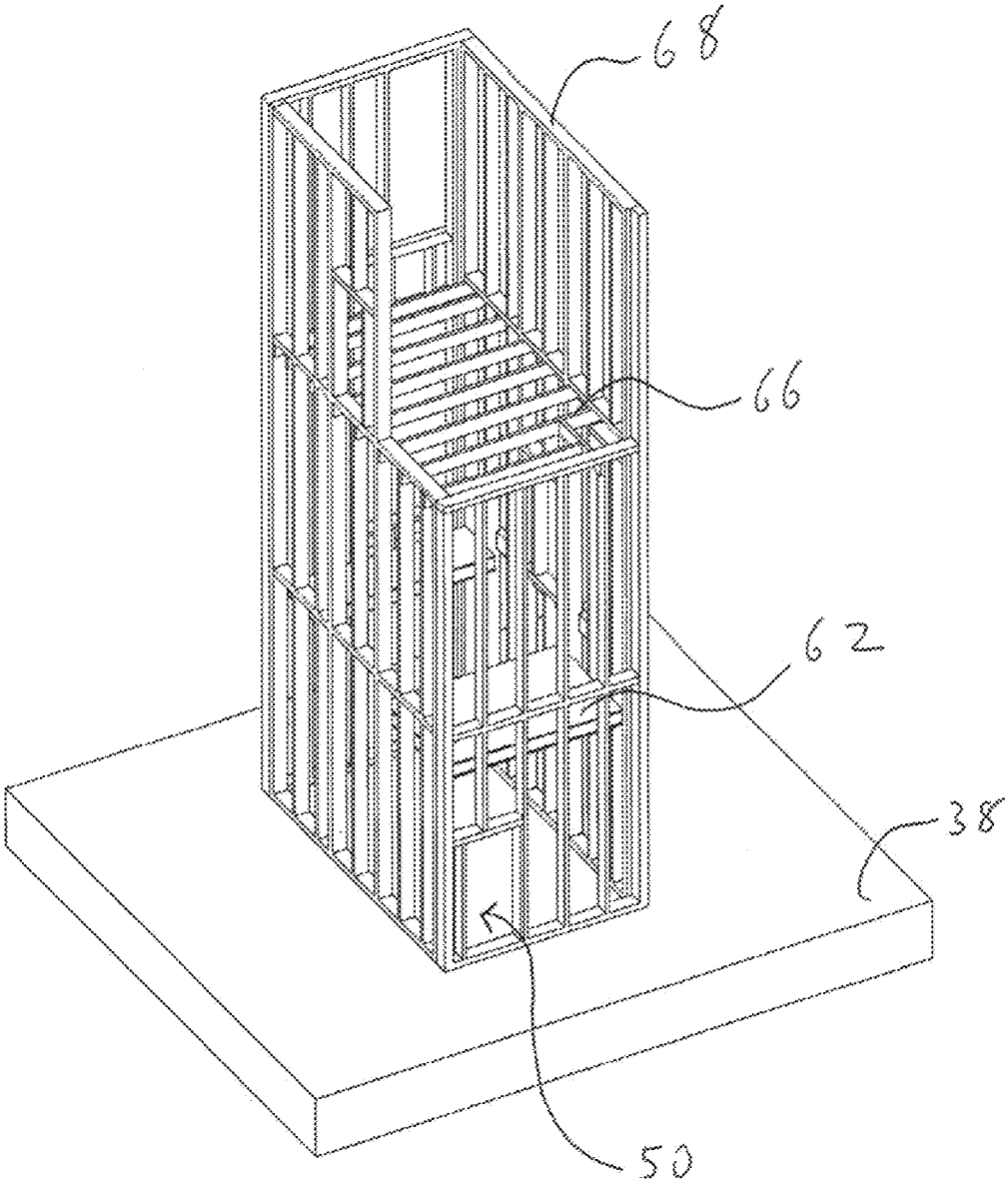
FIG. 2 is a perspective view of the balloon framing of the 3 storey core showing the floor framing.
Figure 3:
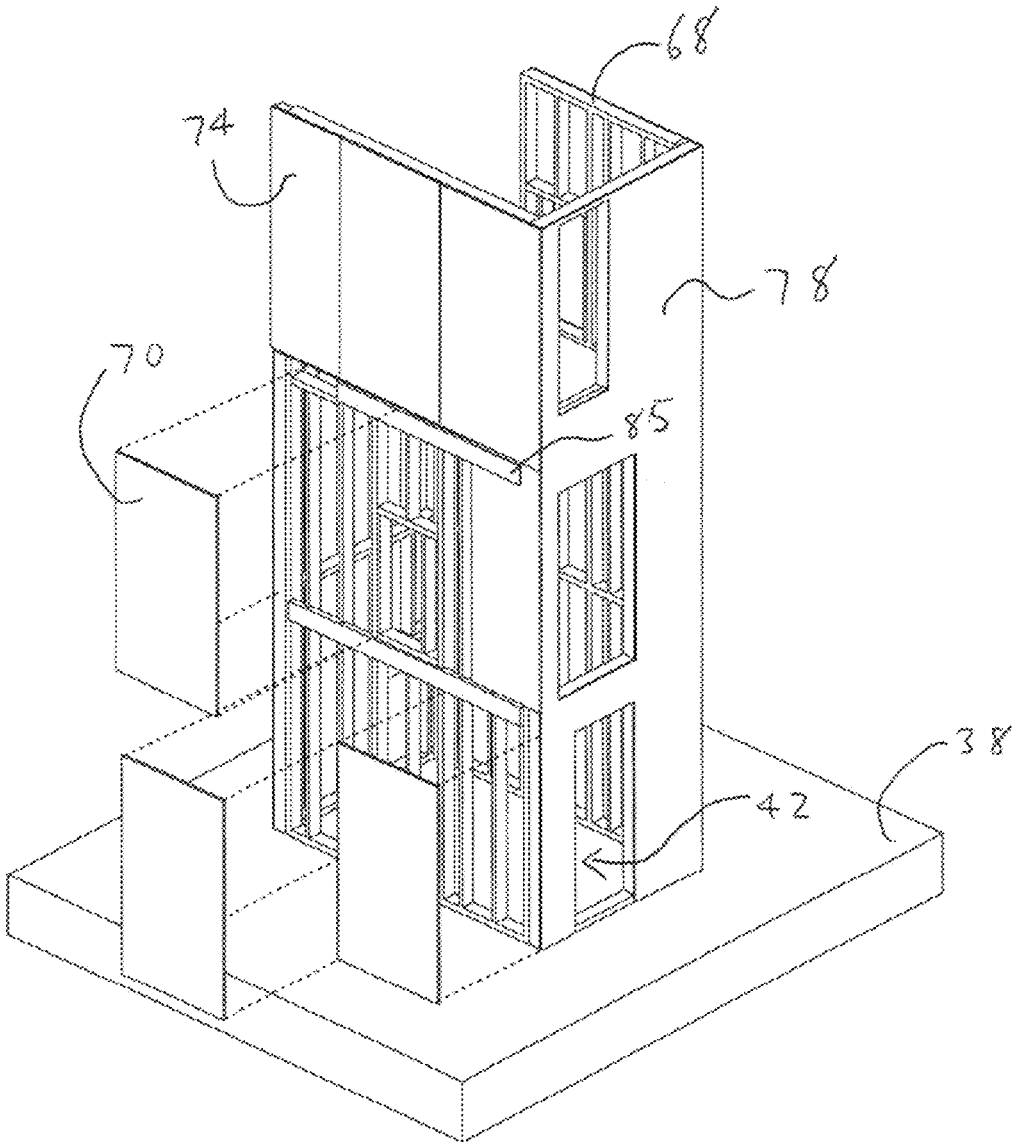
FIG. 3 is a perspective view of the 3 storey core illustrating attachment of sheeting which provides structural support to the core and the whole building.
Figure 4:
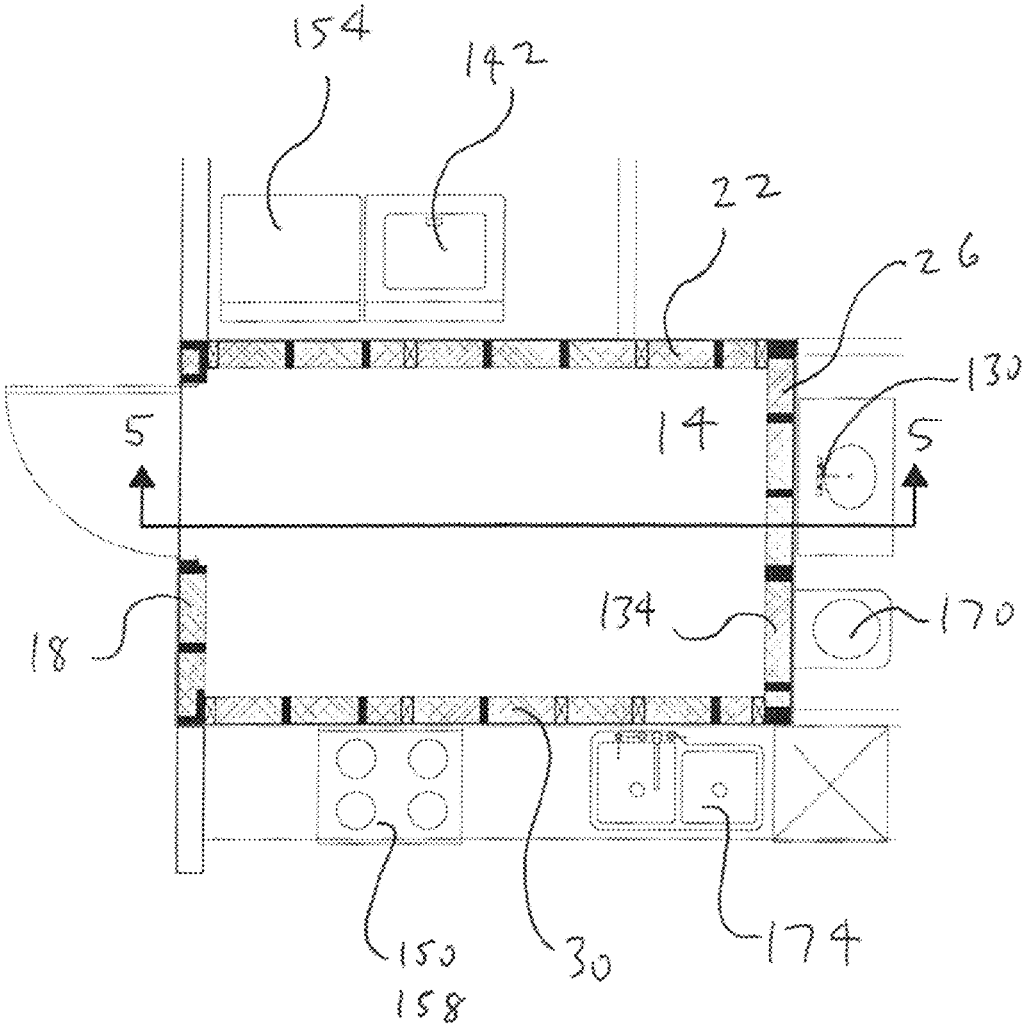
FIG. 4 is a typical ground floor plan for the core.

The following reference numerals are used on FIG. 1 through . . . :

14 room of core
18 exterior wall segment
22 interior wall segment
26 interior wall segment
30 interior wall segment
31 steel corner post
32 steel beam

33 steel cross brace
34 stud—usually of wood
34*a* steel stud
36 sill
38 foundation
40 threaded stud
42 access door opening
44 nut
46 fresh air louver opening
48 bolt
50 space for toilet mechanism
54 structural hold down
58 corner
62 interior platform
66 floor joist interior to core
68 top of core
70 sheathing panel
74 outside of interior wall segment
78 outside of exterior wall segment
82 floor joist exterior to core but interior to house
83 nail
84 joist hangers
85 ledger board
86 water main
90 gas main
94 water main connection
96 irrigation line
98 gas main connection
100 sprinkler controller
102 sewer connection
106 main sewer line
110 sewer stub
114 vertical drain
118 lateral drain
120 sewer vent
122 cold water line
126 water heater
128 water heater vent
130 faucet
134 toilet mechanism
138 mixing valve
142 clothes washer
146 gas line
150 range
154 clothes drier
158 oven
162 hot water line
166 inside of interior wall segment
170 toilet bowl
174 sink
178 drier gas connection
182 range gas connection
186 forced air unit gas connection
190 electric main
194 electric meter
198 main electrical wiring
202 electric subpanel
206 electric circuits
210 lighting control panel
214 low voltage light control cable (CATS or twisted pair)
218 light fixture(s)
222 light control
226 lighting power line
230 conduit for lighting power line
234 first forced air unit
238 second forced air unit
242 air conditioning condenser unit
246 return air duct
250 supply air duct
254 fresh air louver
258 air stubs
262 filtration tanks
266 water softener
268 backwash tank for water softener
270 reverse osmosis control panel
274 reverse osmosis tank
278 cable line
282 telephone line
286 phone punch block
290 security system control panel
292 incoming cable box
294 splitter
298 data rack
302 internal security line
306 coax cable carrying TV signal
310 data lines
314 internal phone line
318 central vacuum canister
322 vacuum duct
326 vacuum connection
330 exhaust duct
334 main fire suppression system water line
338 remote fan
342 room exhaust ducting
346 main exhaust duct
350 control switch
354 drier vent
358 wall fan
362 thermostat switch
366 kitchen range hood
370 range hood exhaust ducting
374 fan
378 exhaust duct Thus, the present invention has been described herein with reference to a particular embodiment for a particular application. Those having ordinary skill in the art and access to the present teachings will recognize additional modifications, applications and embodiments within the scope thereof It is therefore intended by the appended claims to cover any and all such applications, modifications and embodiments within the scope of the present invention.

What is claimed is:

1. A core for a building comprising:

a) an exterior wall section and three interior wall sections joined together to form a room; said interior and exterior wall sections being at least two storeys tall; each of said wall sections having a top, an inside and an outside; said interior wall sections being shear walls; the outsides of said interior wall sections being finished with an interior finish; the outside of said exterior wall section being finished with an exterior finish;

b) a structural hold down attached to said room, within said room, at each corner;

c) an interior platform attached to the inside of at least one of said walls;

d) a means for attaching an external floor, external to said room, to each of said interior walls;

e) an access door in said exterior wall; said access door being sized for ingress and egress to said room for a person in full upright position;

f) a fresh air louver within said exterior wall;

g) a water main connection located outside said exterior wall section;

h) a gas main connection located outside said exterior wall section;
i) a sewer connection located inside said room;
j) a water heater appliance in said room;
k) a clothes washer connection located adjacent and outside of one of said interior wall sections;
l) a drier connection located adjacent and outside of one of said interior wall sections;
m) a dishwasher connection located adjacent and outside of one of said interior wall sections;
n) a first toilet mechanism appliance located within at least one of said interior wall sections; said mechanism installed so that the bowl for said toilet will install from outside of said room;
o) a faucet appliance attached to said outside of at least one of said interior wall sections;
p) a mixing valve appliance attached to said outside of at least one of said interior wall sections;
q) plumbing and shut off valves interconnecting said water main connection, gas main connection, sewer connection, water heater, clothes washer connection, drier connection, dishwasher connection, toilet mechanism, faucet and mixing valve, as necessary and appropriate; said shut off valves being located adjacent the insides of said interior walls as close as possible to said appliances and said interior connections;
r) an irrigation connection connected to said water main and located outside said exterior wall section;
s) an electric mains connection located on said exterior of said exterior wall section;
t) a breaker box located within said room and electrically connected to said electric mains connection;
u) a forced air unit within said room;
v) an air conditioning condenser unit within said room, connected by ducting within said room to said forced air unit and located near said fresh air louver, whereby hot air produced by said air conditioning condenser unit can escape through said louver;
w) a return air duct stub connected to said forced air unit and running through one of said interior wall sections;
x) a supply air duct stub connected to said forced air unit and running through one of said interior walls;
y) a phone line connection located outside said exterior wall section;
z) a television signal connection located outside said exterior wall section;
aa) a telephone punch block located inside said room and electrically connected to said phone line connection;
bb) a signal splitter located inside said room and electrically connected to said television signal connection;
cc) a modem inside said room and electrically connected to one of said telephone punch block via a DSL line and said signal splitter;
dd) a security panel inside said room, electrically connected to one of said telephone punch block and said modem;
ee) a fire suppression unit within said room connected by a plumbing line to said water main connection;
ff) a sprinkler line stub running from said fire suppression unit through an interior wall of said room;
gg) an exhaust fan within said room;
hh) an inlet duct running through an interior wall of said room to said exhaust fan;
ii) an outlet duct running from said fan to said fresh air louver;
jj) an exhaust fan control switch attached to the outside of at least one of said interior wall sections and electrically connected to said exhaust fan;
kk) a drier vent running from behind the eventual location of said clothes drier through said interior wall through said room and through said exterior wall;
ll) a range hood attached to the outside of one of said interior walls over the eventual location of said range;
mm) a range exhaust fan in said room;
nn) range hood inlet ducting connecting said range hood to said range exhaust fan;
oo) range exhaust ducting running from said range exhaust fan to said fresh air louver;
pp) control wiring running from the switch in said range hood to said range exhaust fan;
qq) a core exhaust fan located in said room adjacent said fresh air vent; and
rr) a thermostatic control inside said room and electrically connected to said core exhaust fan;

said room being sized to: contain all the above listed equipment, and allow for access to, repair of and replacement of said equipment by a person.

2. A core for a building as claimed in claim 1 in which said walls contain platform framing.

3. A core for a building as claimed in claim 1 in which said walls contain balloon framing.

4. A core for a building as claimed in claim 1 in which said walls contain rigid steel framing.

5. A core for a building as claimed in claim 1 in which said walls contain balloon framing.

6. A core for a building as claimed in claim 1 further comprising an internet protocol lighting control panel located within said room and electrically connected to said breaker box.

7. A core for a building as claimed in claim 1 further comprising a water filtration unit inside said room in said plumbing between said water main connection, and said appliances and said interior connections.

8. A core for a building as claimed in claim 1 further comprising a reverse osmosis unit in said plumbing between said water main connection, and said appliances and said interior connections.

9. A core for a building as claimed in claim 1 in which said modem is a wired/wireless modem.

10. A core for a building as claimed in claim 1 in which said modem is a wireless modem.

11. A core for a building as claimed in claim 1 further comprising;

a) a central vacuum canister in said room;
b) a central vacuum outlet in at least one of said interior walls;
c) vacuum tubing connecting said central vacuum canister to said central vacuum outlet.

12. A core for a building as claimed in claim 1 further comprising a server in said room.

13. A core for a building as claimed in claim 1 further comprising an interior floor joined to said wall sections one storey below the tops of said wall sections; whereby an interior room is created.

14. A core for a building as claimed in claim 13 in which said interior room is a bathroom; said bathroom comprising:

a) A second toilet mechanism appliance located within at least one of said interior wall sections; said mechanism installed so that the bowl for said second toilet mechanism appliance will install from inside of said interior room;

b) a faucet appliance attached to said inside of at least one of said interior wall sections;

c) a mixing valve appliance attached to said inside of at least one of said interior wall sections;

d) plumbing and shut off valves interconnecting said water main connection, sewer connection, water heater, toilet mechanism, faucet and mixing valve as necessary and appropriate; said shut off valves being located under said interior floor as close as possible to said appliances.

15. A method of fabricating a core for a building comprising the steps of:

a) fabricating a room having an exterior wall section and three interior wall sections; said interior and exterior wall sections being at least two storeys tall; each of said wall sections having a top, an inside and an outside; said interior wall sections being shear walls; the outsides of said interior wall sections being finished with an interior finish; the outside of said exterior wall section being finished with an exterior finish;

b) attaching a structural hold down to said room, within said room, at each corner;

c) constructing an interior platform attached to the inside of at least one of said walls;

d) fabricating a means for attaching an external floor, external to said room, to each of said interior walls;

e) installing an access door in said exterior wall; said access door being sized for ingress and egress to said room for a person in full upright position;

f) installing a fresh air louver within said exterior wall;

g) installing a water main connection outside said exterior wall section;

h) installing a gas main connection outside said exterior wall section;

i) installing a sewer connection inside said room;

j) installing a water heater appliance in said core;

k) installing a clothes washer connection adjacent and outside of one of said interior wall sections;

l) installing a drier connection adjacent and outside of one of said interior wall sections;

m) installing a dishwasher connection adjacent and outside of one of said interior wall sections;

n) installing a first toilet mechanism appliance located at least one of said interior wall sections; said mechanism installed so that the bowl for said first toilet mechanism appliance will install from outside of said room;

o) attaching a faucet appliance to said outside of at least one of said interior wall sections;

p) attaching a mixing valve appliance to said outside of at least one of said interior wall sections;

q) installing plumbing and shut off valves interconnecting said water main connection, gas main connection, sewer connection, water heater, clothes washer connection, drier connection, dishwasher connection, toilet mechanism, faucet and mixing valve as necessary and appropriate; said shut off valves being located adjacent the insides of said interior walls as close as possible to said appliances and said interior connections;

r) installing an irrigation connection to said water main and outside said exterior wall section;

s) installing an electric mains connection on said exterior of said exterior wall section;

t) installing a breaker box within said room and electrically connected to said electric mains connection;

u) installing a forced air unit within said room;

v) installing an air conditioning condenser unit within said room, near said fresh air louver; whereby hot air produced by said air conditioning condenser unit can escape through said louver;

w) connecting said air conditioning condenser by ducting within said room to said forced air unit;

x) connecting a return air duct stub to said forced air unit through one of said interior wall sections;

y) connecting a supply air duct stub to said forced air unit through one of said interior walls;

z) installing a phone line connection outside said exterior wall section;

aa) connecting a television signal connection outside said exterior wall section;

bb) installing a telephone punch block inside said room;

cc) electrically connecting said phone line to said punch block;

dd) installing a signal splitter inside said room;

ee) electrically connecting said television signal connection to said signal splitter;

ff) installing a modem inside said room;

gg) electrically connecting said modem to one of said telephone punch block via a DSL line and said signal splitter;

hh) installing a security panel inside said room;

ii) electrically connecting said security panel to one of said telephone punch block and said modem;

jj) installing a fire suppression unit within said room;

kk) connecting said fire suppression unit by a plumbing line to said water main connection;

ll) installing a sprinkler line stub running from said fire suppression unit through an interior wall of said room;

mm) installing an exhaust fan within said room;

nn) connecting an inlet duct through an interior wall of said room to said exhaust fan;

oo) connecting an outlet duct from said fan to said fresh air louver;

pp) installing an exhaust fan control switch to the outside of at least one of said interior wall sections;

qq) electrically connecting said exhaust fan control switch to said exhaust fan;

rr) installing a drier vent from behind the eventual location of said clothes drier through said interior wall through said room and through said exterior wall;

ss) attaching a range hood to a the inside of one of said interior walls over the eventual location of said range;

tt) installing a range exhaust fan in said room;

uu) connecting sais range hood to said range exhaust fan with ducting;

vv) installing range exhaust ducting from said range exhaust fan to said fresh air louver;

ww) installing control wiring from the switch in said range hood to said range exhaust fan;

xx) installing a core exhaust fan in said room adjacent said fresh air vent;

yy) installing a thermostatic control inside said room; and zz) electrically connecting said thermostatic control to said room exhaust fan;

said room being sized to: contain all the above listed equipment, and allow for access to, repair of and replacement of said equipment by a person.

16. A method of fabricating a core for a building as claimed in claim 15 in which said walls contain platform framing.

17. A method of fabricating a core for a building as claimed in claim 15 in which said walls contain balloon framing.

18. A method of fabricating a core for a building as claimed in claim 15 in which said walls contain rigid steel framing.

19. A method of fabricating a core for a building as claimed in claim 15 further comprising the steps of:

a) installing an internet protocol lighting control panel within said room; and b) electrically connecting said internet protocol lighting control panel to said breaker box.

20. A method of fabricating a core for a building as claimed in claim 15 further comprising the step of: installing a water filtration unit in said room in said plumbing between said water main connection, and said appliances and said interior connections.

21. A method of fabricating a core for a building as claimed in claim 15 further comprising the step of: installing a reverse osmosis unit in said plumbing between said water main connection, and said appliances and said interior connections.

22. A method of fabricating a core for a building as claimed in claim 15 in which said modem is a wired/wireless modem.

23. A method of fabricating a core for a building as claimed in claim 15 in which said modem is a wireless modem.

24. A method of fabricating a core for a building as claimed in claim 15 further comprising the steps of:

a) installing a central vacuum canister in said room;

b) installing a central vacuum outlet in at least one of said interior walls;

c) connecting said central vacuum canister to said central vacuum outlet with tubing.

25. A method of fabricating a core for a building as claimed in claim 15 further comprising the step of installing a server in said room.

26. A method of fabricating a core for a building as claimed in claim 15 further comprising the step of: constructing an interior floor joined to said wall sections one storey below the tops of said wall sections; whereby an interior room is created.

27. A method of fabricating a core for a building as claimed in claim 26 further comprising the steps of:

a) installing a second toilet mechanism appliance within at least one of said interior wall sections within said interior room; said mechanism installed so that the bowl for said second toilet mechanism appliance will install from inside of said room;

b) attaching a faucet appliance to said inside of at least one of said interior wall sections within said interior room;

c) attaching a mixing valve appliance to said inside of at least one of said interior wall sections within said interior room;

d) installing plumbing and shut off valves interconnecting said water main connection, sewer connection, water heater, toilet mechanism, faucet and mixing valve as necessary and appropriate; said shut off valves being located under said interior floor as close as possible to said appliances.

* * * * *